US010470554B2

(12) United States Patent
Kovac

(10) Patent No.: US 10,470,554 B2
(45) Date of Patent: Nov. 12, 2019

(54) PORTABLE HYDRATION SYSTEM WITH INTEGRATED CIRCULATORY AND HEATING SYSTEM

(71) Applicant: Creative Law Enforcement Resources, Inc., South Pasadena, CA (US)

(72) Inventor: Kresimir Kovac, Fountain Valley, CA (US)

(73) Assignee: Creative Law Enforcement Resoures, Inc., Carson, CA (US)

( * ) Notice: Subject to any disclaimer, the term of this patent is extended or adjusted under 35 U.S.C. 154(b) by 0 days.

(21) Appl. No.: 15/592,924

(22) Filed: May 11, 2017

(65) Prior Publication Data

US 2018/0325246 A1 Nov. 15, 2018

(51) Int. Cl.

| | |
|---|---|
| ***A45F 3/20*** | (2006.01) |
| ***B65D 83/00*** | (2006.01) |
| ***B65D 81/18*** | (2006.01) |
| ***B05B 9/08*** | (2006.01) |
| ***B05B 1/30*** | (2006.01) |
| ***B05B 9/043*** | (2006.01) |
| *B05B 9/00* | (2006.01) |
| *A45F 3/16* | (2006.01) |
| *B05B 9/047* | (2006.01) |
| *B05B 11/00* | (2006.01) |

(52) U.S. Cl.

CPC ..... *A45F 3/20* (2013.01); *B05B 1/3093* (2013.01); *B05B 9/043* (2013.01); *B05B 9/0861* (2013.01); *B65D 81/18* (2013.01); *B65D 83/0055* (2013.01); *A45F 2003/163* (2013.01); *A45F 2003/166* (2013.01); *B05B 9/002* (2013.01); *B05B 9/047* (2013.01); *B05B 9/0888* (2013.01); *B05B 11/3092* (2013.01)

(58) Field of Classification Search

CPC ..... A45F 3/20; A45F 3/04; A45F 2003/166; A45F 2003/163; Y10S 383/906; B05B 9/043; B05B 9/0861; B05B 9/002; B05B 9/047; B05B 9/0888

USPC ..... 222/92–107, 175, 386.5

See application file for complete search history.

(56) References Cited

U.S. PATENT DOCUMENTS 1,676,358 A * 7/1928 Schott ..... F16N 13/08 222/340
2,117,907 A * 5/1938 Ogden ..... E03B 7/08 137/337
4,424,916 A * 1/1984 Pearson ..... A47K 5/18 222/105
5,059,182 A * 10/1991 Laing ..... A61M 5/1483 222/95

(Continued)

*Primary Examiner* — Charles Cheyney

(74) *Attorney, Agent, or Firm* — Smyrski Law Group, A P.C.

(57) ABSTRACT

A hydration system is provided. The hydration system includes a container configured to receive and maintain a quantity of liquid, a pump connected to the container, a hose system comprising a plurality of hoses connected to the container and the pump and configured to receive liquid from the container, and an end piece connected to one of the plurality of hoses configured to be used by a user of the hydration system. The pump is configured to circulate liquid through the hose system and container to maintain a relatively similar liquid temperature for all liquid contained in the hose system and container.

15 Claims, 46 Drawing Sheets

(56) References Cited

U.S. PATENT DOCUMENTS

| | | | | | |
|---|---|---|---|---|---|
| 5,115,947 | A * | 5/1992 | McDonnell | A62C 15/00 | 141/111 |
| 5,992,531 | A * | 11/1999 | Mikulec | A62C 13/00 | 169/33 |
| 6,854,888 | B1 * | 2/2005 | Brown | A45F 3/20 | 222/107 |
| 7,007,502 | B2 * | 3/2006 | Kreutzmann | A42B 3/048 | 62/457.2 |
| 7,806,300 | B1 * | 10/2010 | Noell | A45F 3/20 | 222/175 |
| 8,083,105 | B2 * | 12/2011 | Reichert | A45F 3/20 | 220/703 |
| 8,220,664 | B1 * | 7/2012 | Teetzel | A45F 3/20 | 222/175 |
| 9,480,762 | B2 * | 11/2016 | Wang | A61L 2/18 | |
| 9,624,083 | B2 * | 4/2017 | Tuggle | B67D 1/0004 | |
| 9,642,980 | B2 * | 5/2017 | Alizoti | A61M 16/0816 | |

* cited by examiner

PORTABLE HYDRATION SYSTEM WITH INTEGRATED CIRCULATORY AND HEATING SYSTEM

BACKGROUND

I. Field

The present invention relates generally to the field of body worn hydration systems, and more particularly, to hydration systems that employ fluid circulation techniques.

II. Description of the Related Art

Water is a basic human necessity and is required at a high level by persons engaged in exercise and other endeavors, including but not limited to military service and police work. When water is not readily accessible, people employ a variety of containers to carry personal supplies of water depending on their anticipated daily activities. Numerous individuals undertake activities, tasks, or duties that require quantities of water maintained on their person for consumption. Persons may also be involved in recreational activities, such as camping, backpacking, running a race, or activities that necessitate carrying a quantity of water, which may not be resupplied or refilled for an extended period. (For the purposes of this document, the use of the term "water" is used generally to reference water as well as any other liquids consumable by human beings or any other living organisms).

Specific professions such as military soldiers and law enforcement officers may be deployed for extensive or even unknown periods of time and need to carry large quantities of heavy equipment such as uniforms, helmets, ballistic equipment, backpacks, weapons and other items of equipment on their person. This equipment may be bulky, constricting, hot, non-ergonomic and heavy. Military soldiers, law enforcement officers, and others may work long shifts, so their hydration and well-being are especially important to ensure they have the capacity to conduct their duties over an extended period of time with no logistical support.

Single or multiple containers may be carried on the person for the purposes of transporting and having fluids such as drinking water available. These liquid containers have typically been constructed in various sizes, weights, durability and configurations in order to carry liquids on the person. Such previous liquid containers possess a variety of efficiencies related to the quantity of liquids carried, insulation, ease of use, ergonomics, method carried or transported, durability, size of the container, and other factors. These factors are critical when related to body worn equipment to ensure liquid containers may be carried for extended distances, time periods, strenuous activities, etc. Previous designs may require the user to use both hands in order to carry or employ a container, or the container may be positioned on the body, leaving the hands free to conduct unrelated tasks.

For the purposes of this document, the term "containers" refers to any variety of systems and items that may be utilized to carry water or other liquids. Containers may be constructed of various materials such as plastic, rubber, metal, vinyl or any other materials. Containers may also include mounting systems for carrying upon a person, as well as a closure system, which may be utilized to ensure liquid is maintained inside the container.

Military soldiers and others have carried water on their person via the use of a variety of containers, which may have a mechanism, such as a cap, top or other system securing the liquids inside. The modern means of carrying water upon the person and hydration for military soldiers has been a container with a screw top cap, commonly referred to as a military "canteen." The canteen has been in use by nearly all military personnel worldwide for over 100 years. Canteens may hold approximately one liter of liquid and are generally attached to the body of a person via clips, brackets, loops or other similar means. Alternately, canteens may be carried within a secondary container or pouch attached to the body of a user.

Canteens have a number of limitations. While they may be small and durable, they are generally limited in the volume of liquid able to be carried on the body of the user. As a result, more than one canteen is generally carried on a person, thereby monopolizing valuable carrying space. Canteens may be inefficient in hydrating persons when utilized in various positions that are common to active military soldiers and others. For example, a soldier is often in a prone position (laying upon the ground) for extended periods of time and is required to minimize movement. Moreover, a soldier may be concealed via camouflage in a prone position while carrying out an ambush on enemy combatants. During this time, attempting to drink from a canteen is difficult, inefficient and causes excessive movement, which may reveal the location of the user to enemy personnel, thereby endangering safety.

Another limitation of modern canteens is that they are often constructed of hard and inflexible materials such as plastic, metal, etc. When a canteen is full, the water carried within the canteen makes no sound. When a soldier drinks from a canteen, the reduction in liquid can create a sloshing effect inside the canteen when the user moves. The sound of water sloshing inside the canteen while a soldier is moving may create a dangerous situation when enemy combatants are nearby, alerting them to the soldier's location. Soldiers may be hesitant to drink water or may empty the container to prevent unnecessary sloshing noise. Lastly, the water inside a canteen may become either too hot or freeze depending on the environment and weather conditions.

Hydration packs were developed and introduced to resolve some of these problems experienced with canteen style systems. Hydration packs utilize a flexible bladder system or bag to store water. The bladder may be manufactured of rubber, vinyl, plastic or any other materials. The bladder may possess an opening or cap, which provides a means to fill the bladder with liquid. The bladder also possesses a connection point at the bottom of the bladder, which provides the capability of attaching a hose or tube. Many current hydration packs possess a valve at the end of the hose, which is utilized to stop water from leaking out and provides a component that goes inside the user's mouth when the user wants a drink. A user of a hydration pack sucks on the tube in the same manner as sucking on a straw in order to drink the water located inside the hydration pack.

Hydration packs are generally much larger in volume than canteens, and are therefore able to hydrate a user over much longer periods of time with minimal movement on the part of the user or sloshing within the pack. The hydration pack systems may also be easily utilized while in the prone position, as the user is not forced to elevate the system over his/her mouth in order to drink from the drinking tube.

Hydration packs generally store between two and five liters of water inside the bladder. The hydration bladders may be positioned or stored inside purpose built backpacks or similar systems, which are worn by the user like a backpack. The backpack system may be capable of carrying numerous other items or may be built with the purpose of carrying only the hydration bladder. The hydration tube may be routed outside the hydration pack and may be left near the front side of the user for ease of access. The hydration packs may be carried on top of a user's clothing and equipment, or be worn underneath.

Many currently available hydration packs have additional benefits over canteens. In addition to simply being able to carry more liquid, a hydration pack has a flexible bladder that collapses upon itself when a user drinks water. As a result, no air is introduced into the bladder system, thereby preventing the sounds of sloshing when the user moves after drinking. The hydration bladder is also easier to drink from in any position, including the prone position. A hydration pack does not require the need to unscrew a cap or similar system to drink fluid, thus providing an efficient and safer way for soldiers to consume liquids without having to use both hands.

Nonetheless, current hydration packs still possess certain issues and weaknesses. When soldiers and law enforcement officers wear hydration packs, the water inside the hydration bladder may become too hot or too cold to drink due to the ambient temperature of the environment in which the user is located. Even if a hydration pack contains ice, the water inside the drinking tube or hose on a hot day will likely be hot due to the lack of insulation and the ambient temperature of the environment.

The techniques for drinking cold water out of existing hydration pack system designs tend to be wasteful and/or ineffective. If a user wants to drink cold water inside the hydration bladder when ice is employed, the user may spit out the warm water that is situated inside the drinking tube prior to sucking cold water from the hydration bladder. This method is inefficient in that it wastes the limited supply of water carried by the user. The user may also swallow the warm water located in the drinking tube, which is counter-productive, as it is not refreshing and may have a limited effect on reducing the user's core body temperature in a hot environment. Finally, the user may utilize his or her mouth to blow the warm water in the hydration hose back into the bladder of the hydration pack, allowing the hose water to mix with the cold water inside the hydration bladder. The user would then suck the water back up the drinking tube in order to drink. This technique intensifies user fatigue, introduces air into the bladder system, and permits bacteria to enter the hydration pack.

Current hydration packs are also generally unable to pour or spray water from the system without the use of an external pumping mechanism, unless the user removes the hydration pack and upends its contents. This pumping maneuver is impractical for soldiers and law enforcement officers because it creates air pressure within the hydration pack that extends to the other equipment on a soldier's back. Such a pump maneuver would also require the soldier to exert energy, would take a significant amount of time, and would require use of one hand in critical moments. Forcing a user to remove the hydration pack, from his or her person, in order to open it and pour out its contents is impracticable, time consuming and inefficient.

Police officers, military soldiers and officials, and athletes are frequent users of hydration packs due to the physically demanding nature of their activities. As military soldiers and law enforcement officers are involved with operations in radically different environments with extreme temperatures that can rapidly change, water containers or hydration systems should provide efficient and effective means for providing sustenance to its users. Moreover, as athletes require refreshment and hydration, they prefer cool water that can lower their internal temperature and allow them to continue their activities.

There is a need for a modern hydration system that is wearable, efficient, and effective in providing liquids to its wearer. The system should prevent the introduction of air and bacteria and prevent sloshing sounds during user movement. The hydration system should have the ability to readily maintain hot or cold water in a manner that is readily accessible to the user. There is also a need for a hydration system that has the ability to discharge water with a spraying function for a variety of purposes, as well as other capabilities, without the need for the user to suck on the drinking tube.

It would be highly beneficial to offer a hydration pack wherein the user may consistently receive cold water in a hot environment, or warm water in cold environment. Such a system would be effective in maintaining a user' core body temperature and enhancing his or her physical performance and well being.

SUMMARY

According to one aspect of the present design, there is provided a hydration system comprising a container configured to receive and maintain a quantity of liquid, a pump connected to the container, a hose system comprising a plurality of hoses connected to the container and the pump and configured to receive liquid from the container, and an end piece connected to one of the plurality of hoses configured to be used by a user of the hydration system. The pump is configured to circulate liquid through the hose system and container to maintain a relatively similar liquid temperature for all liquid contained in the hose system and container.

According to another aspect of the present design, there is provided a hydration system comprising a deformable container configured to receive and maintain a quantity of liquid, a pump, and a hose system comprising a plurality of hoses connected to the deformable container and the pump and configured to receive liquid from the deformable container. The deformable container is configured to be worn on a person and the pump is configured to circulate liquid through the hose system and deformable container.

According to another aspect of the present design, there is provided a hydration system comprising a deformable container configured to be maintained on the person of a user and further configured to receive and maintain a quantity of liquid, a pump, and a hose system comprising an end piece and a plurality of hoses connected to both the deformable container and the pump and configured to receive liquid from the deformable container and provide liquid in a desired manner. The pump is configured to circulate liquid through the hose system and deformable container.

Various aspects and features of the disclosure are described in further detail below.

DETAILED DESCRIPTION

Figure 1:
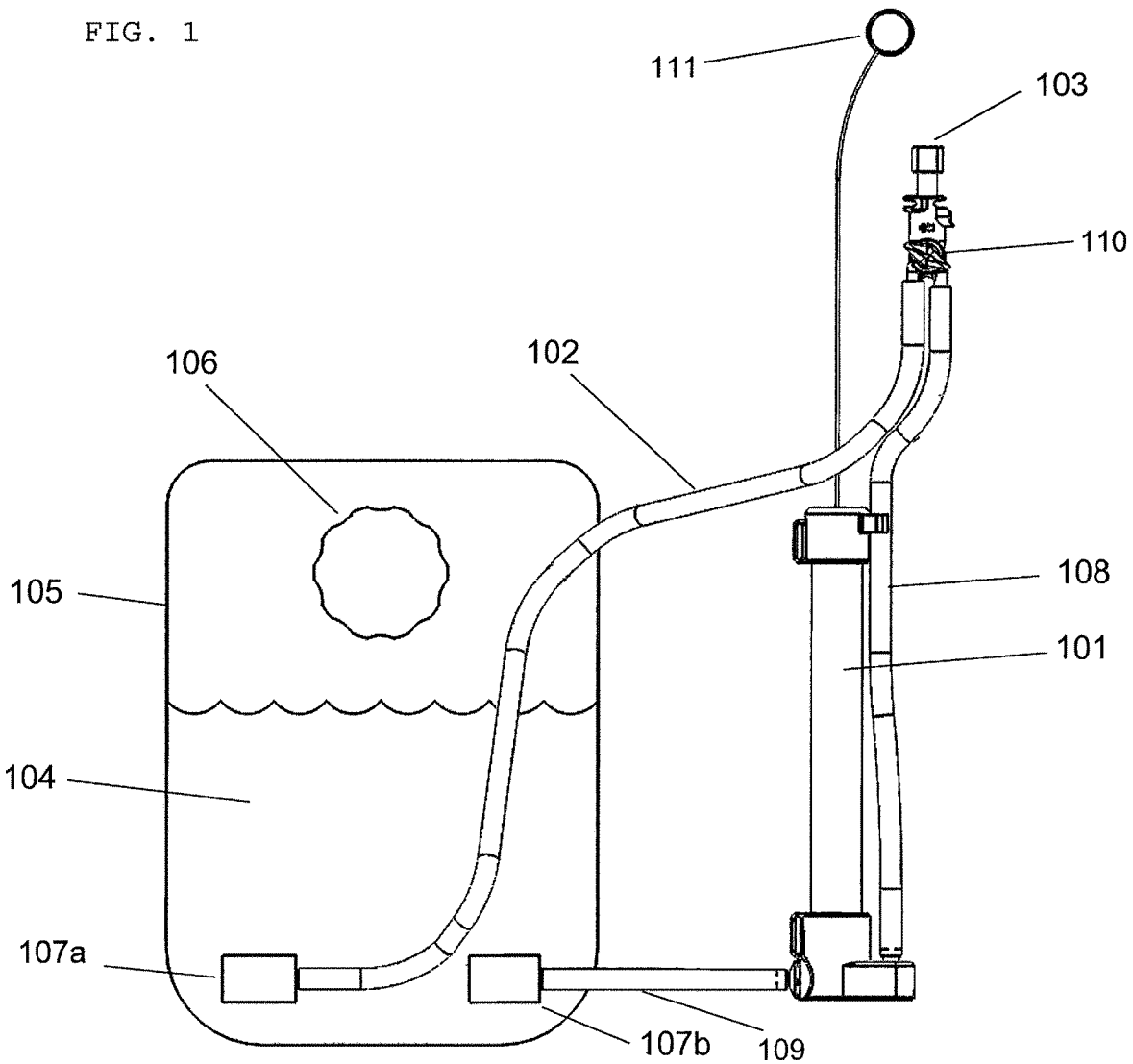
FIG. 1 shows a hydration system overview with dual tube and pump.

The present design enables law enforcement officials, military soldiers, athletes, construction workers and other interested individuals involved in numerous duties and activities to employ a hydration pack containing a recirculating pump system 101 which employs a dual hose design 102 and 108 that integrates the drinking tube opening 103 as depicted in FIG. 1. The design permits the user to continuously consume cold water 104 from the hydration bladder 105 by circulating this water 104 through the dual hose (hoses 102 and 108) configuration. This device would ultimately allow users to instantly consume cold water while in a hot environment, without having to drink the hot water located inside the drinking feeder tube 108 and/or the drinking return tube 102, and without the exertion required to suck liquids out of a long drinking tube. For soldiers, law enforcement officers and athletes in particular, this system increases their capabilities, performance, alertness, and overall well being in the field.

As used herein, various terms are employed and are intended to be used in the broadest sense possible. For example, the present application uses the term "officer" or "law enforcement officer" or otherwise to indicate the individual employing the system, and such a term is meant to broadly encompass any individual who may have use for such a device or system, including but not limited to police officers, military personnel, corrections officers, security personnel, athletes or other interested individuals. Additionally the term "water" is utilized as a generic term to encompass any form of liquid which may be carried, utilized or consumed from or within the hydration system as described in the various configurations.

As depicted in FIG. 1, one design for this system may include a flexible bladder 105 or reservoir utilized for the storage of various quantities of water or other liquids on the person. The terms "bladder," "reservoir," "container," or the like, are intended to convey any items which may be utilized to carry, store, contain, etc. liquid or liquids pursuant to this design. It is understood the system is not limited to that described, and the design incorporates all similar or disparate arrangements and/or components that may be utilized to provide the system. The system may employ one water bladder 105, two, or even a series of water reservoirs acting in concert in order to create a hydration system while still within the teachings of the present design. The walls of the water reservoir 105 may be rigid or flexible, and may be constructed of rubber, vinyl, plastic, metal, mesh or any variety or combination of materials. The water bladder 105 may have an opening 106 situated on the top of the bladder 106 or located in any other area for the purposes of filling the bladder system 105 with liquid. The opening may utilize a cap 106 and collar system, which may be attached to the bladder 105 in order to provide the ability to securely close the hydration bladder 105 once it has been filled with liquid 104. The bladder opening 106 may also encompass a variety of different components or means to open and close the bladder 105 when filing it with liquid. It is understood that the present design is not limited to the descriptions noted herein or referenced in the drawings and may encompass numerous other iterations which achieve the intent of the design.

The present design also includes one, two, or more coupling points 107*a* and 107*b* integrated or attached to the bladder reservoir 105. The coupling points 107*a* and 107*b* allow liquid 104 contained within bladder 105 to enter or leave bladder 105 at these coupling points 107*a* and 107*b*. The coupling points 107*a* and 107*b* may include any of a number of specialized systems which allow the attachment of additional pieces such as hoses, tubes, coupling parts, sensors, pumps or any other appropriate parts. The coupling points 107*a* and 107*b* may be designed as separate pieces and points on bladder 105, or may be a one-piece design attached to bladder 105. The coupling points 107*a* and 107*b*, or couplers, and other attachment points may be permanently affixed, removable, or have a quick attachment and disconnect feature.

Figure 2:
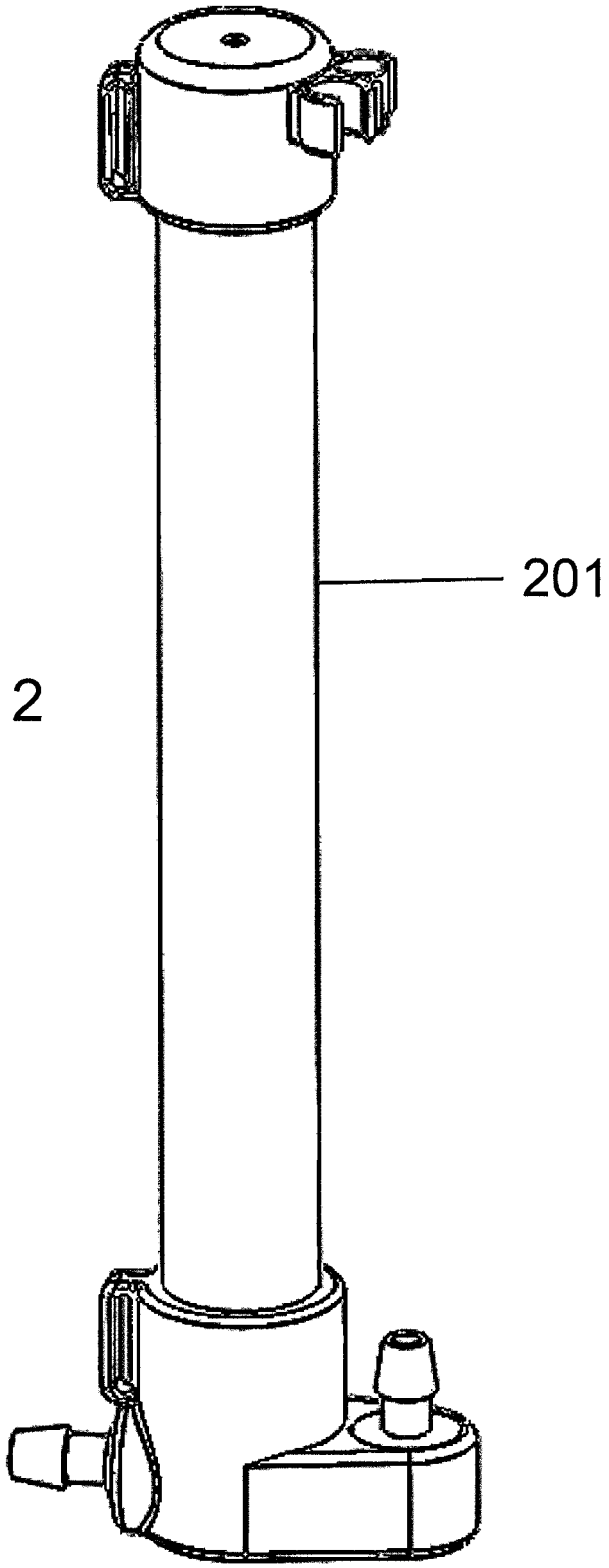
FIG. 2 illustrates a manual pump system.

The design may also include a self-contained or segmented pump system 101. The pump system 101 may be integrated into bladder 105, or into the carrying pack, or may include various components attached to bladder 105, or may be separate from the system and attached via coupling points 107*a* and 107*b* or other coupling system. Such integration may be provided by any appropriate means. As shown in FIG. 2, the pump or pump system may include a tube shaped body 201 or other appropriate shape or design.

Figure 3A:
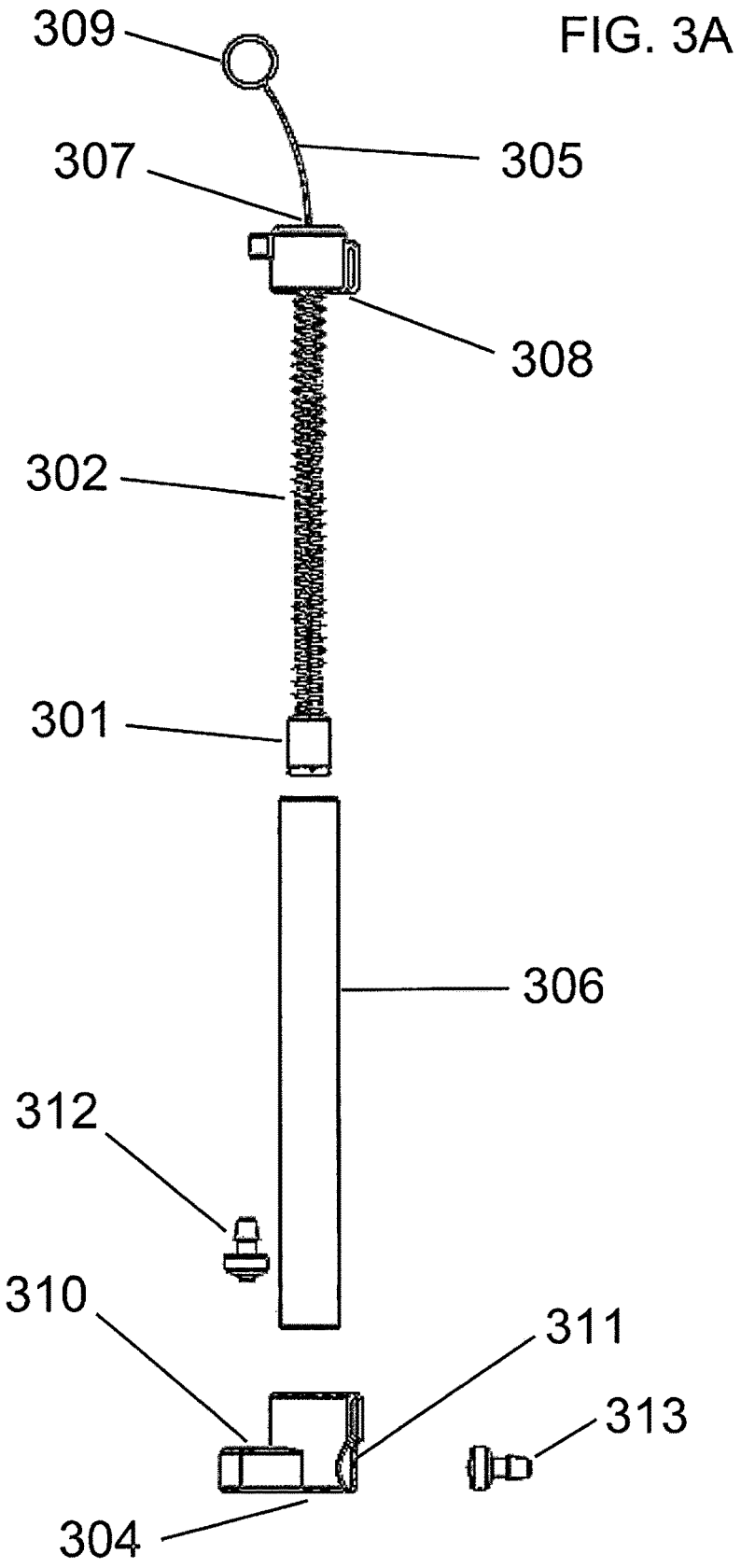
FIG. 3A is an exploded view of a manual pump system.

As shown in FIG. 3A, the pump may contain a plunger 301 or similar system designed to push or pull liquid within the pump system. The pump may contain an internal spring 302, as depicted in the drawing, utilize an external spring or any other manner of system which may provide positive or negative pressure on designated components. Bottom end cap 304, string or other system 305, pump body 306, opening 307, end cap 308, and handle 309 are shown, where bottom end cap 304 may contain one, two or more openings 310 and 311, which provide points for liquid to enter or be ejected out of the pump system. The openings in bottom end cap 304 may have attachment points 312 and 313.

In general, the present design includes a number of similar components shown in various similar drawings and in certain embodiments. Part numbering in certain drawings, such as those in FIG. 3A through and including FIG. 3F are generally intended to represent the same element or part, i.e. element 309 is intended to represent the same element (handle 309), in all of FIGS. 3A through 3F, and the same is true for all drawings herein. While certain elements may have differences, a single element number is intended to represent a similar or identical element.

Figure 3B:
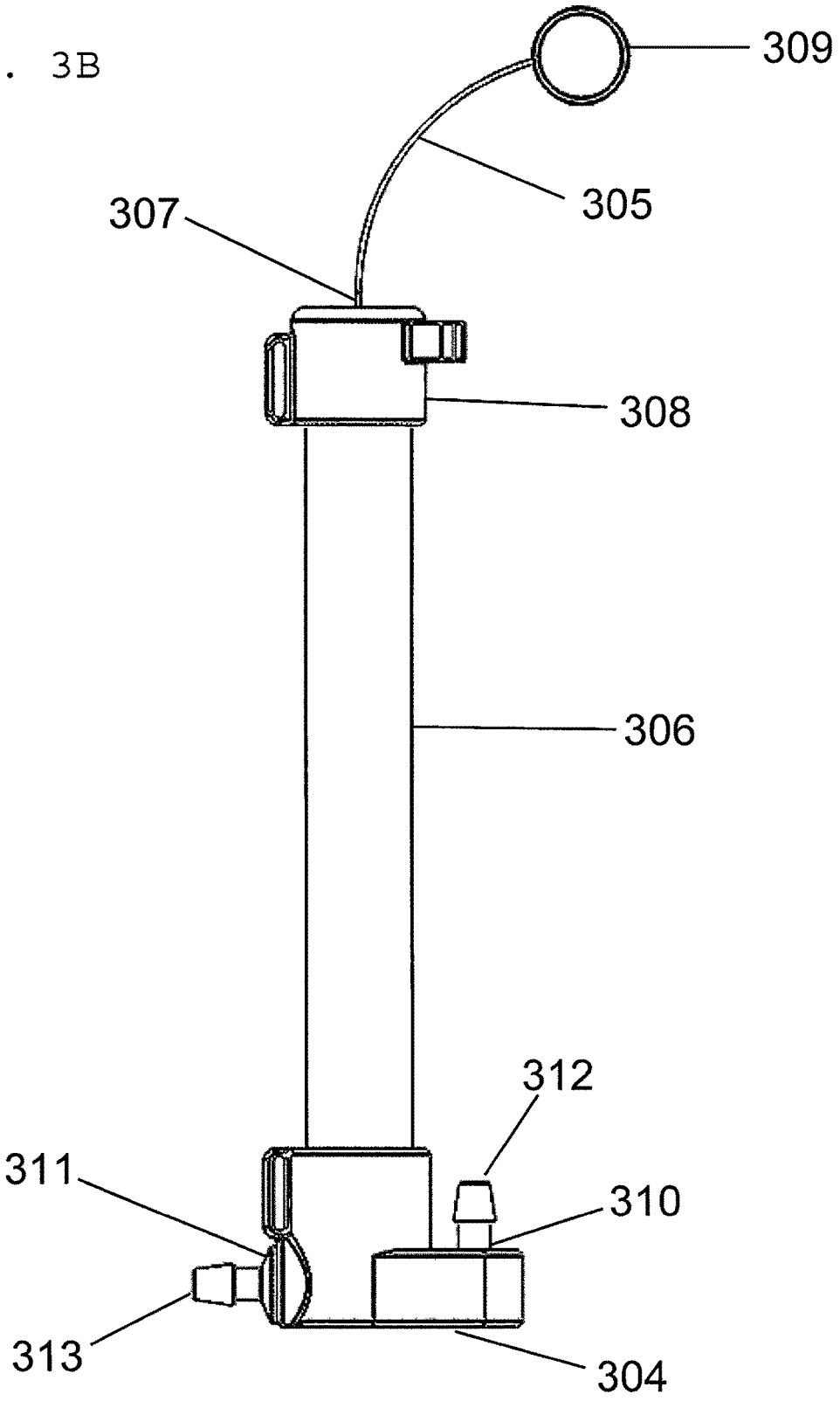
FIG. 3B depicts a manual pump system including the pump plunger.
Figure 3C:
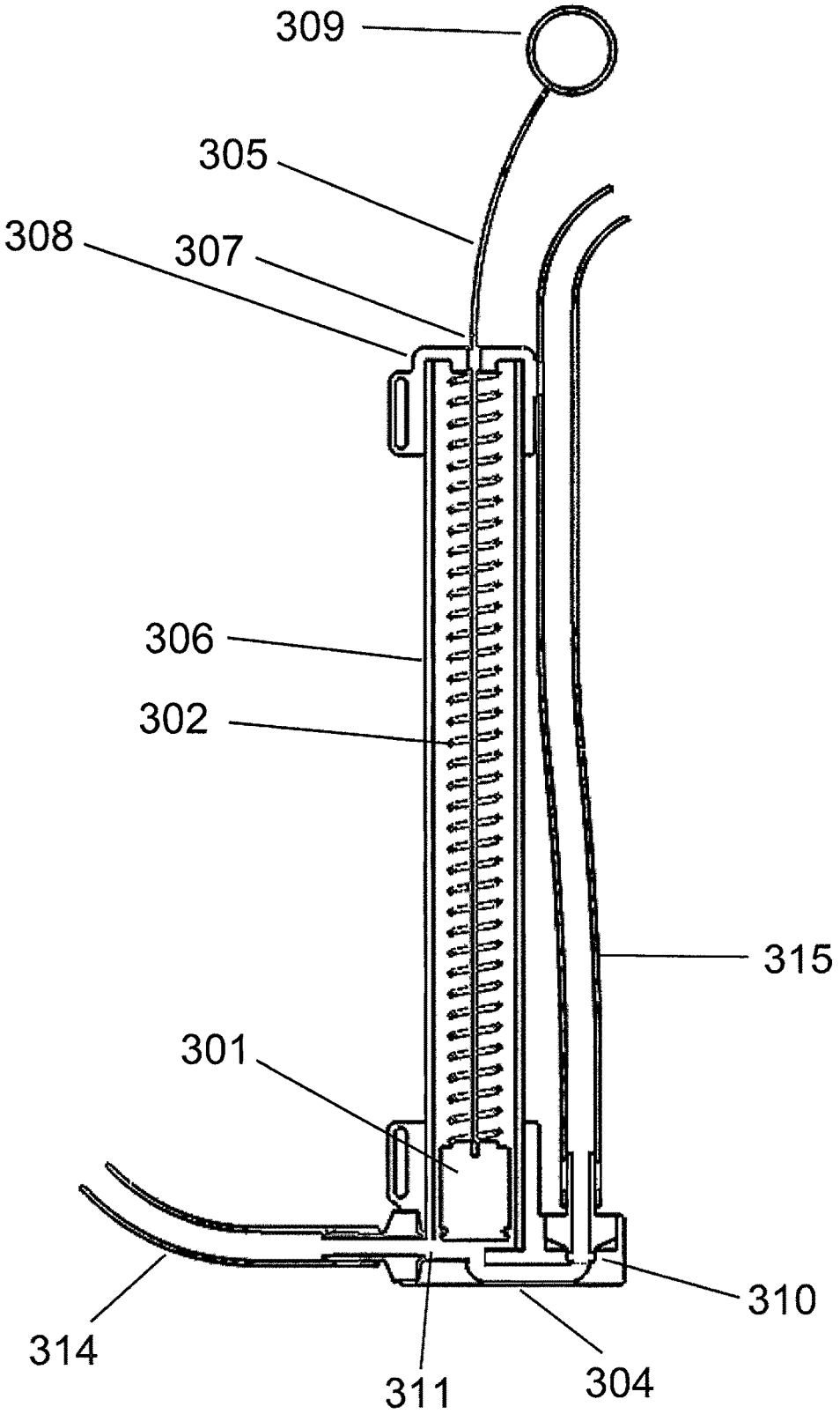
FIG. 3C illustrates the movement of the spring inside the manual pump system.
Figure 3D:
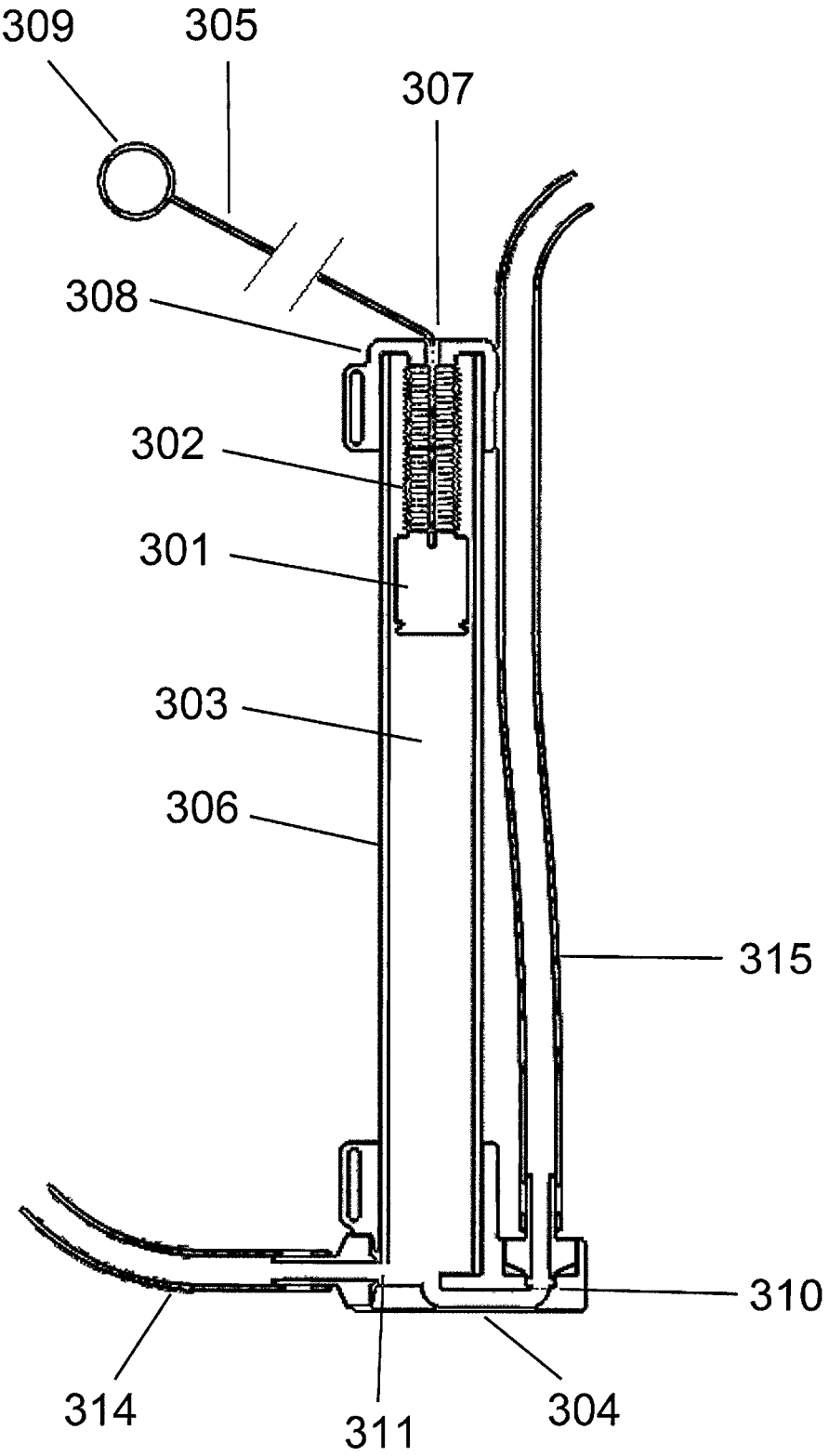
FIG. 3D shows the inflow of liquid within a manual pump system once the pull cord handle has been pulled.

FIGS. 3B, 3C, and 3D show alternate views of the design of FIG. 3A. From FIG. 3A, pump plunger 301 is pushed downward pursuant to pressure exerted by the pump spring 302. This positive pressure keeps water out of the pump chamber 303, unless the plunger 301 is pulled upward and away from the bottom end cap 304 of the pump. A cable, string or other system 305 may be attached to the top of the plunger 301 and may pass through the pump body 306 and spring 302. This cable, herein referred to as a pull cord 305, may be routed through an opening 307 located in the top end cap 308 of the pump. The pull cord 305 may have various attachment points integrated into its length or configuration. The pull cord 305 may have a covering, coating or other protective structure, or may be covered by a protective sheath allowing cable 305 to move freely within the sheath. A handle 309, connection point, or any other system may be linked to pull cord 305.

The pump may include a top end cap 308 secured to the top of the pump tube 306 or pump body, or may be manufactured as a component of the pump itself. The top end cap 308 may be fixed or removable to facilitate assembly, repairs and/or cleaning. The top end cap 308 may hold the pump spring 302 captive and ensure the spring 302 produces positive pressure against the plunger 301.

Bottom end cap 304 may be attached to or formed into the bottom or another appropriate part of the pump system. The bottom end cap 304 may include one, two, or more openings, such as openings 310 and 311, which provide points for liquid to enter into or be ejected out of the pump system. The openings in bottom end cap 304 may have attachment points 312 and 313 allowing for the attachment of tubes, pump feed tubes 314, drinking feeder tubes 315, components, parts, pumps, or any other systems in which liquids may be delivered into or removed from the pump. The bottom end cap 304, or other components, may include valves 316 and 317, allowing the flow of liquid in only one direction, in both directions, as well as opening or shutting the flow of liquids, or may provide the ability to control the amount of liquid allowed to flow through the system.

Figure 3E:
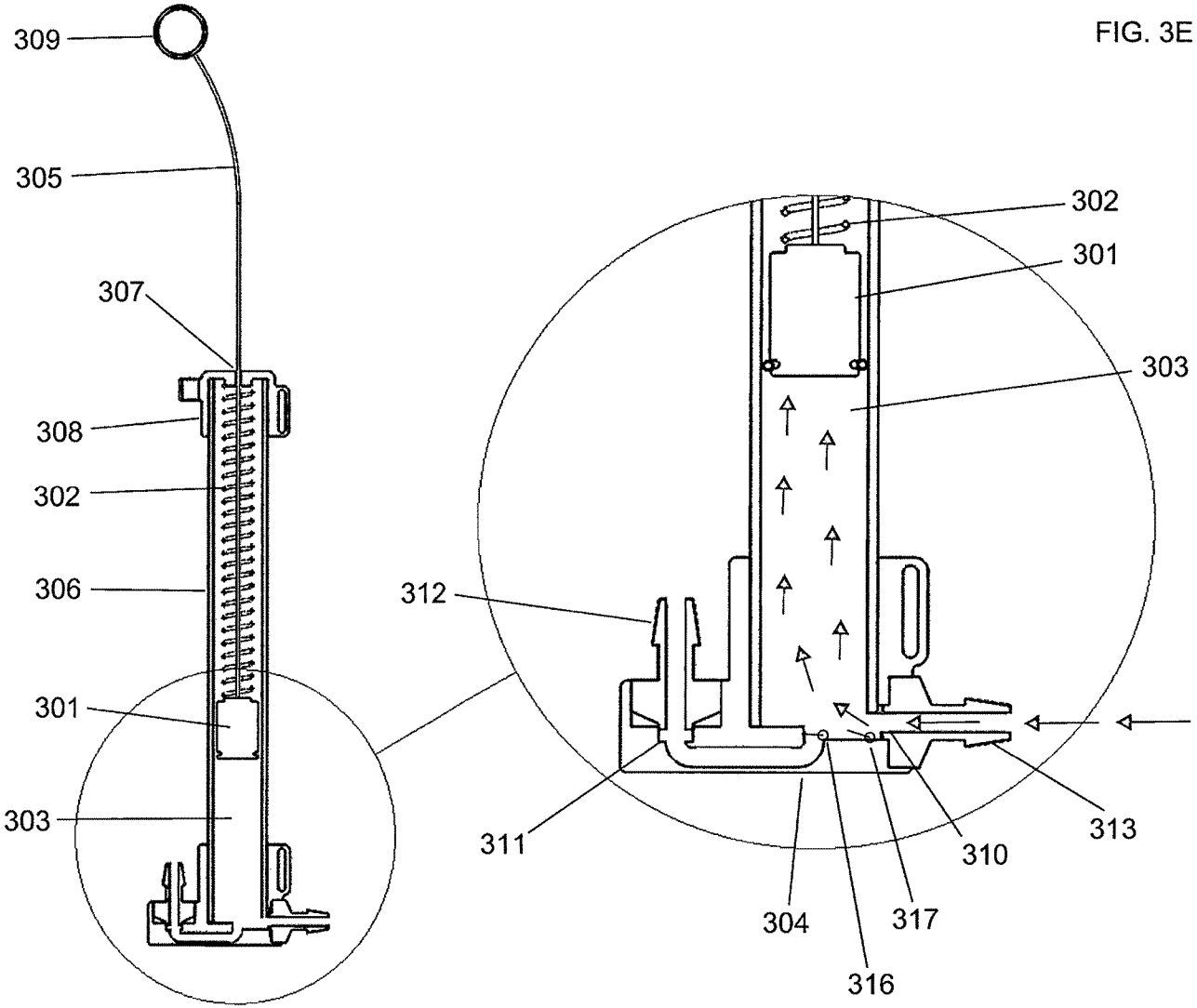
FIG. 3E illustrates the outflow of liquid from the manual pump system once the pull cord handle has been released.
Figure 3F:
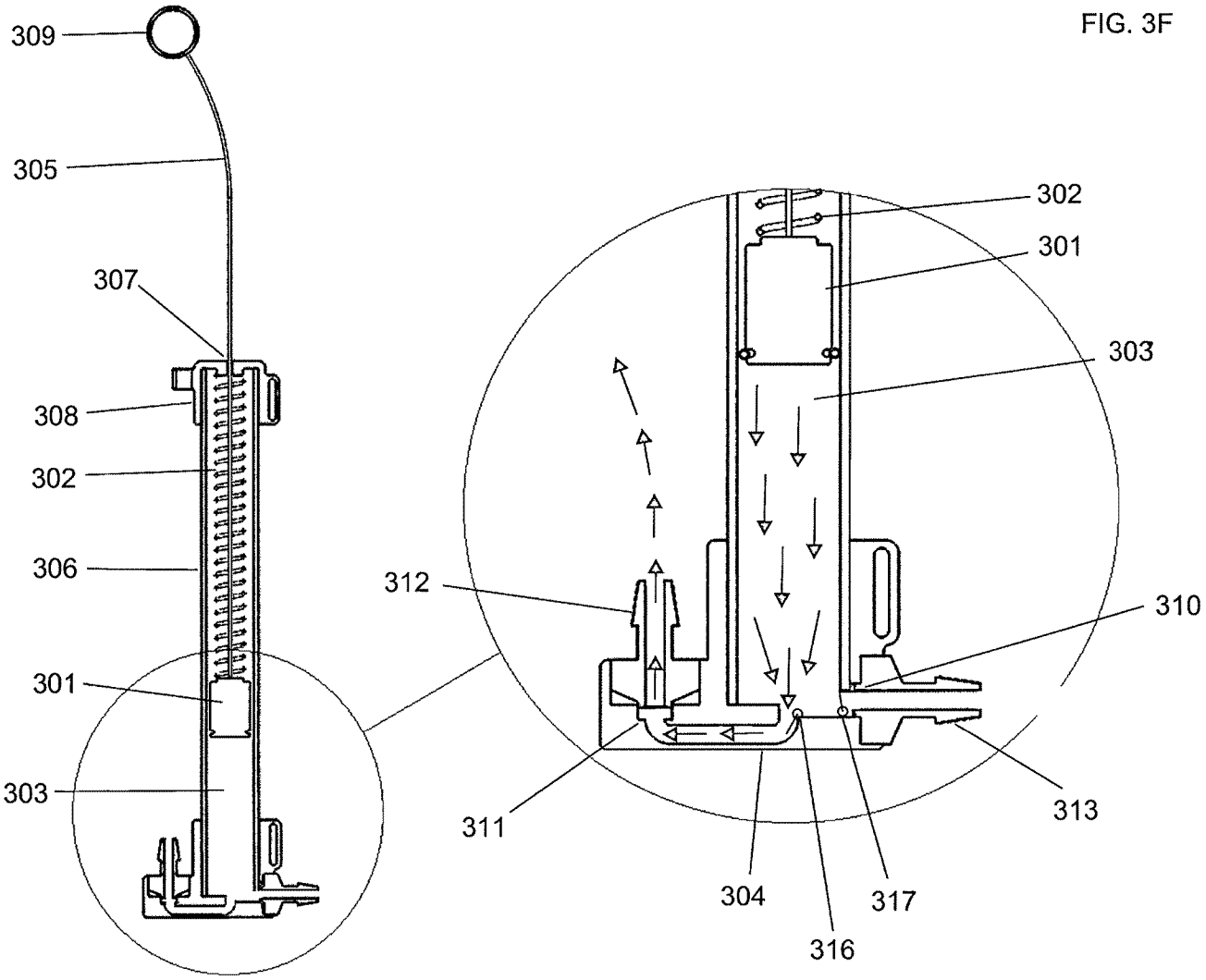
FIG. 3F shows a manual pump design where the pump chamber has been filled with liquid from the hydration bladder.

FIG. 3E shows a manual pump design in which the pull cord handle 309 has been pulled outward away from the pump body 306, thereby pulling up on the plunger 301 and depressing the internal pump spring 302. This action results in a negative vacuum or pressure being created within the pump chamber 303. A one-way valve 316 at the drinking feeder tube connection 313 remains closed, while a one-way valve 317 located at pump feed tube 312 is opened and allows liquid to enter the pump chamber 303. The plunger 301 may remain in the upward position as long as the pressure is exerted outward on the pull cord handle 309.

FIG. 3F illustrates a manual pump design where the pump chamber 303 has been filled with liquid from the hydration bladder. The pull cord handle 309 has been released in this view and main spring 302 exerts downward pressure toward bottom end cap 304. The pressure closes the one-way valve 317 connected to pump feeder tube 313, which opens one-way valve 316 connected to the drinking feeder tube 312.

As shown in FIG. 1, the pump 101 may connect to a drinking tube 102 or hose, herein referred as the drinking feeder tube 108. The bladder 105 may have a separate tube 102 attached, bypassing the pump system 101. This bypass is shown in this embodiment as drinking return tube 108. The tubes or hoses 102 and 108 may be individual tubes or constructed as one unified tube with two or more individual hoses embedded within.

Figure 4A:
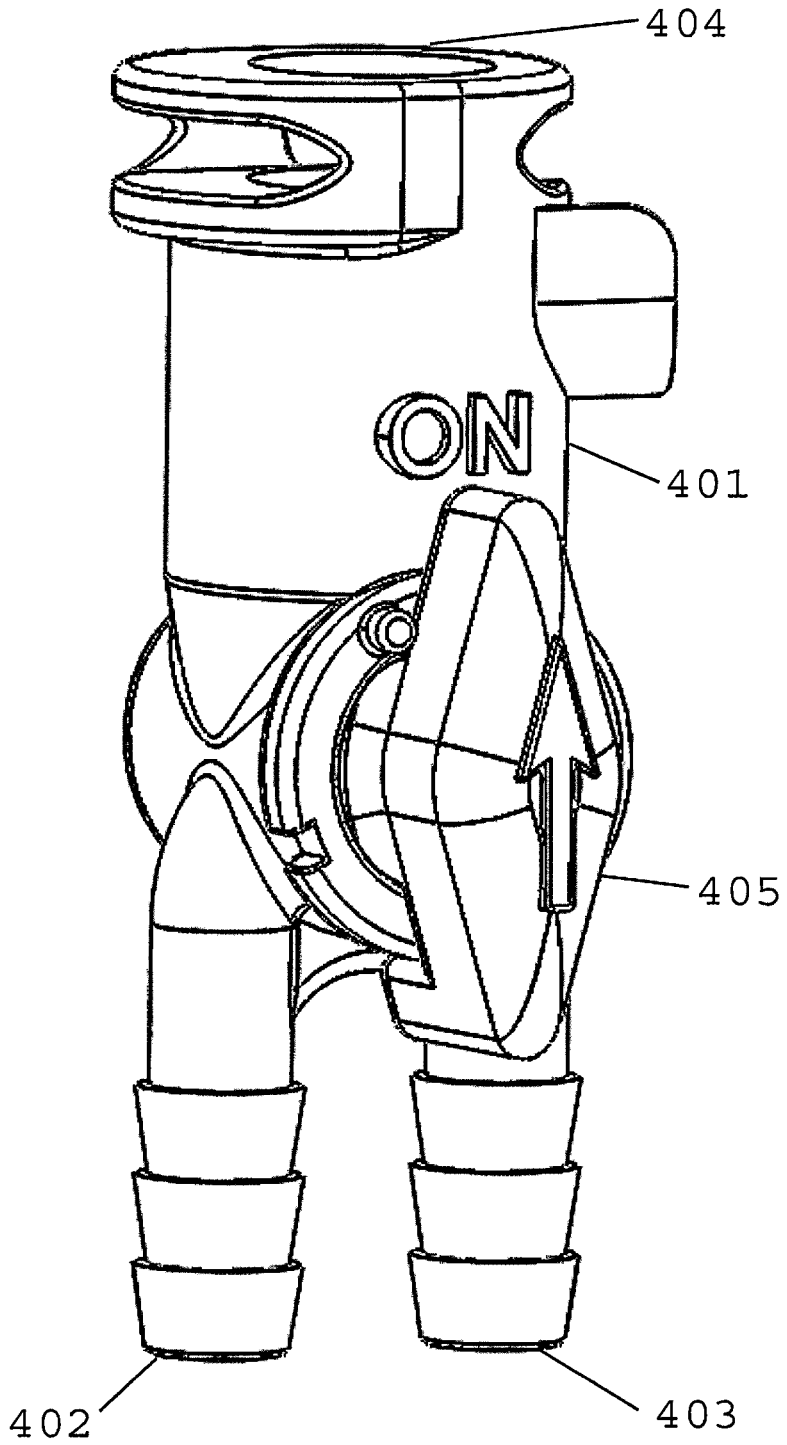
FIG. 4A illustrates the valve in an ON position.
Figure 4B:
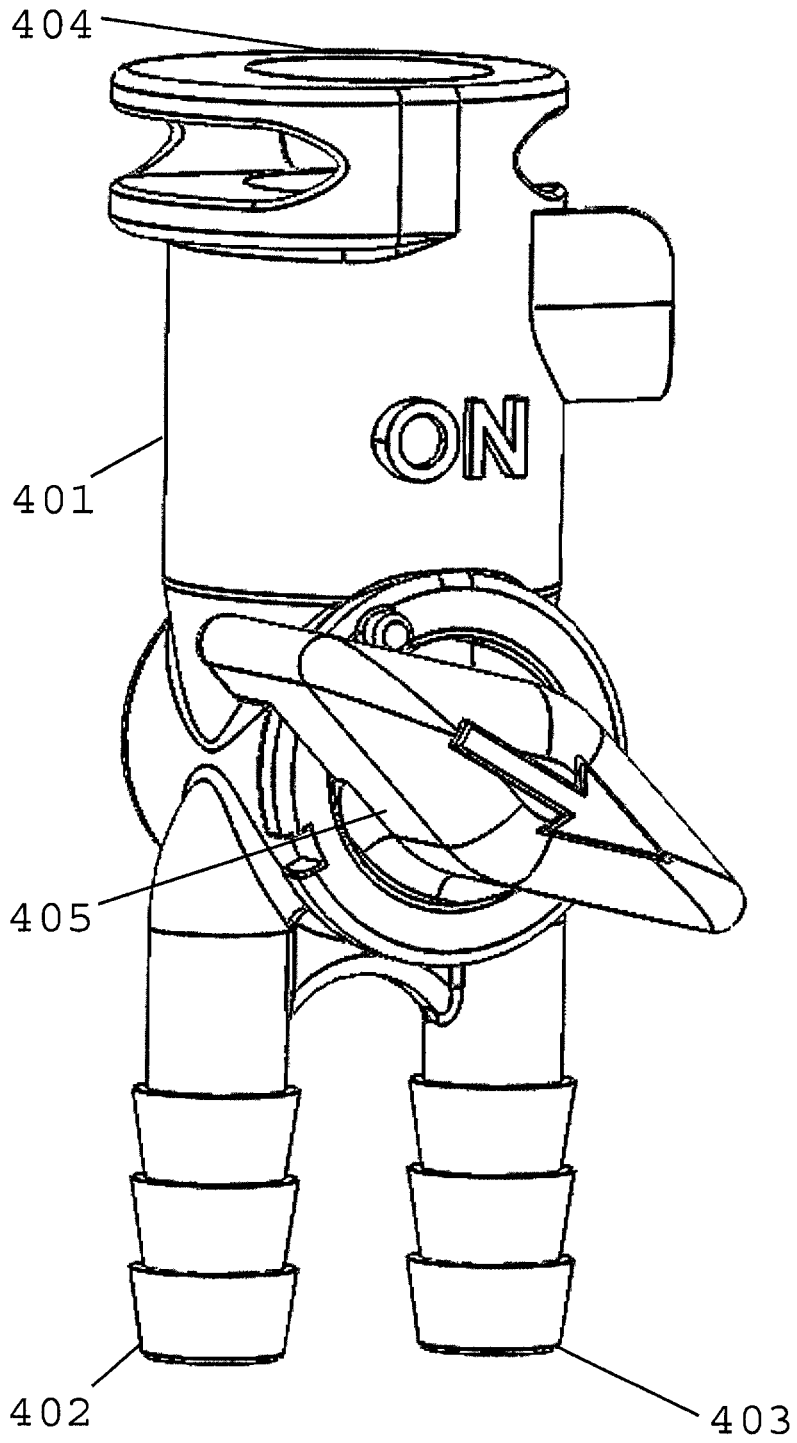
FIG. 4B shows the valve rotated away from the ON position.
Figure 4C:
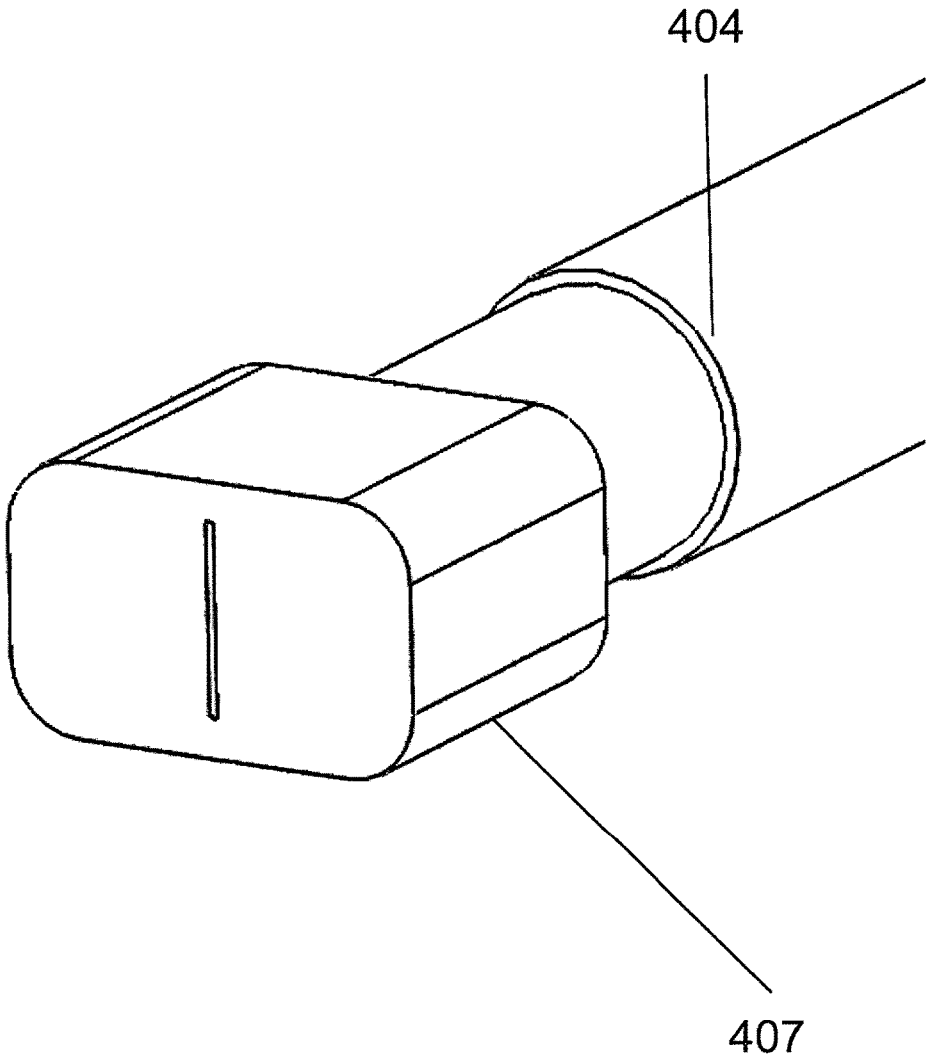
FIG. 4C shows a bite valve that may be employed with one embodiment of the present design.
Figure 4D:
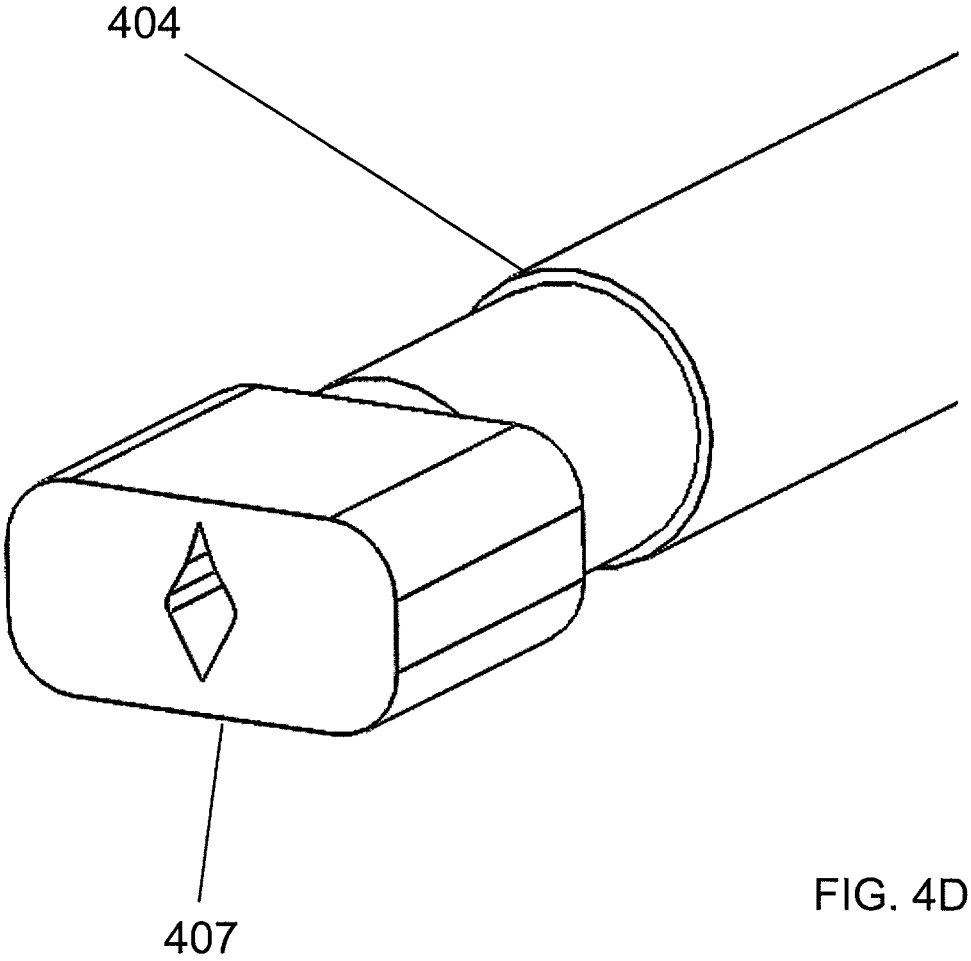
FIG. 4D is an alternate bite valve employable with the current design.

In FIG. 1, the drinking feeder tube 108 and the drinking return tube 102 may be connected to an end piece 103. As shown in FIGS. 4A and 4B, end piece 401 may connect both drinking tubes 402 and 403. End piece 401 may have an expansion chamber 406 inside to allow the free flow of liquid from one drinking tube 402 to another drinking tube 403. End piece 401 may also have an opening 404 to allow the discharge of liquid. From FIGS. 4C and 4D, the opening 404 may have a bite valve 407 or other device to ensure the opening remains closed unless the user has the end piece 401 in his/her mouth thereby preventing water or liquid from unnecessarily being wasted. Different shaped bite valves are shown in FIGS. 4C and 4D.

End piece 401 may also have a cap or cover to protect end piece 401 and bite valve 407 from dirt, exposure, impact, damage, leakage of liquids or other potential issues. The end piece 401 may incorporate a valve 405, which may have the ability to remain open, thereby allowing liquids to be discharged through the opening 404. Conversely, valve 405 may be closed by the user, preventing liquid from exiting opening 404, or valve 405 may reduce the amount of liquid discharged from opening 404.

Figures 4E, 4F, 4G:
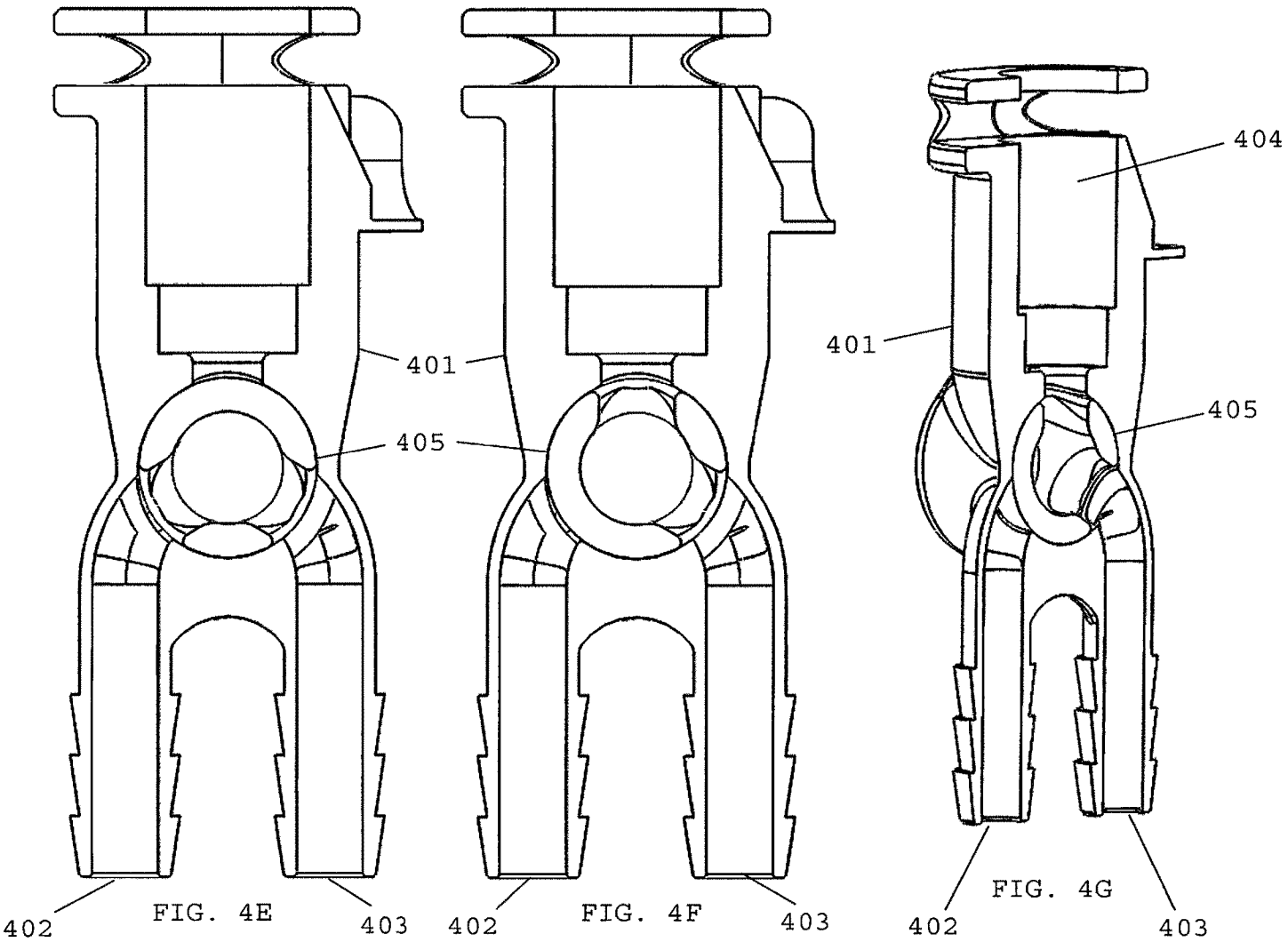
FIG. 4E represents a cutaway view of a valve providing no liquid to the user.
FIG. 4F is a cutaway view of a valve providing liquid to the user via one drinking tube.
FIG. 4G is an alternate cutaway view of the valve providing liquid to the user via one drinking tube.
Figures 4H, 4I, 4J, 4K, 4L:
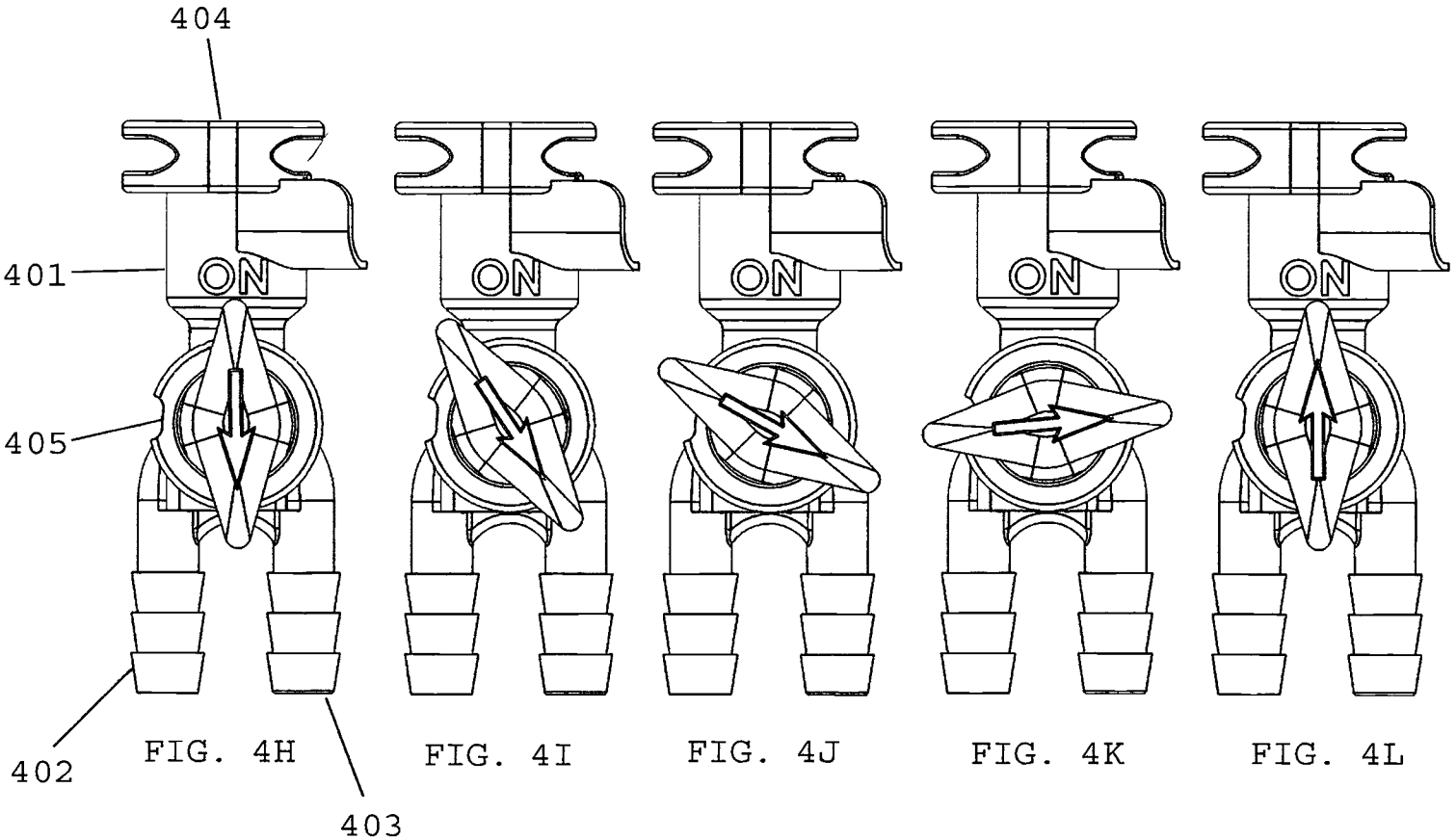
FIG. 4H shows a valve in a first position.
FIG. 4I shows the valve in a second position.
FIG. 4J shows the valve in a third position.
FIG. 4K shows the valve in a fourth position.
FIG. 4L shows the valve in a fifth (open) position.
Figure 4O:
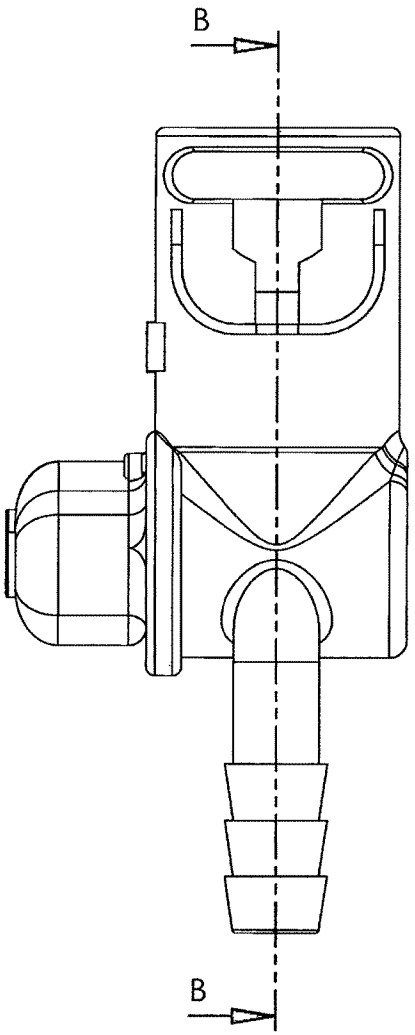
FIG. 4O is a side view of the valve of FIG. 4M.
Figure 4N:
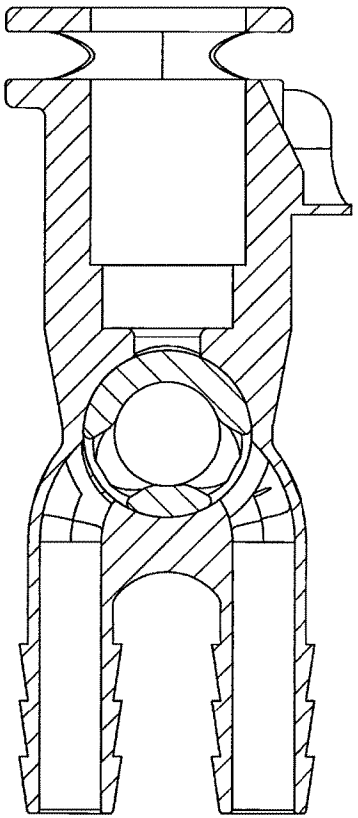
FIG. 4N is a cutaway view of the valve of FIG. 4M.
Figure 4M:
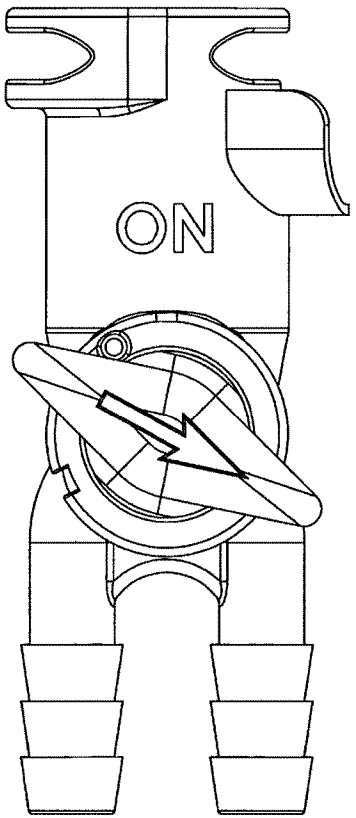
FIG. 4M shows a view of the exterior of the valve.
Figure 4R:
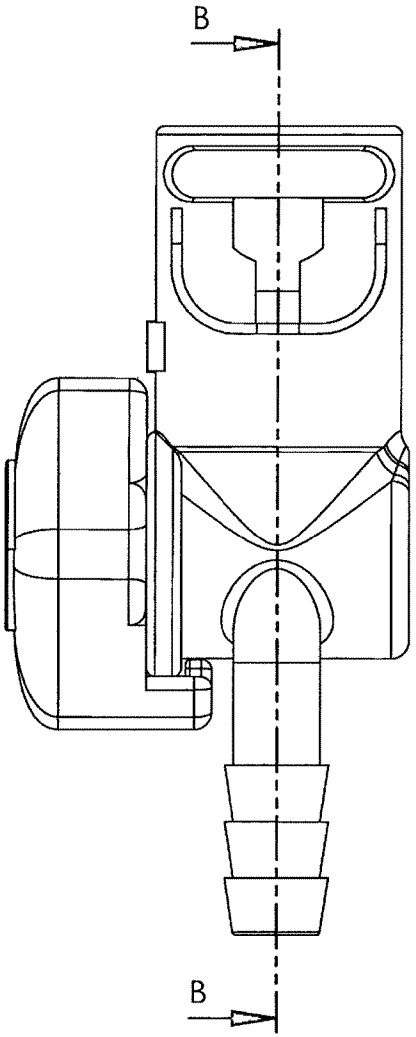
FIG. 4R is a side view of the valve of FIG. 4P.
Figure 4Q:
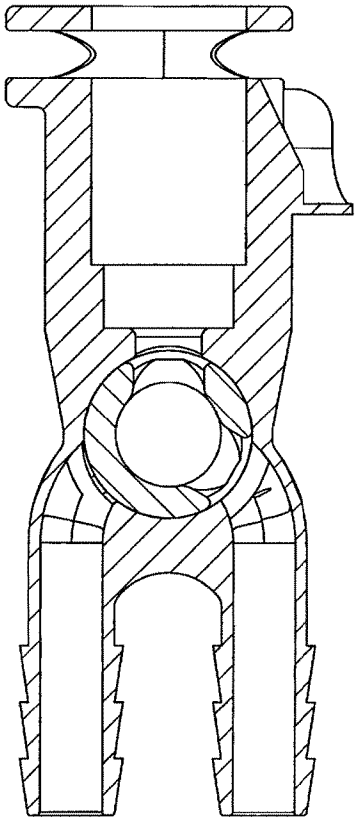
FIG. 4Q is a cutaway view of the valve of FIG. 4P.
Figure 4P:
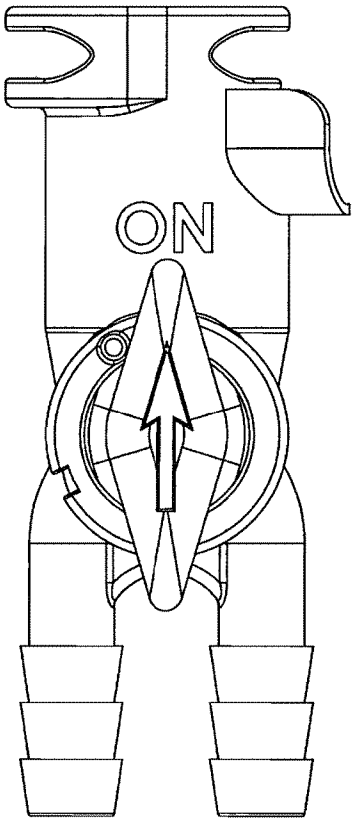
FIG. 4P depicts the valve in the ON position.

FIGS. 4E through 4R represent various aspects of the end piece. FIG. 4E shows the interior of an end piece 401 and the valve 405 routing liquid from the drinking feeder tube 402 through the opening 404 of the end piece 401 (FIG. 4E showing the valve connecting one drinking tube 402 to other drinking tube 403, and FIG. 4F connecting drinking tube 403 to end piece 401), or routes the liquid back into the drinking return tube 403. FIGS. 4H to 4L show that when the valve 405 is in the open position, only the drinking feeder tube 403 provides liquid to the user through the end piece 401. FIG. 4H is the Off position; FIG. 4I the pump on, mixing; FIG. 4J the pump on, mixing, with slightly greater valve rotation; FIG. 4K, pump on, cold water; and FIG. 4L, valve on, pump off. FIGS. 4M through 4O show the exterior when the valve 405 is rotated to an angle similar to that in FIG. 4I, FIG. 4N a cutaway view of FIG. 4M along line B-B in FIG. 4O, an FIG. 4O a side view. FIGS. 4P, 4Q, and 4R show the exterior when the valve is rotated at an angle similar to that of FIG. 4L; FIG. 4Q is a cutaway view of FIG. 4P along line B-B in FIG. 4R, and FIG. 4R is a side view of the configuration of FIG. 4P.

Figure 4S:
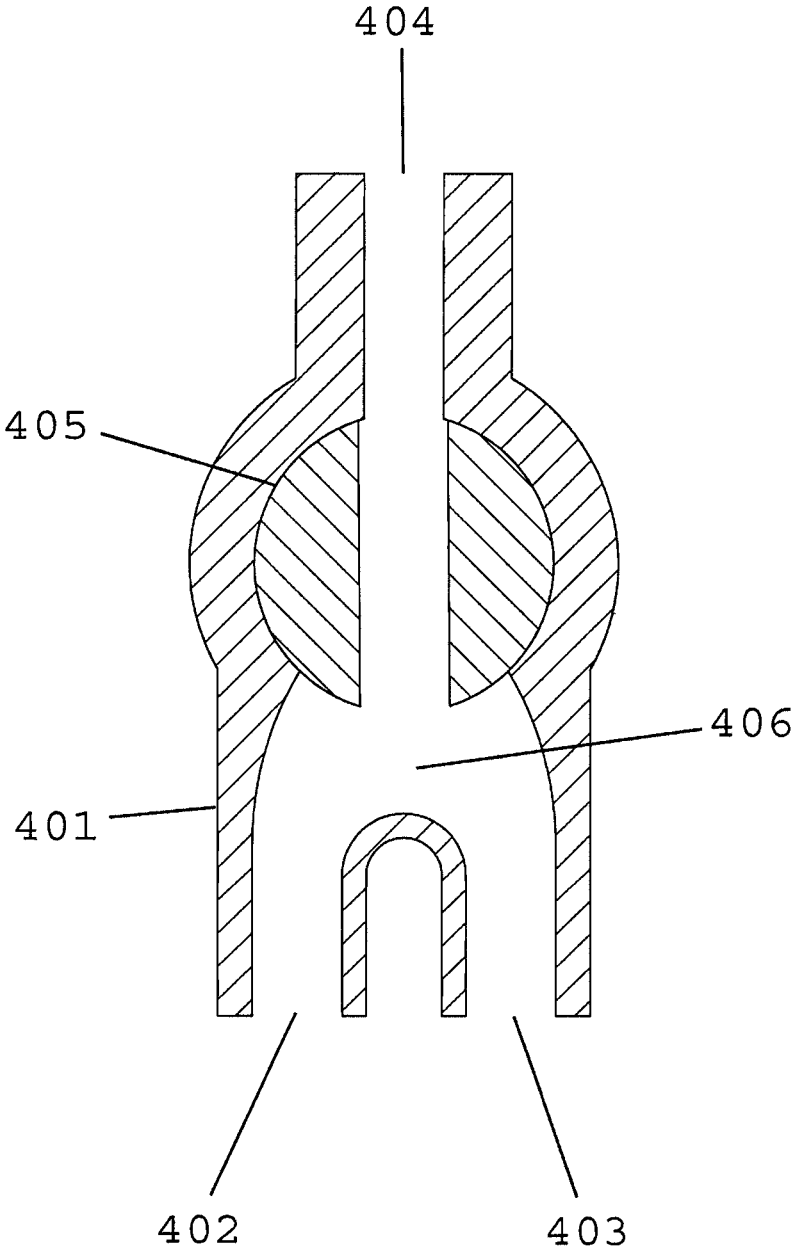
FIG. 4S is a cutaway view of an alternate valve in an open position.

FIG. 4S shows an alternate design in which the end piece 401 incorporates a valve 405 located next to an expansion chamber 406. When the valve 405 is in the "open" position, liquid is able to travel through the drinking feeder tube 403 and drinking return tube 402 into the expansion chamber 406. The liquid could then bypass the expansion chamber 406 and be discharged through the opening 404 of the end piece 401.

Figure 4T:
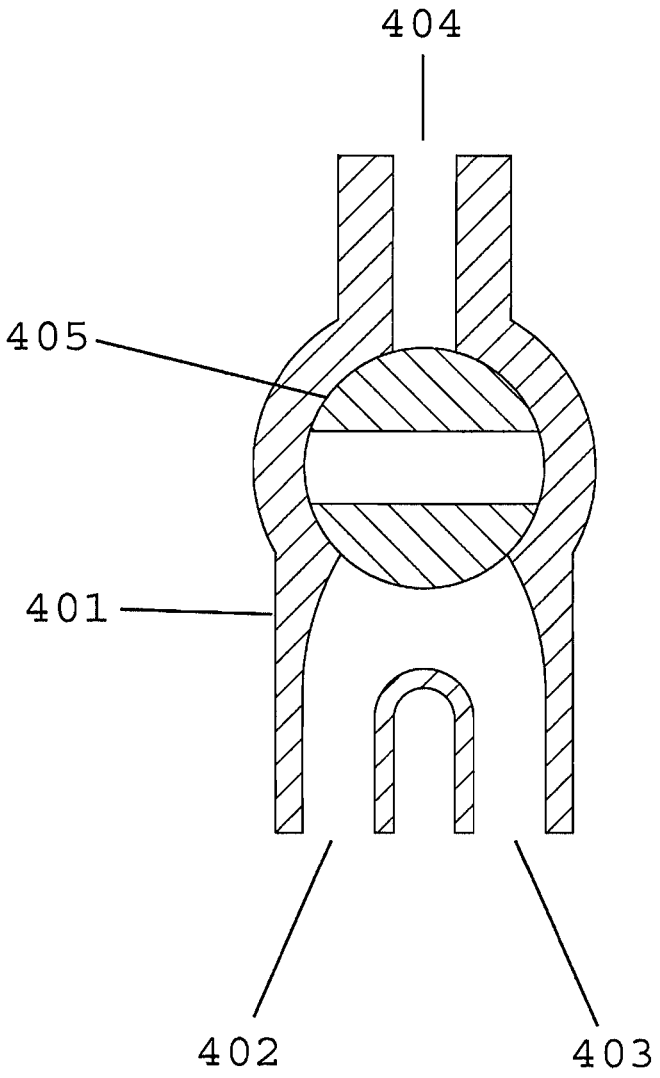
FIG. 4T is a cutaway view of the alternate valve in a closed position.

FIG. 4T shows an end piece 401 with a similar type of valve 405 as shown in FIG. 4S. In FIG. 4T, the valve 405 is in the closed position. The closed position prevents liquid from being discharged through the opening 404 of the end piece 401; however, the liquid is allowed to enter the expansion chamber 406 through the drinking feeder tube 403 and exit the component through the drinking return tube 402.

Figure 5A:
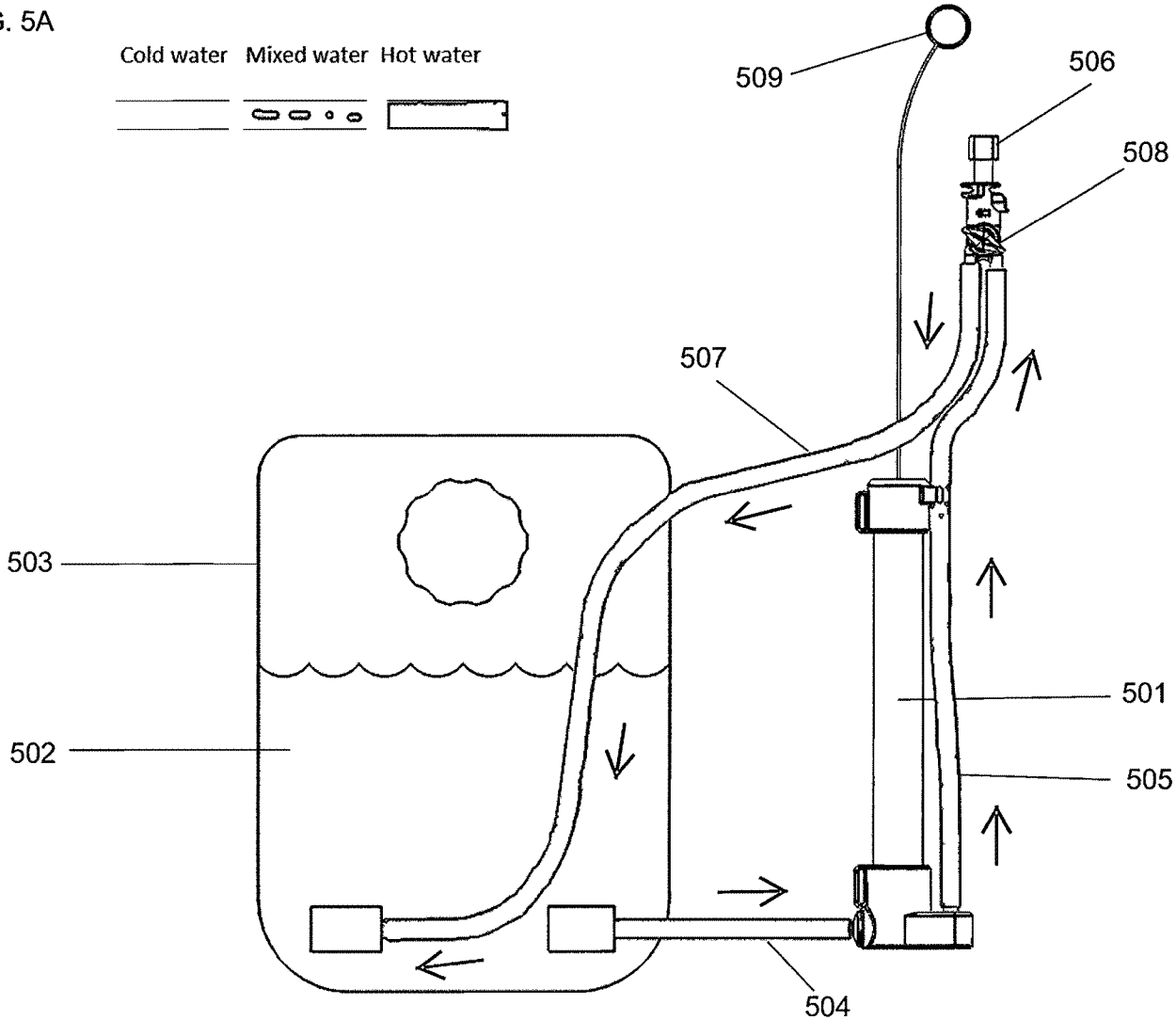
FIG. 5A shows an overview of the hydration system with the attached manual pump system.

FIG. 5A depicts an overview of the hydration system design with attached manual pump system 501. Cold water 502 is depicted in the hydration bladder 503, while warm or hot water is shown in the insulated pump feeder tube 504, drinking feeder tube 505, end piece 506, valve 508 and drinking return tube 507. In this view, valve 508 is in the closed position and pump 501 is cycled by pulling on pull cord handle 509.

Figure 5B:
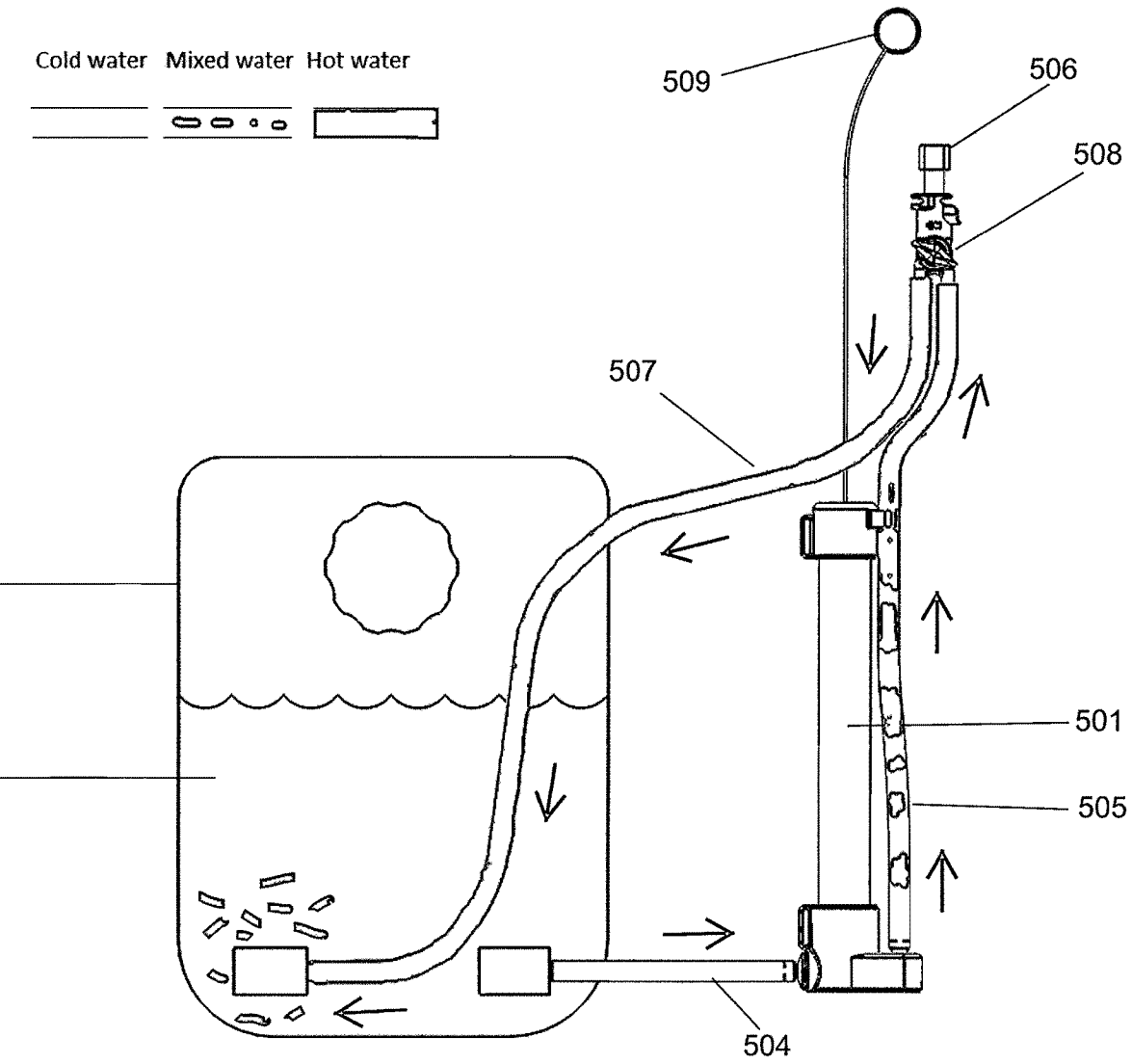
FIG. 5B illustrates the cold liquid circulating from the hydration bladder and into the manual pump system.
Figure 5C:
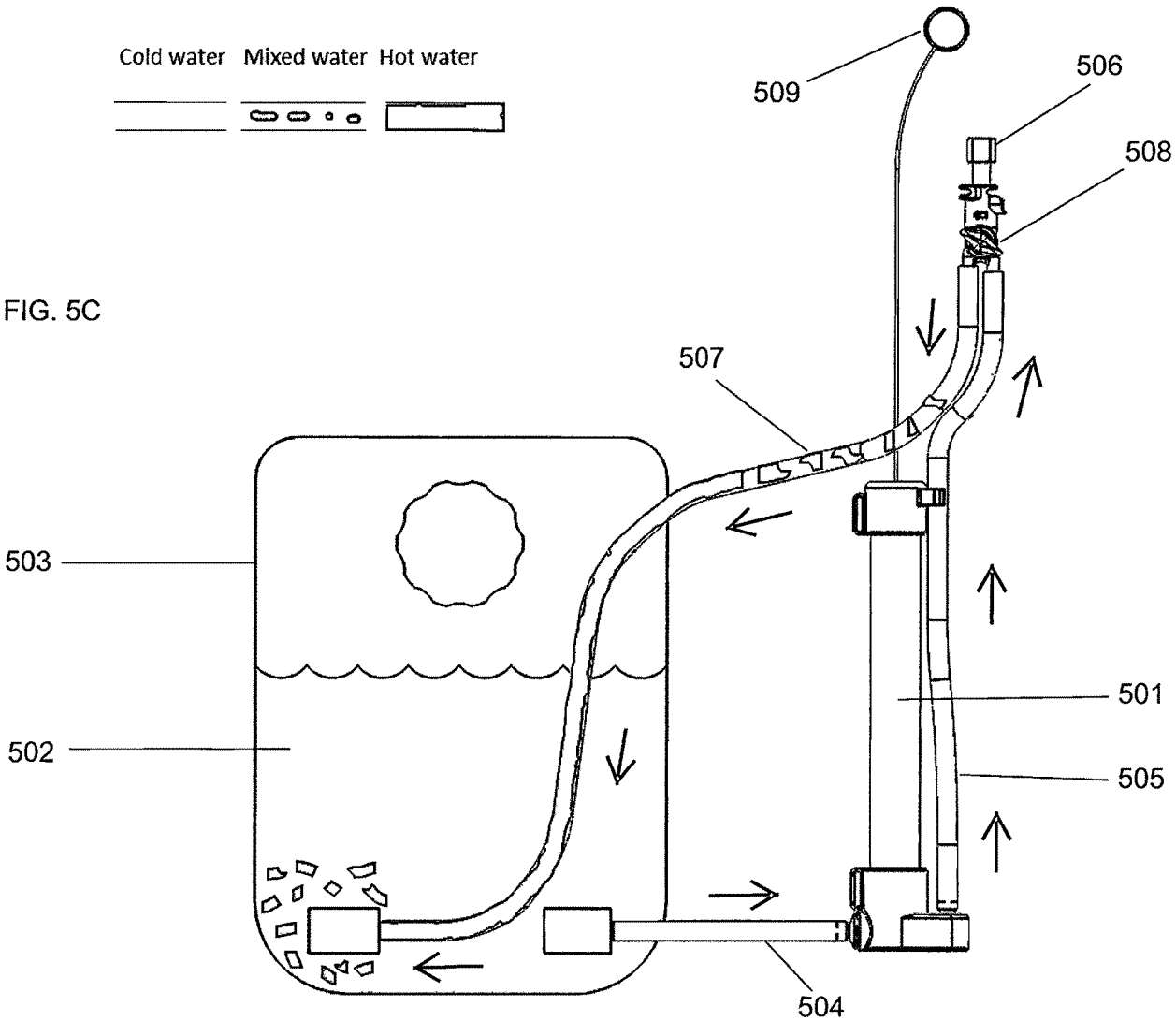
FIG. 5C shows the warm water circulating into the hydration bladder.
Figure 5D:
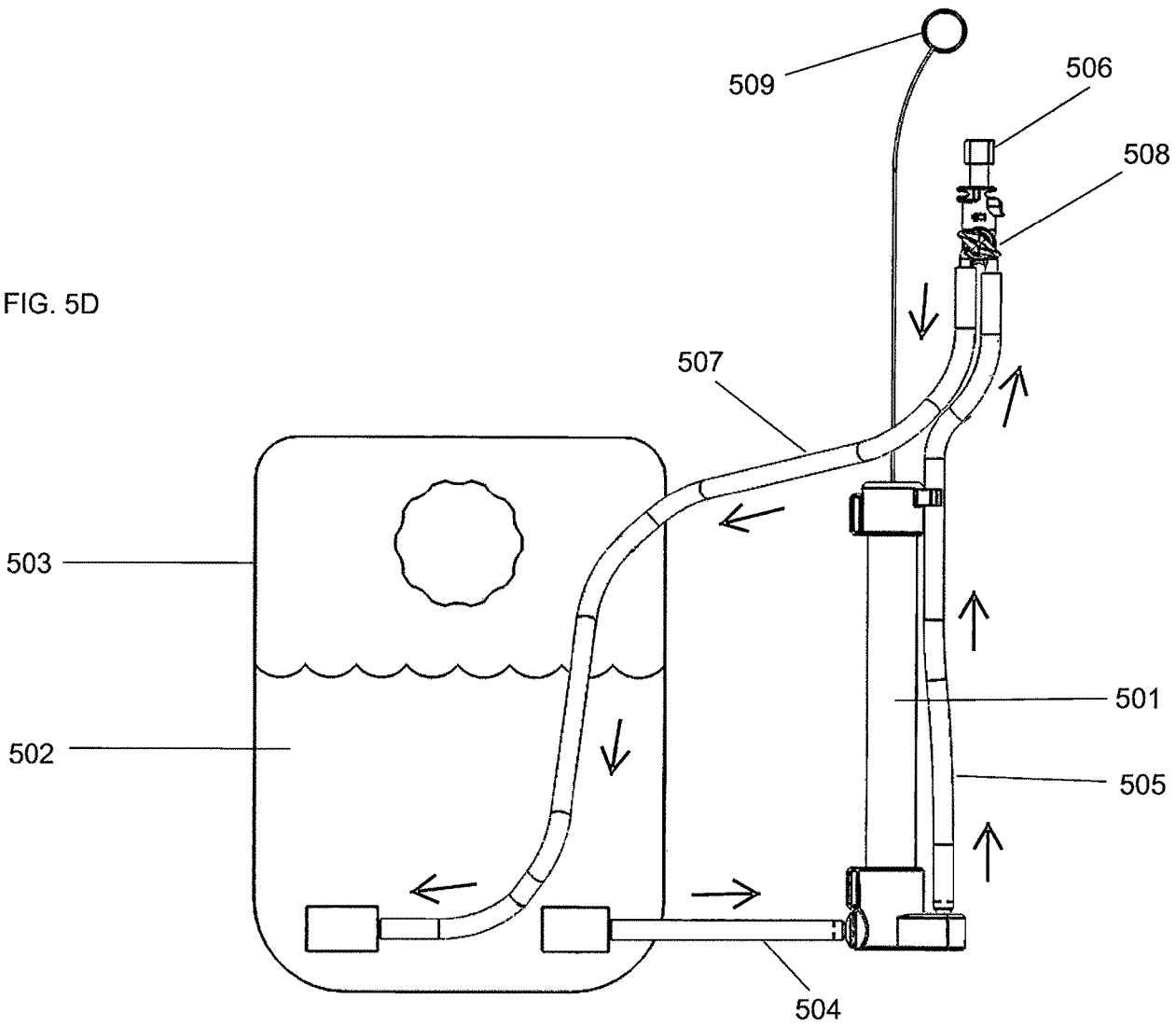
FIG. 5D illustrates the warm water mixing with the cold water within the hydration system having circulated cold water from the hydration bladder throughout the circulation system.

FIG. 5B shows pump 501 having been cycled and as a result, cold liquid 502 from bladder 503 is pulled into pump feeder tube 504 and into pump 501. Pump 501 discharges cold water into the drinking feeder tube 505 as hot/warm liquid is cycled to the closed end piece 506 and into the return feeder tube 507. The warm water is discharged into the hydration bladder 503 and mixes with the existing cold water 502. FIG. 5C shows the warm water further circulating throughout the system. FIG. 5D shows the hydration system having circulated cold water 502 from the hydration bladder 503 throughout the recirculation system. In the representation of FIG. 5D, all hot/warm water has been discharged into bladder 503 and mixed with the cold water 502 inside.

With respect to the pump, and manual pumping in particular, the manual pump design 101 provides for a robust, simple and cost effective method to recirculate liquid within the hydration system. The user merely ensures end piece valve 110 is in the closed position, then pulls and releases pull cord handle 111 in order to circulate liquid throughout pump feeder tube 109, drinking feeder tube 108, drinking return tube 102, pump 101, and hydration bladder 105. Pump 101 may be manually actuated once in order to circulate the liquid within drinking tube system 102, 108 and 109 or it may be actuated a multitude of times.

The user may open the valve 110 and actuate the pump 101 by pulling pull cord handle 111. With each pull of pull cord handle 111, pump 101 discharges a quantity of liquid through the drinking feeder tube 108 and out through the bite valve 103. This produces a stream of liquid, which may be sprayed from the hydration system by simply continuing to pull the pull cord handle 111 while the user wears the hydration pack, or the system has been removed from his/her person. Referring to FIG. 3A, the user may tug and release pull cord handle 309 multiple times, cycling movement of the plunger 301 in a manner similar to a piston inside the pump tube 306. This movement produces a continuous spray of liquid from the end piece provided the user continues to cycle the system.

Manual pumping capability is highly desirable, as a user who is actively involved in physical activity can place end piece 103 inside his or her mouth, open end piece valve 110, and pull and then release pull cord 111. This produces a stream of fluid from hydration bladder 105, sprayed into the user's mouth with little exertion or effort. Such functionality allows the user to continue his or her physical activity, such as running, riding a bicycle, etc., without having to stop.

Figure 6:
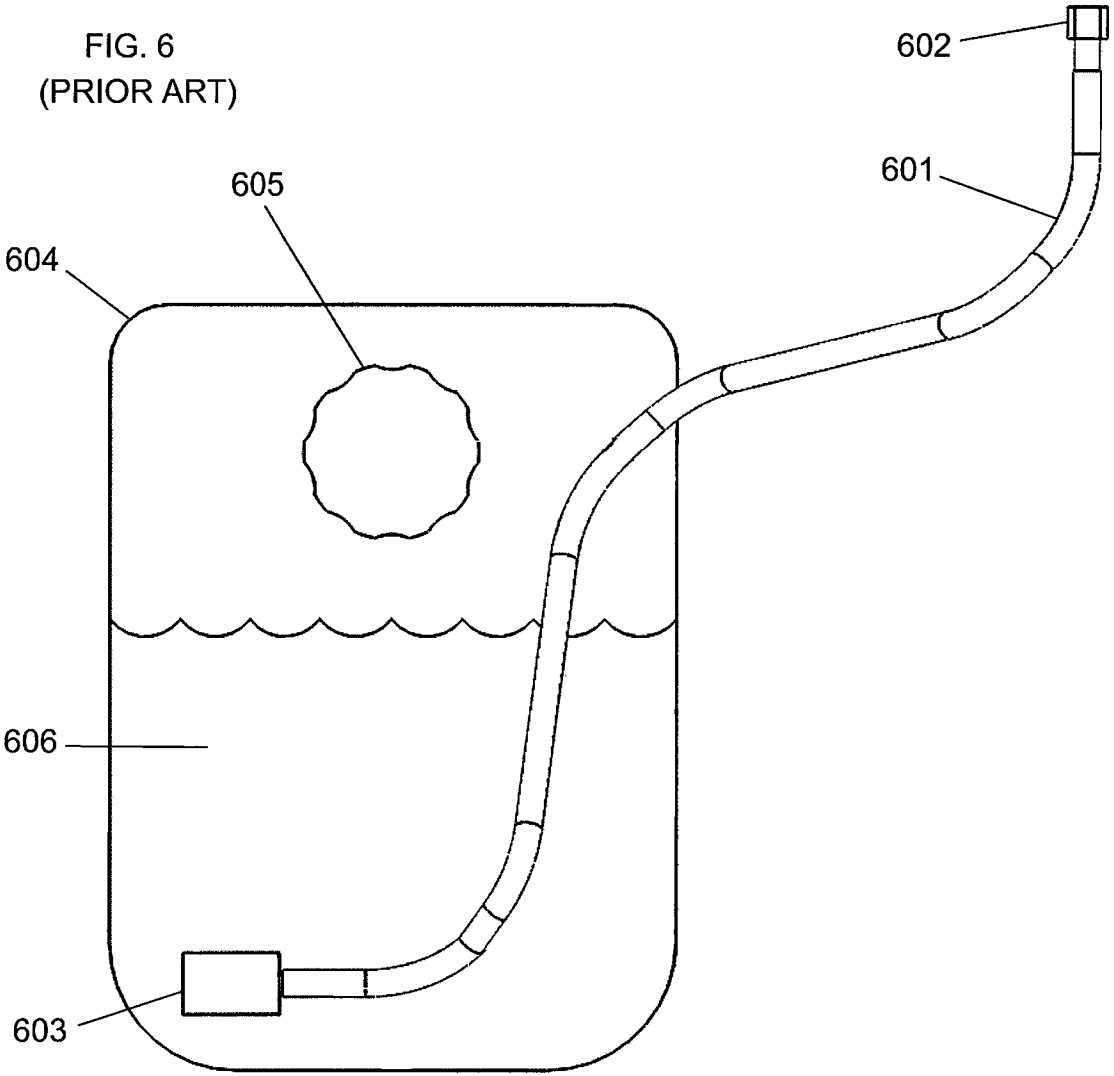
FIG. 6 (PRIOR ART)
FIG. 6 is an example of an existing hydration pack.

From FIG. 6, in currently commercial available hydration packs, the user is forced to suck the liquid through a singular drinking tube 601, which is typically approximately 24 inches to 36 inches in length. This act requires physical effort, and may be difficult for users who are running, riding a bicycle, or out of breath. Current commercially available hydration systems generally encompass a single drinking tube 601, bite valve or end piece 602, and a single coupling point 603 connected to a hydration bladder 604. The bladder 604 has a fill point 605 used to fill hydration bladder 604 with liquid 606.

Additionally, from FIG. 1, the manual pump system 101 provides the ability to actively spray water from the end piece 103. The user holds end piece 103 with one hand and directs the spray of water onto objects or areas nearby while simultaneously pumping pull cord handle 111 with his or her other hand. This action provides a steady stream of sprayed water as long as the user continues to tug and release pull cord 111, thereby actuating the pump system 101. This capability allows the user to spray water and wash out a person's eyes or wounds as well as the ability to clean equipment and other items or devices. Most current commercially available hydration packs do not have this capability. As a result, users are forced to remove commercially available hydration packs from their person, open the fill cap 106, and pour liquid from the system in order to wash equipment, wounds or other actions as described above.

Figure 7A:
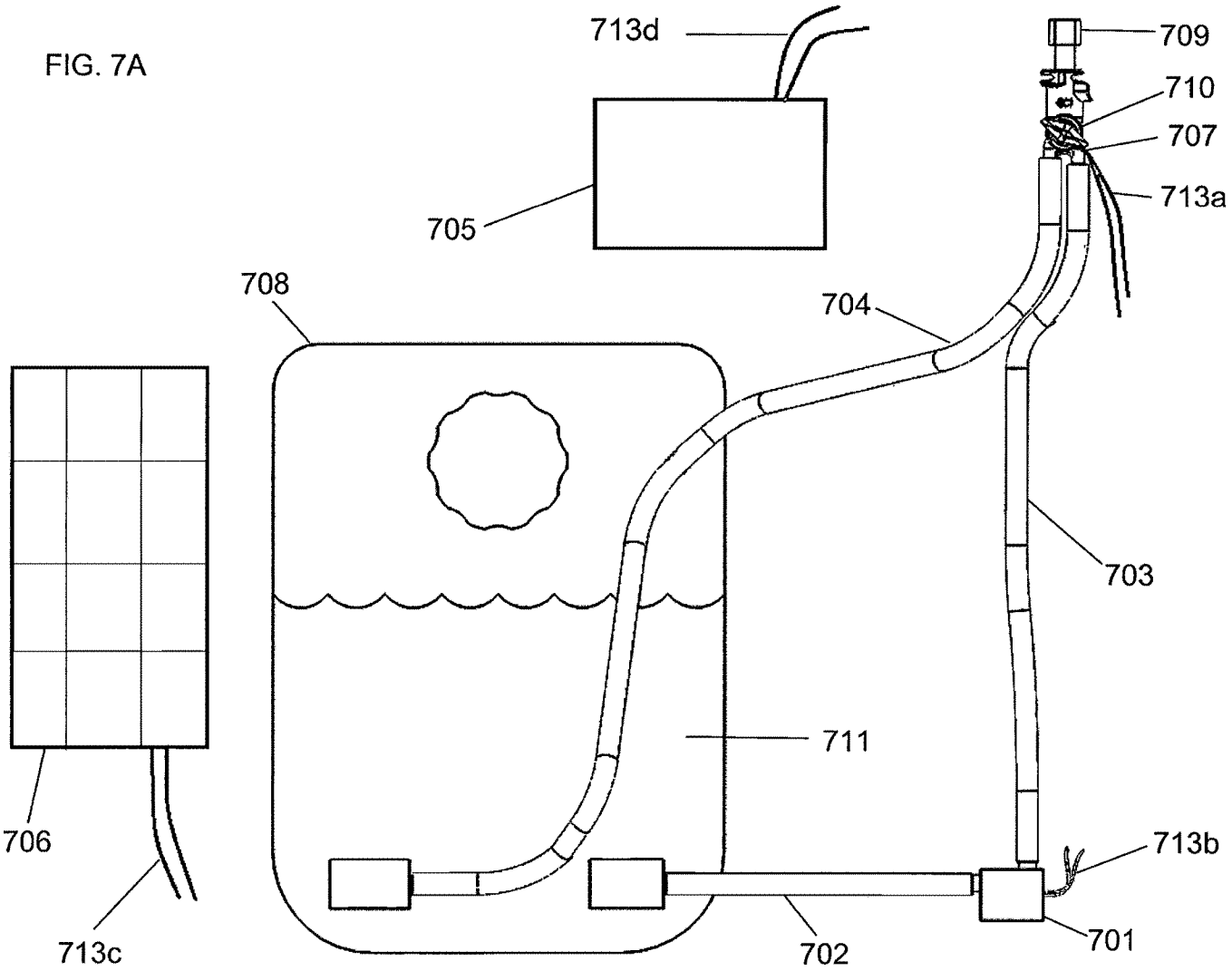
FIG. 7A represents another embodiment of the design, wherein the manual pump system is replaced with an electric pump system.

Functioning of the electric pump may be understood with respect to the depictions of FIGS. 7A through 7F. From FIG. 7A, representing another embodiment of the design, the manual pump system is replaced or utilized with electrical pump system 701, or any other system designed to eliminate the need for manual interaction or pumping, in order to circulate liquid within the system and accompanying hoses 702, 703 and 704. This design may replace the manually operated pump as described above using a variety of electrical pump systems 701. Electrical pump 701 may be the same size and shape as the manual pump, or it may be of a different configuration. Electrical pump 701 in one embodiment includes or provides a pump system 701, motor, wiring 713*a-d*, circuitry, processor, battery 705, alternate power source, solar panels 706, switches, sensors as well as any other manner of hardware appropriate under the circumstances. Electrical pump 701 may be built into the hydration pack or added after the fact as an accessory.

Figure 7B:
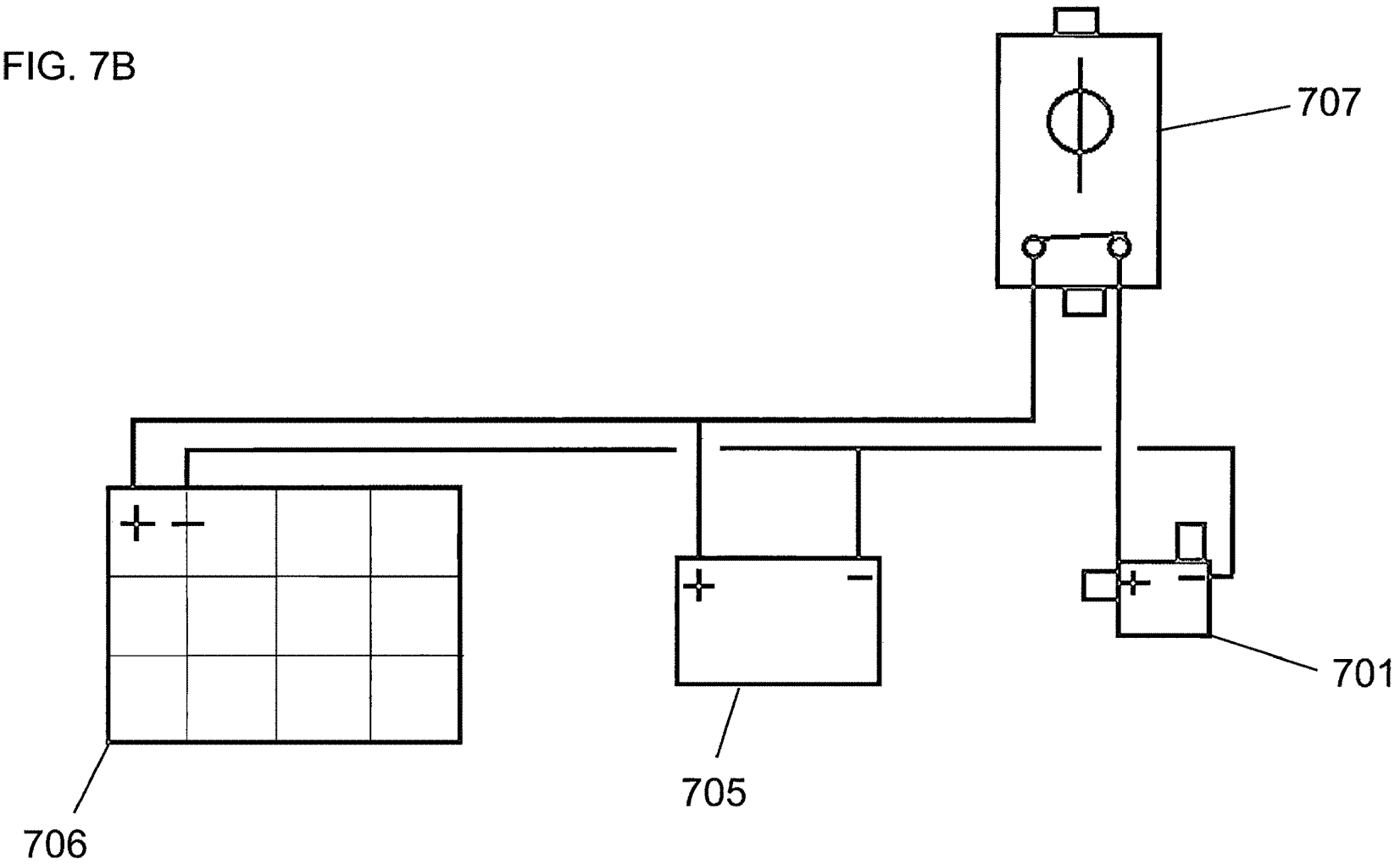
FIG. 7B illustrates the electronics of an electric pump system that utilizes a variety of switching mechanisms.
Figure 7C:
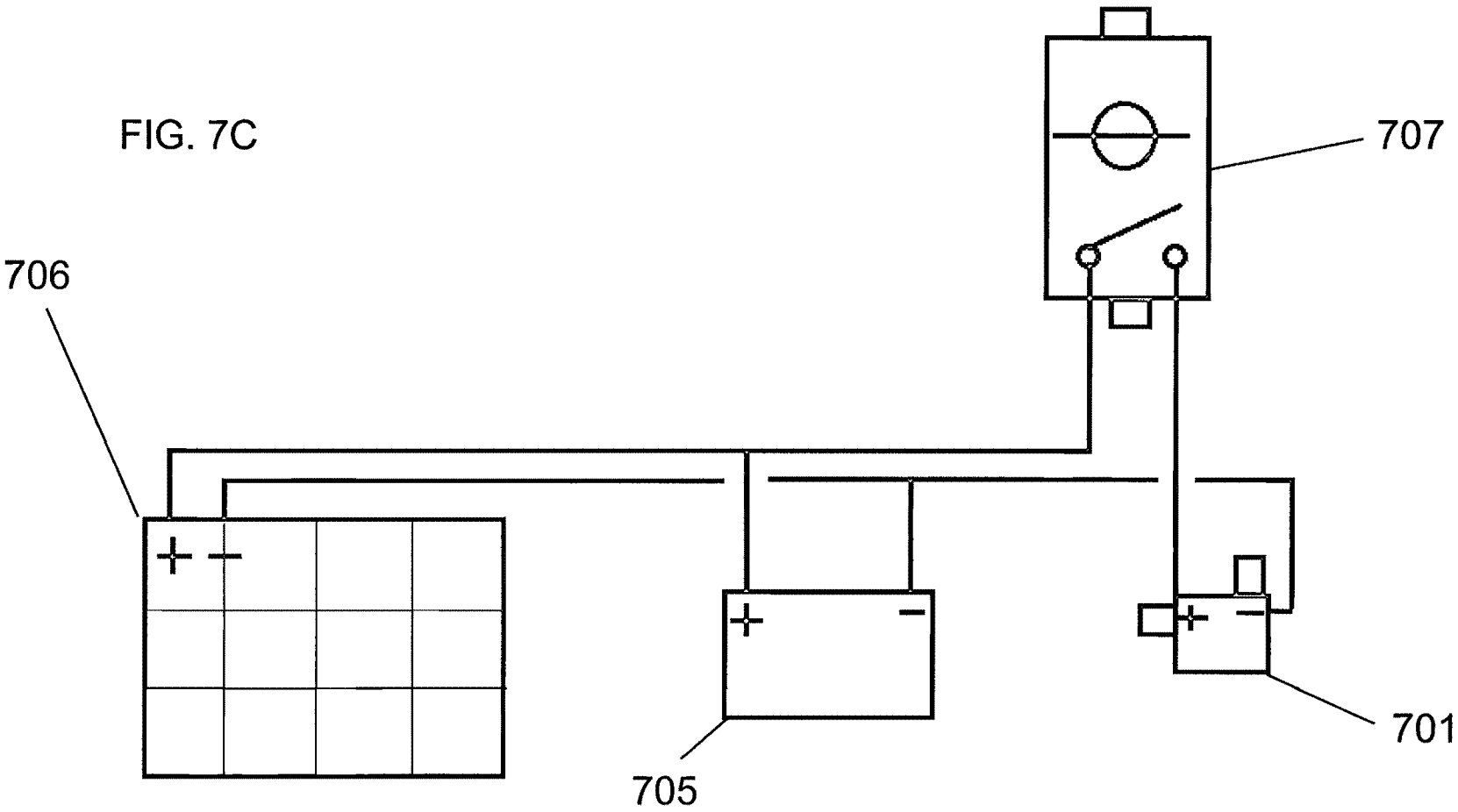
FIG. 7C represents an alternate version of the electronics, specifically with valves closed and the motor off.

From FIGS. 7B and 7C, the electrical pump 701 may employ one or more switching mechanisms 707 in order to turn on, turn off, and regulate power, for example, or for any other appropriate purpose. When the user activates switch 707, liquid within the hydration bladder 708 is sucked into the electric pump 701 via the pump feed tube 702 (or similar element) and pushed into drinking feeder tube 703. The pump pressure pushes the water stored inside hoses 702 and 703 to end piece 709. If end piece valve 710 is open, liquid 711 is forced out of end piece 709 like a spray. If the valve 710 is closed, the liquid is forced into the drinking return tube 704 and circulated back into hydration bladder 708.

Switch 707 may be incorporated into end piece 709 so that a user merely grabs the drinking tube end piece 709, places it in his or her mouth, and activates the attached electrical pump 701, spraying water from end piece 709 into his or her mouth. The switch 707 may be located in different areas of the hydration pack in order to allow the user to quickly and easily activate the electrical pump system 701 while the user is still wearing the system. The design many employ a singular switch 707 or multiple switches in different locations.

From FIG. 7B and FIG. 7C, the present design may employ a switch 707 incorporated into the end piece 709, or a bite valve. Such an arrangement enables starting electrical motor 701 when a user merely places the end piece 709 in his or her mouth, or if the user bites down on a bite valve provided on end piece 709. The design may employ a switch 707 that operates based on a timing function, whereby the switch 707 is activated after a given time period and automatically circulates liquid 711 with hydration bladder 708 for a period of time. Such a design provides the ability to ensure cool water 711 located inside hydration bladder 708 is always instantly available in drinking tubes 702, 703 and 704.

Temperatures may fluctuate in different parts of the design presented herein, but it is understood that the desire is to provide a relatively even temperature quantity of fluid in the container/bladder and the hoses such that the user can release a quantity of fluid that is a normalized temperature, i.e. drink from the end piece a quantity of liquid that is the same temperature or nearly the same temperature as in the rest of the system. While temperature deviations are highly dependent on circumstances, it may be desirable to have temperatures fluctuate no more than 1, 2, 5, or even 10 degrees from a certain value, where the certain value may be average temperature of all liquid in the system or average temperature within the bladder or container, or even a high or low temperature. Again, the goal and functionality disclosed is to pass the fluid through the system such that a relatively normalized temperature of liquid is available for consumption or other use at any given time. The presence of ice in the system, as well as the use of heating or cooling components disclosed herein, may alter fluid temperatures under certain circumstances.

The present design may also employ a temperature sensor inside drinking tubes 703 and 704, the hydration bladder 708 and/or other parts of the system. The temperature sensor monitors the temperature of liquid 711 and would has the ability to manually or automatically trigger the electrical pump 701 to circulate water from the hydration bladder 708 throughout the system whenever the temperature in drinking tubes 702, 703 and 704 exceeds minimum predefined temperature settings, which may be defined the user via a control device or arrangement.

From FIGS. 7A through 7F, if cold water 711 is stored inside hydration bladder 708, a temperature sensor inside the drinking feeder tube 703, pump feeder tube 702, drinking return tube 704, end piece 709 or other part may monitor temperature of the liquid. If the liquid inside drinking tubes 702, 703 and 704 becomes too warm, the sensor may signal the electrical pump to turn on for a predefined period of time (for example 15 seconds, but other times are acceptable) and then automatically stop.

Figure 7D:
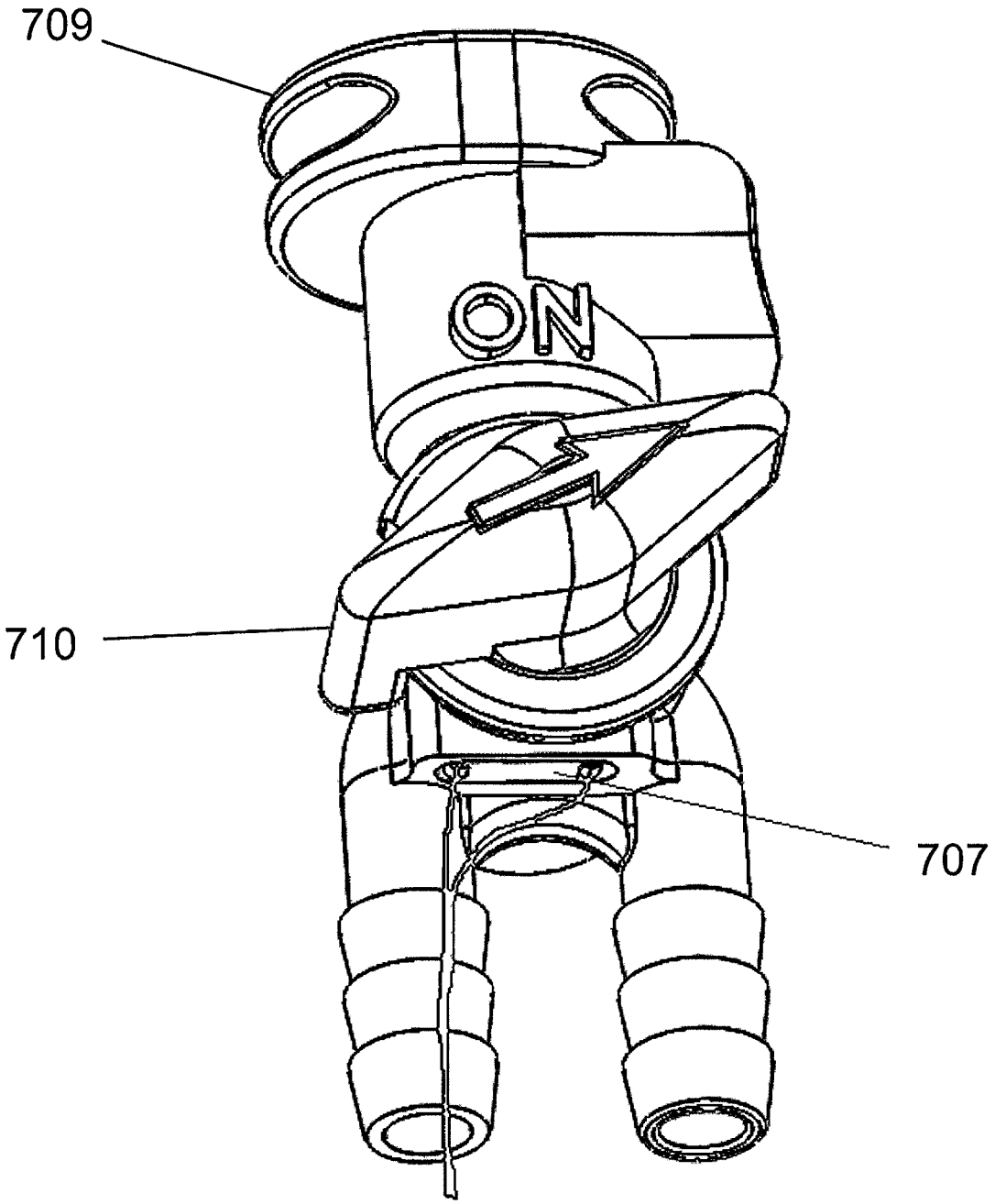
FIG. 7D illustrates a valve that may automatically turn the pump on and off based on its positioning through the use of magnetic force.
Figure 7E:
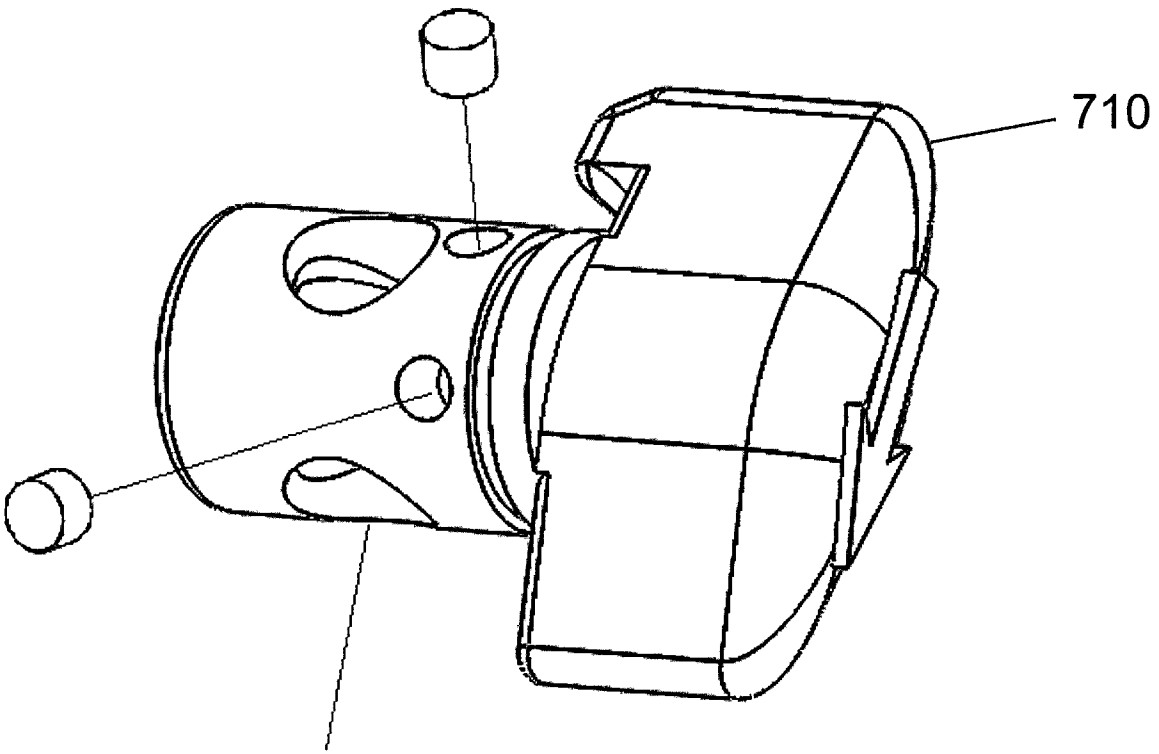
FIG. 7E shows portions of a valve that uses magnetic force, including two magnets.
Figure 7F:
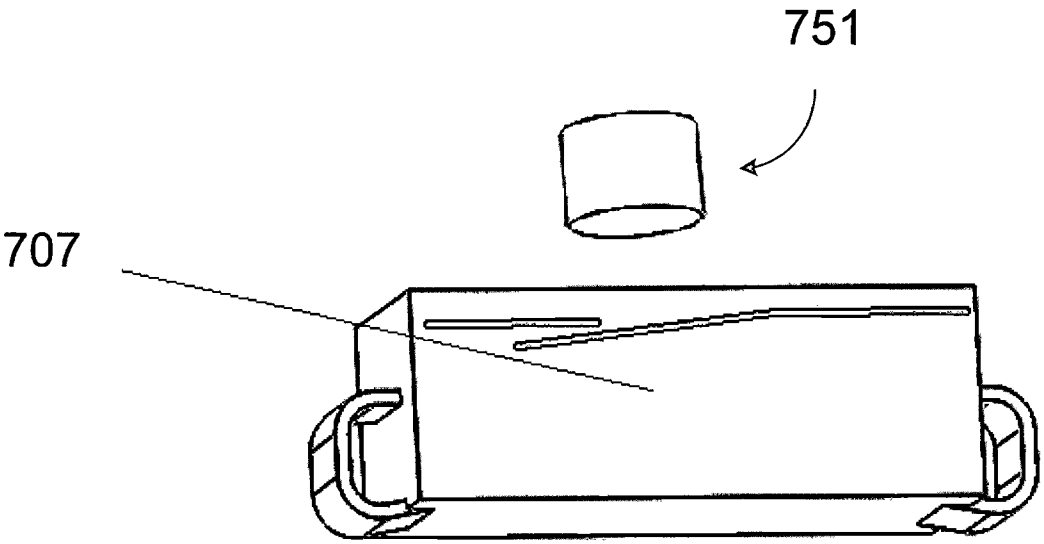
FIG. 7F illustrates components of a valve that uses magnetic force to turn on and off.

FIG. 7D shows a valve, electronically and magnetically operated. End piece 709 and valve 710 are shown, as well as switch 707, in this case an electronic switch. FIG. 7E shows the switch handle, i.e. the handle of switch 710, as well as two magnets and a flow channel. Application of power to the magnets causes the switch to rotate in one direction or the other depending on the power applied. FIG. 7F shows a further electrical component, specifically electrical switch 707, and magnet 751.

Figure 7G:
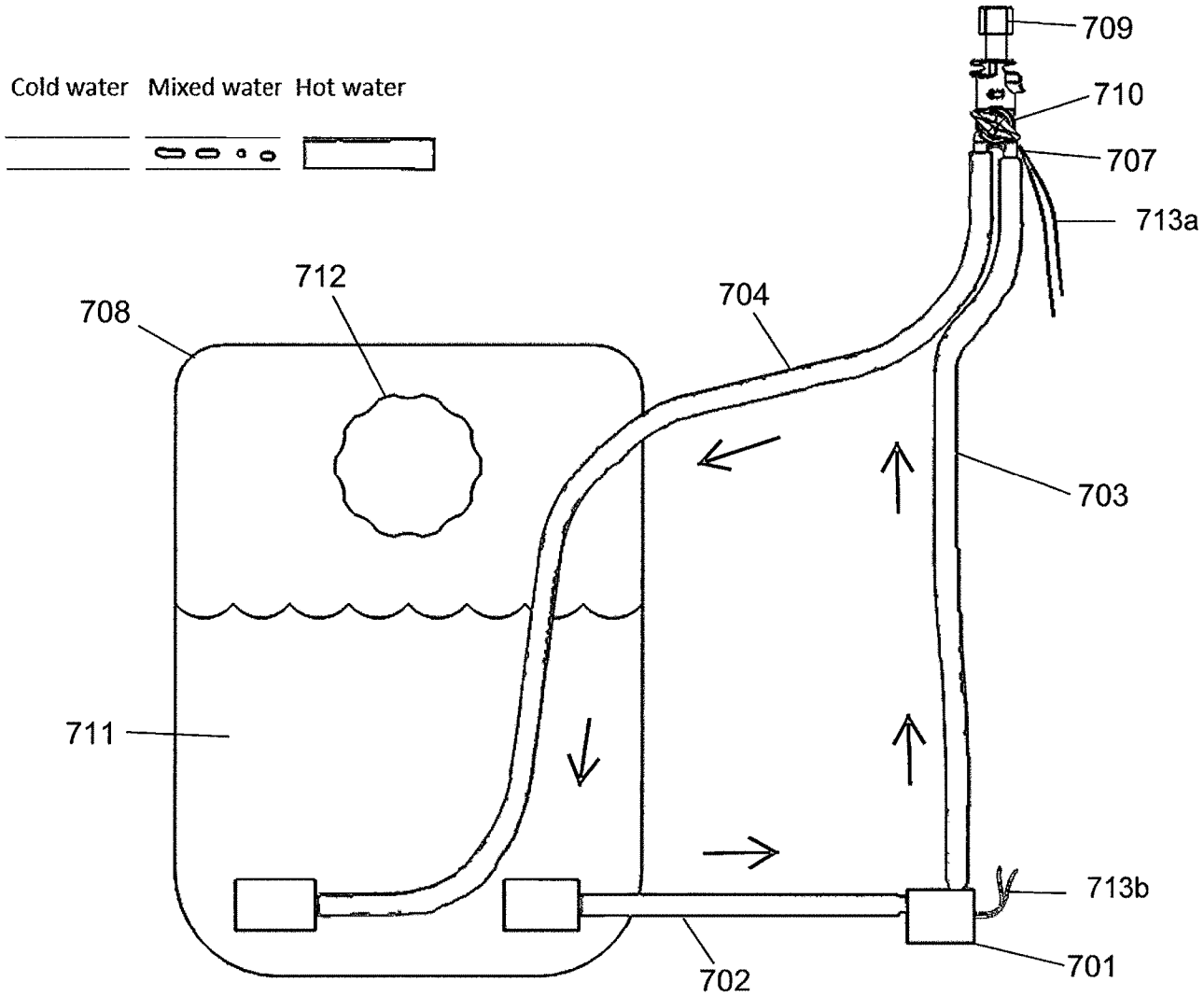
FIG. 7G shows the circulation of water through an electric pump system.
Figure 7H:
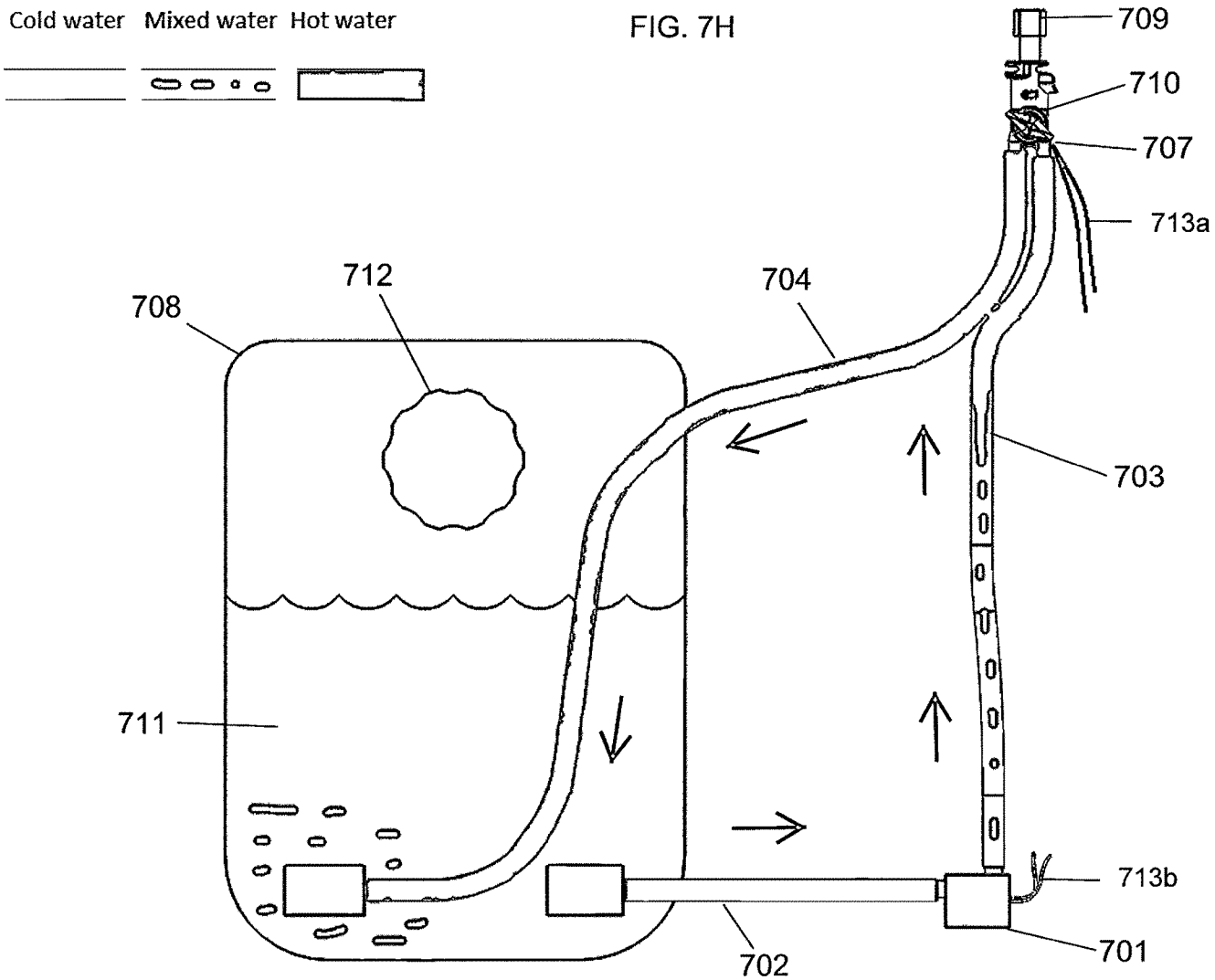
FIG. 7H is the circulation of water through an electric pump system with cold water flowing through a system predominantly including warm or hot water.
Figure 7I:
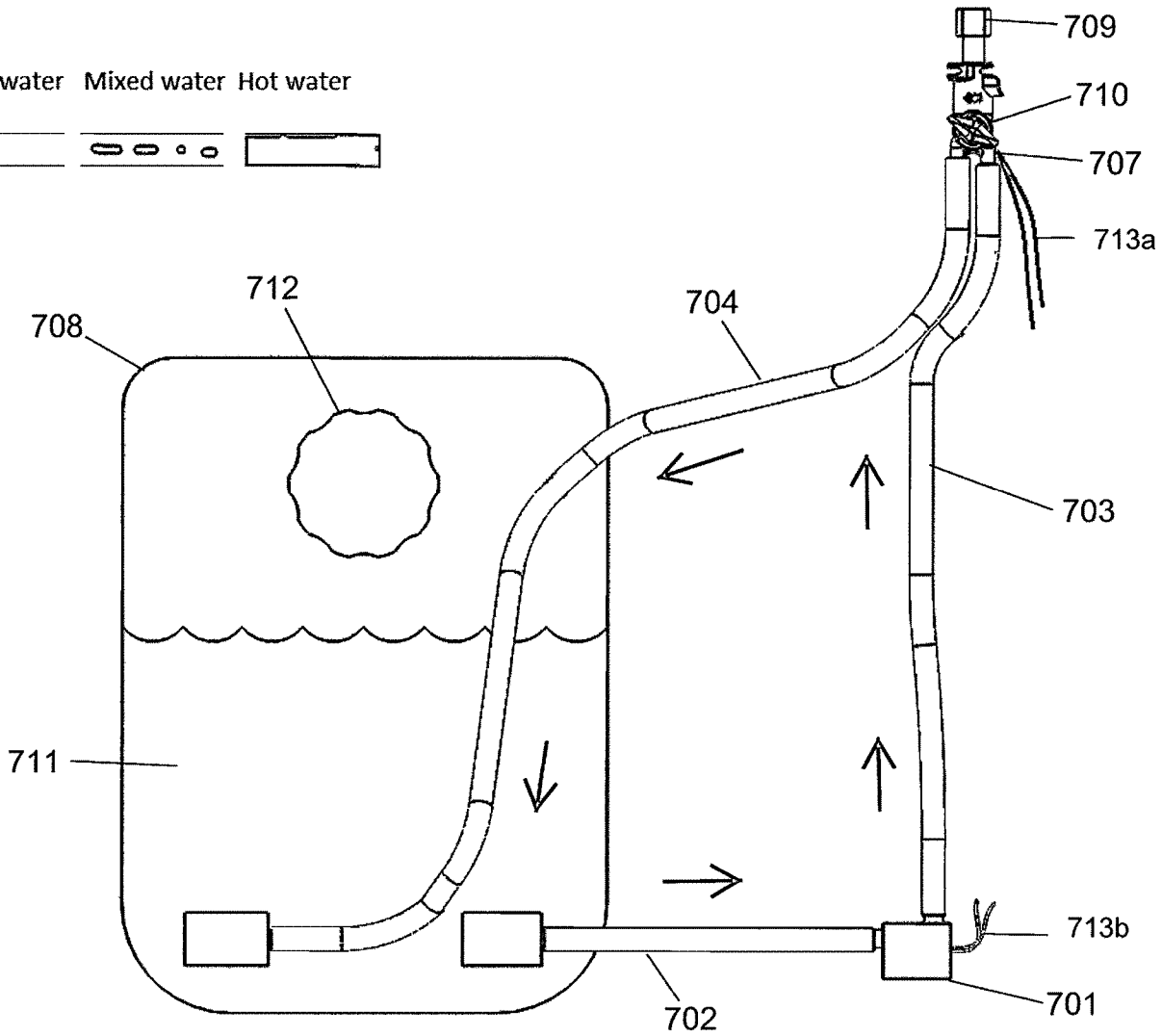
FIG. 7I shows the circulation of cold water through an electric pump system with cold water circulating throughout the system.

For FIGS. 7G through 7I, application of switching in the manner illustrated circulates all the warm water from the drinking tubes 702, 703 and 704 into the hydration bladder 708 and replaces liquid inside the drinking tubes 702, 703 and 704 with cold water 711 from bladder 708. This may occur automatically without the interaction of the user. The described alternative switching methods are provided as possible embodiments, but it is understood that various alternative activation switch designs may be employed that incorporate many other different devices and/or methods to accomplish the goal of circulating liquid at a desired temperature.

The double hose design provides for a simple, easy, and effective method to recirculate the liquid within the hydration system. As presented in FIG. 1, the present design incorporates a drinking feeder tube 108 and a drinking return tube 102 connected to a manually operated pump 101, electrical pump or other similar system utilized to circulate or discharge liquid from the hydration system. An aspect of the design is the use of two or more separate tubes or hoses 108, 109 and 102, which may be used to move liquid through the system. Tubes 108, 109 and 102 may be singular, modular or designed as one component embedded with multiple tubes. The double hose system allows for cold water 104 stored in bladder 105 to enter pump feeder tube 109 and be pulled into the pump system 101. When the pump is cycled, a series of one-way valves 316 and 317 directs liquid within pump 101 to be discharged into the drinking feeder tube 108.

From FIG. 3D, drinking feeder tube 315, pump feeder tube 314, and drinking return tube 102 interfaces with individual nipple fittings 312 and 313 or any other connection system located on the pump 306. Water then flows from the drinking return tube 102 into the hydration bladder 105 through a coupler 107.

From FIG. 5B, the ability to circulate the liquid 502 contained within the hydration bladder 503 is highly desirable. The double hose system allows for the cold water 502 within bladder 503 to circulate the warm water that remains in hoses 504, 505 and 507 and send it back into bladder 503. The circulatory system for the drinking tubes 504, 505 and 507 may benefit a user in a cold weather environment in that the dual hose system and its circulatory effect may prevent freezing of the liquid within the hydration pack in cold environments.

The hose system, in this aspect including drinking tubes 504, 505 and 507, may be constructed of clear materials to allow the user to visually determine fluid within the system, or be manufactured of any desired and appropriate colors or materials. The hose system may incorporate an embedded insulation system, covering or integrated into the drinking tube(s) 504, 505 and 507, or may utilize an external insulation system or cover which encases or encloses the tubes and other components.

A heating arrangement may also or alternately be provided within the system. From FIG. 8, the present design may employ a heating system 801 integrated into the hydration bladder 802 and related components. The heating system may include a heating coil 801 or other device designed to safely produce heat inside or around the hydration system. This design would ensure the liquids 803 contained inside the hydration bladder 802 and ancillary components do not freeze in inclement weather conditions or freezing environments.

The heating system 801 may be provided inside the hydration bladder 802 or added to the inside or outside of the hydration bladder 801. The heating system 801 may cover a large or small area of the hydration bladder 802 and may connect to various electrical components such as wiring 804*a*, 804*b*, and 804*c*, switches 808, sensors (not shown), power sources 806, processors 807, and other devices. The heating system 801 may be provided as a device inserted temporarily or permanently into the hydration bladder 802 via opening 809 or another location. The heating system may be integrated into, or attached inside, the carrying pack system of a backpack carrying the hydration bladder 802 and/or entire system. Conversely, the heating system may be a standalone device inserted into the carrying compartment of the pack or device used to hold the hydration system.

The heating system may include a processor 807, controller, battery 806, sensors, solar panels, and/or other relevant components and power sources. A switch 808 may be incorporated into the end piece 810, drinking tubes 811, 812 and 813, electrical components, hydration system, or may be externally located. Switch 808 may be connected to the bladder system by wire, wirelessly, or using any other appropriate means. Switch 808 may be activated manually by the user, automatically by an external source such as a sensor, timer, or processor, or by other means. The heating system may be integrated into, or work in conjunction with, the heating system located in or around drinking tubes 811, 812 and 813, as described below.

The heating system may also employ or interface with the pump 805 and other ancillary equipment. Such a heating system would ensure liquid contained in pump 805 would not freeze in cold weather environments or inclement conditions. The pump may be a manual pump, electric pump, or any other mechanism useful to move liquid within the system.

The wiring and circuitry for pump system 805 may connect to a processor 807, controller, battery, sensors, solar panels and other components and power sources 806. A switch may be incorporated into end piece 810, drinking tube(s) 811, 812 and 813, electrical components, hydration system or may be externally located. The switch may be connected to bladder system 801 via wire, wirelessly, or via any other means. The switch 808 may be activated by the user, by an external source such as a sensor, automatically, timer, by a processor 807 or other means. Upon activation, the system would activate the heating coils 801 or system within or on the drinking tube(s). This process may then heat the liquid contained within pump system or pump 805.

In another aspect of the design, the activation of the switch 808 and heating system 801 may be accomplished by a sensor 814 inside or on the hydration bladder 801, drinking tubes 811, 812 and 813 or other components. If the sensor 814 detects a drop in the water temperature located in the drinking tubes 811, 812 and 813, and/or the hydration bladder 802, the heating system may be activated for a specific amount of time. The heating system may shut off automatically when the sensor 814 detects the temperature has reached a pre-designated threshold.

An automated timer may activate heating system 801 for a specific period of time, or automatically shut off and then reactivate after a designated time period. This cycle may repeat as desired by the user and/or system. Various circuitry and capabilities may be integrated into processor 807 to control the functions and capabilities of heating system 801. The heating controller 807 may contain a processor that may control the duration of the heating process. For example, once activated, the processor 807 may provide for constant heating until turned off by the user; a timer turned on at a specific time that stays on for a predefined time; or may stay on for a specific amount of time only.

The system may be configured so that only some components are heated, or even all of them, when the system is activated. For example, the heating system may address and/or heat bladder 801, pump feeder tube 813, pump 805, drinking feeder tube 811, end piece 810, valve 817, drinking return tube 812 and/or any combination of components. This may provide independent heating of various components or all components of the system. The present system may incorporate an in-hose heating system, wherein the connection point on drinking tubes 811, 812 and 813 interfaces with an electrical system 807 located on, within, or integrated into the hydration system, or the electrical system may be provided separately. The wiring for drinking tubes 811, 812 and 813 may connect to a processor 807, controller, switches 808, sensors, solar panels and other components as well as power sources 806. Again, switch 808 may be incorporated into end piece 810, drinking tube 811, 812 and 813, electrical components, hydration system, or may be externally located or provided in another appropriate configuration. The switch 808 may be connected to the system via wire, wirelessly, or using any other reasonable means. Switch 808 may be activated by the user, by an external source such as a sensor, automatically, by a timer, by a processor 807, or using any other reasonable means.

Upon activation, the system may trigger the heating coils or heating system within, embedded in, surrounding, or on pump feeder tube 814, drinking feeder tube 815, drinking return tube 816, and/or other components. Such a system heats the liquid located throughout the length of drinking tubes 811, 812 and 813 as well as various other connection points. The heating system and switch 808 may be activated using a sensor 814 detecting a drop or rise in the water temperature of the liquid in the drinking tube 811, 812 and 813, hydration bladder 802, or in other components.

Figure 8:
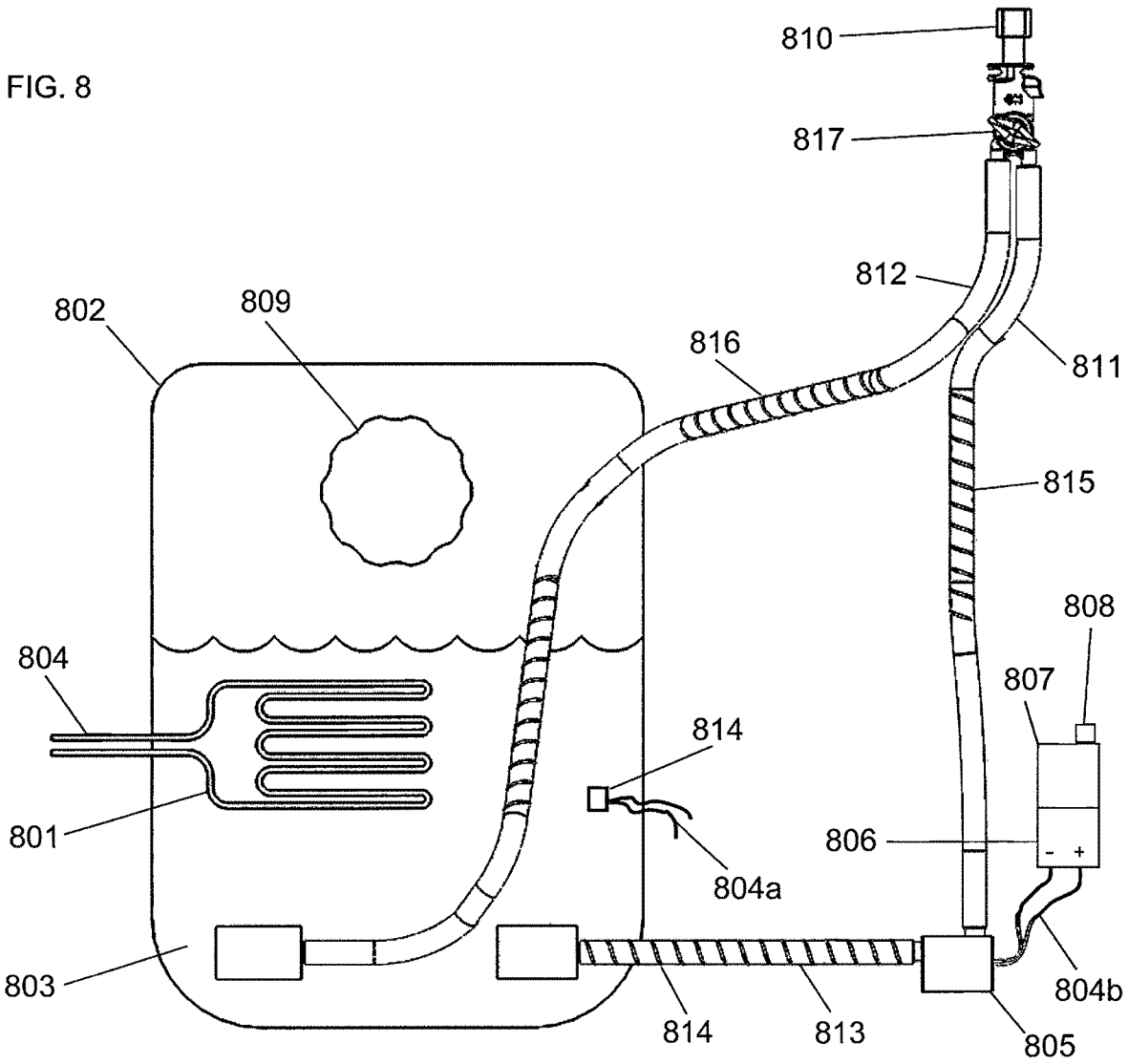
FIG. 8 represents another embodiment of the design, wherein heating systems are integrated into various components of the design.

As depicted in FIG. 8, drinking hose(s) 811, 812 and 813 may incorporate wiring, heating coils 814, 815 and 816, or other devices or methods, which may provide warmth or heating properties to drinking tubes 811, 812 and 813 and related components. This capability will ensure the liquid within one or more of drinking tubes 811, 812 and 813 cannot freeze even when the system is exposed to inclement freezing temperatures.

Conversely, the heating system may be activated via a timer system, which may be integrated into drinking tubes 811, 812 and 813, end piece 810, manual or electric pump systems 805, or any other component. An automated timer may activate the heating system 801, and heating coils 814, 815 and 816 for a specific period of time, or automatically shut off and then reactivate it after a designated time period. This cycle may repeat as designated by the user and/or system or be a one-time occurrence. Various circuitry and capabilities may be integrated into processor 807 to control the functions and capabilities of the heating system. The heating system for drinking tubes, including heating coils 814, 815 and 816, prevents water from freezing within the drinking tubes 811, 812 and 813 or other components. Additionally, this design would provide the user with the ability to drink warm water from end piece 810.

Without the heating coils 814, 815 and 816, the liquid within the drinking tubes 811, 812 and 813 could freeze, making the stored water 803 inaccessible. The heating coils 814, 815 and 816 being located within drinking tubes 811, 812 and 813 creates a situation where the liquid can be heated prior to drinking while still inside drinking tubes 811, 812 and 813.

The use of a heating system as discussed above also provides benefits when used in a hot weather environment. The user fills bladder reservoir 802 with ice or freezes a large section of the hydration bladder 802, forming a block of ice. The remainder of the hydration bladder 802 is filled with water. The water 803 inside the hydration bladder 802 stays cold for extended periods of time. Due to the lack of insulation on the drinking tubes 811, 812 and 813, in a hot weather environment, the water inside drinking tubes 811, 812 and 813 quickly heat up and become warm, while the water inside the bladder 803 remains cold. If a user wants to take a drink, he or she sucks on the end piece 810 attached to drinking tubes 811 and 812 or places the end piece 810 in his or her mouth and cycles the pull cord handle 111. This would initially provide only the warm water located inside drinking tubes 811, 812 and 813 until the cold water 803 from the bladder 802 reaches end piece 810.

In this design, the user can keep drinking cold water 803 from the bladder 802 if a large amount of ice carried within. Once the supply of cold water 803 is exhausted, the ice inside the hydration bladder 802 melts continuously, providing additional liquid to drink. If the ice inside hydration bladder 802 is not melting fast enough, the user can activate heating system 801 in hydration bladder 802 only. The heating system 801 may activate and heat the interior of hydration bladder 802 thereby melting the ice inside and as a result, generate more drinking water 803. This water 803 remains cold due to the ice block. The user may cycle pull cord handle 111 and drink cold water from the end piece 810.

The heating system may be turned on and actively heating until manually shut off by the user. Alternately, the heating system may be turned on by a user for a predefined amount of time and then automatically shut off, providing the ability for the system melt enough ice inside hydration bladder 802 for a single sip. The system could be reactivated again to produce additional amounts of water from the melting ice on an as needed basis. In another version of heater control 807, the system may utilize level sensors 814, temperature sensors 814, or any other means/device to monitor the level of drinking water relative to the quantity of ice inside hydration bladder 802. The heater control may then turn on and off to maintain a predetermined amount of drinkable water 803 inside bladder 802. This may enable the user to determine which parts of the hydration system are heated and which are not. For example, in a hot weather environment, the system may heat only hydration bladder 802 containing ice and not heat drinking tubes 811, 812 and 813, or the user may elect to heat bladder 802, drinking tubes 811, 812 and 813, and pump system 805 in a cold weather environment to prevent freezing the liquid maintained inside.

Furthermore, in cold weather environments that experience freezing temperatures, the outer and smaller components of the system, such as the drinking tubes 811, 812 and 813, and pump 805, may freeze. Thus, while water 803 contained within the hydration bladder 802 may still be in liquid form, the drinking tubes 811, 812 and 813, and pump 805 may need to be heated to prevent these components from freezing.

Military soldiers and others who work for extended periods in a cold weather environment can carry only limited amounts of water on their person. Additional water can be created by melting ice or snow which is obtained in the environment; however, often the ability to melt snow or ice is unrealistic due to logistical considerations, lack of fire starting tools, lack of fuel, high winds, danger of exposing a soldier's position to enemy combatants, or any other number of issues.

The design provides the ability for persons who are in a cold weather environment where snow and ice is located on the ground, to utilize these materials to produce usable water with little effort in the field. The user may collect snow, ice or cold water and place it inside hydration bladder 802. The user may then activate the heating system 808 to melt the snow or ice and heat up the water in hydration bladder 802 and drinking tubes 811, 812 and 813. After a short period of time, the system produces additional water 803 inside the hydration bladder 802, which could be constantly heated as needed to ensure the availability of warm water in a cold weather environment.

As shown in FIG. 8, a cooling or refrigeration system may be incorporated into the hydration bladder 802, pump system 805, drinking tubes 811, 812 and 813, end piece 810, and/or with any other component. The cooling system may include cooling coils, cooling mechanisms, power sources, switches, processors, circuitry, wiring, and any other components. The cooling system activates to cool water 803 stored in the bladder 802, drinking tubes 811, 812 and 813, pump 805, and/or other components. The cooling system may be activated manually by the user or be automated using temperature sensors 804, timers, flow sensors, and other components. The heating and cooling systems may both be integrated so that the system manages the temperature of the liquid inside regardless of the environmental conditions.

From FIG. 8, the system may include sensors, such as sensor 814, and other devices that gather data possibly including but not limited to water levels, water flow, GPS, temperature, valve control, circuitry, and information about contamination and/or biological systems. Such a sensor or sensors may transmit and receive data from various components that are integrated into the system or are completely separate. The sensors may be connected to the system via wire 804, wireless, Wi-Fi, Bluetooth, commercial wireless, or any other means known in the art.

Such a sensor or sensors, such as sensor 814, may contain or be connected to a reminder function for users to drink water, refill the hydration bladder, or perform other pertinent functions. Such a reminder function may be audible, visual, vibratory, or any other method or means of transmitting information, with the user provided the ability to customize notifications.

FIG. 1 shows a water filtration system integrated into or separately attached to a component of hydration bladder 105. The present design may employ a filtration system that may attach to bladder opening 106. As water enters into this bladder opening 106, the filtration system may separate solids, bacteria, viruses, and any other substances that may contaminate the liquid. The water may be fit for human consumption upon entering hydration bladder chamber 105.

The present design may allow a user to refill a hydration pack by filtering water entering the bladder opening 106. This would prevent contamination of the entire hydration pack system by filtering incoming water. Additionally, this design prevents any unfiltered liquid from contaminating the entire hydration system by providing filtration at the moment of first contact with the system rather than at a later time.

Alternately, the water filtration system may be added to or embedded inside the hydration bladder 105. This arrangement enables the user to quickly pour contaminated water into the hydration bladder 105, where the contaminated water would be internally filtered or cleaned prior to entering another component of the hydration system.

In another embodiment, a filtration system may be integrated or separately attached to a coupler system 107, the pump feeder tube 109, the drinking feeder tube 108 or other components. This design may filter the water initially or later as water enters the drinking feeder tube 108. The hose system may include a filter or filtering arrangement acting as another means of filtration and further ensure that the user is not exposed to any contaminants.

The user may refill a hydration pack by further filtering water entering the pump feeder tube 109 and/or drinking feeder tube 108. A filtration system in the pump feeder tube 109 and/or drinking feeder tube 108 may be the last line of defense, should the filtration systems incorporated in the hydration bladder 105 and pump system 101 fail. This arrangement may prevent contamination of the drinking feeder tube 108 and drinking return tube 102 by filtering water entering the pump feeder tube 109, thereby preventing an unfiltered liquid from contaminating the user who ultimately receives the liquid via bite valve 103.

In another embodiment of the design, a filtration system may be incorporated into the pump system 101. In such a design, a pump 101 combined with a filter or filter arrangement enables pumping and cleaning liquid simultaneously. A filter or filter arrangement used with the pump system 101 may be a more effective and powerful means of filtering liquid due to the pressure created and expelled within the pump 101. A filtration system, such as a filter or filter arrangement, provided within the pump system 101 may act as a backup or redundant filtration system should the filtration system incorporated within the bladder system 105 fail to remove all impurities, malfunction, or become unavailable.

From FIGS. 1 and 4, the present design contains an end piece 103 comprising a bite valve 407 covered by a bite valve cap. In one embodiment, bite valve 407 opens when the user bites on its end and sprays water that has been pressurized by the pump system 101. The bite valve may be connected to dual hose system 102 and 108, but may also connect to additional tubes or hoses. This design may contain a toggle, switch, button or other system integrated into the end piece, bite valve, end piece valve 110, or other component which may control the quantity and type of discharge of fluid from the end piece or related components.

The user may elect to spray a single stream of water from the end piece 103 when drinking, or the user may configure end piece 103 to spray a light mist of water to wash out debris from a person's eyes after contamination from an explosion produced by a military grenade or mine. A user may also configure the end piece 103 to discharge a shower pattern of water to wash out a wound suffered by a soldier in the field. The various different spray configurations may also be helpful in allowing a user to spray himself or herself down with water from the hydration system. The sprayer may also be configured into a single stream of water to clean items.

In another embodiment, a separate system may be provided for spray type functionality. A spray valve may be attached to a secondary tube or hose system or any other component. The system may also include a modular end piece 103 or end piece arrangement whereby the end piece may be quickly removed and exchanged from a bite valve component to a spray valve type component.

In another embodiment, end piece 103 may include an insulated or non-insulated dust cover that may be slipped over the bite valve. Such a cover helps prevent contamination of the end piece, bite valve 407, or other components. Insulation may be embedded or otherwise incorporated into end piece 103 or bite valve 407 to prevent the cooling or heating of internal liquid, depending on the current environment.

The present design may include a processor configured to monitor, initiate, and run various applications of the hydration system. Applications include, but are not limited to, sensing using system maintenance sensors, biological sensors, transmitting and retrieving information, performing GPS functions, tracking water consumption or any other manner of actions. The processor may utilize internal or external circuitry, sensors, power sources as well as numerous other components. The processor may utilize wired, wireless, Wi-Fi, Bluetooth or any other means to connect to various components on the hydration system as well as other unrelated systems.

FIGS. 1, 9A, 9B, and 9C show a carrying system or carrier apparatus holding various components of the system. For example, a carrier or carrying system may provide compartments for the dual tube system, including drinking return tube 102, hydration bladder 105, a manual pump 101, an electric pump, and/or any other components. This carrying system may employ various mounting configurations.

Figure 9A:
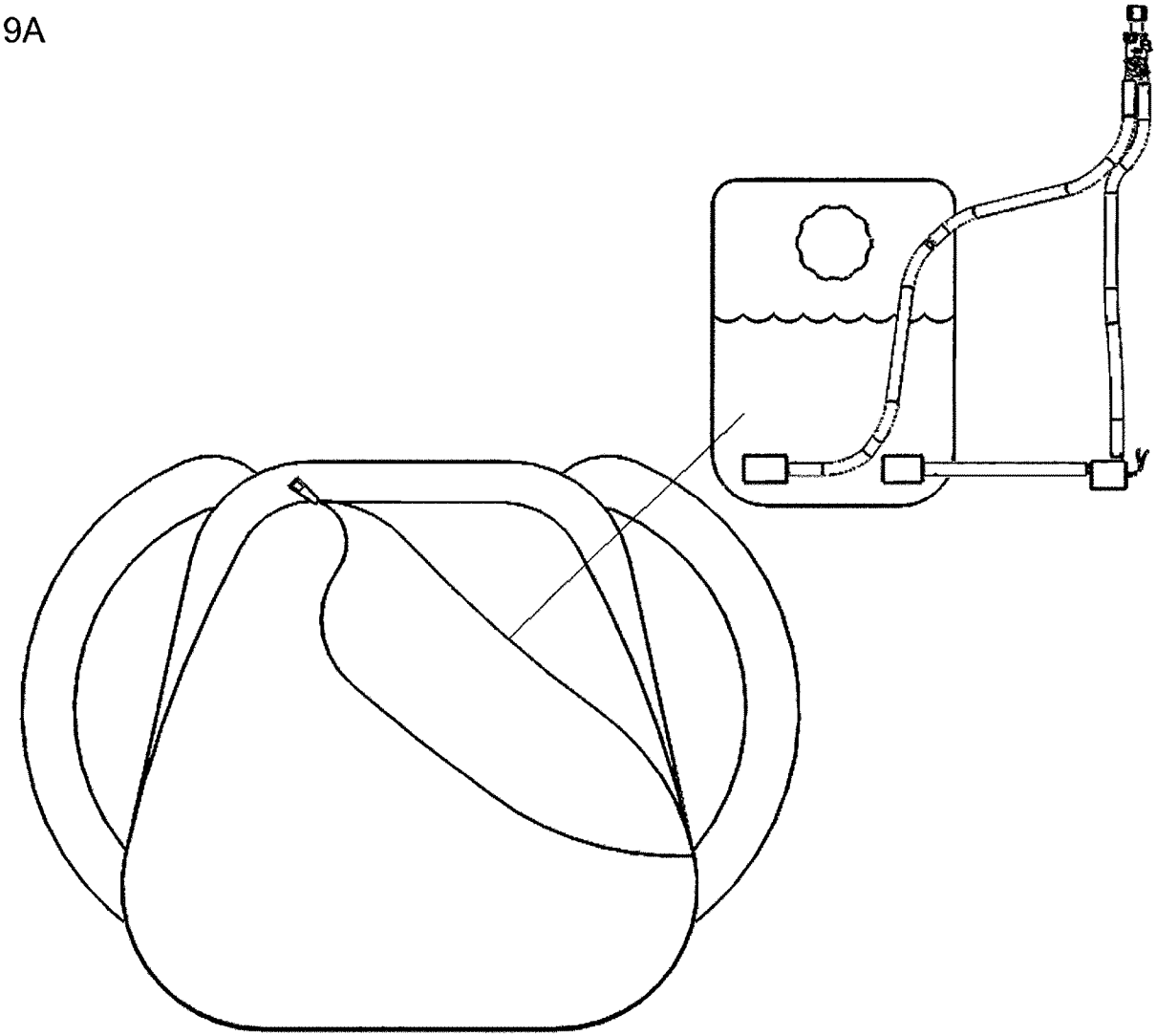
FIG. 9A shows a carrying system that may hold various components of the system.
Figure 9B:
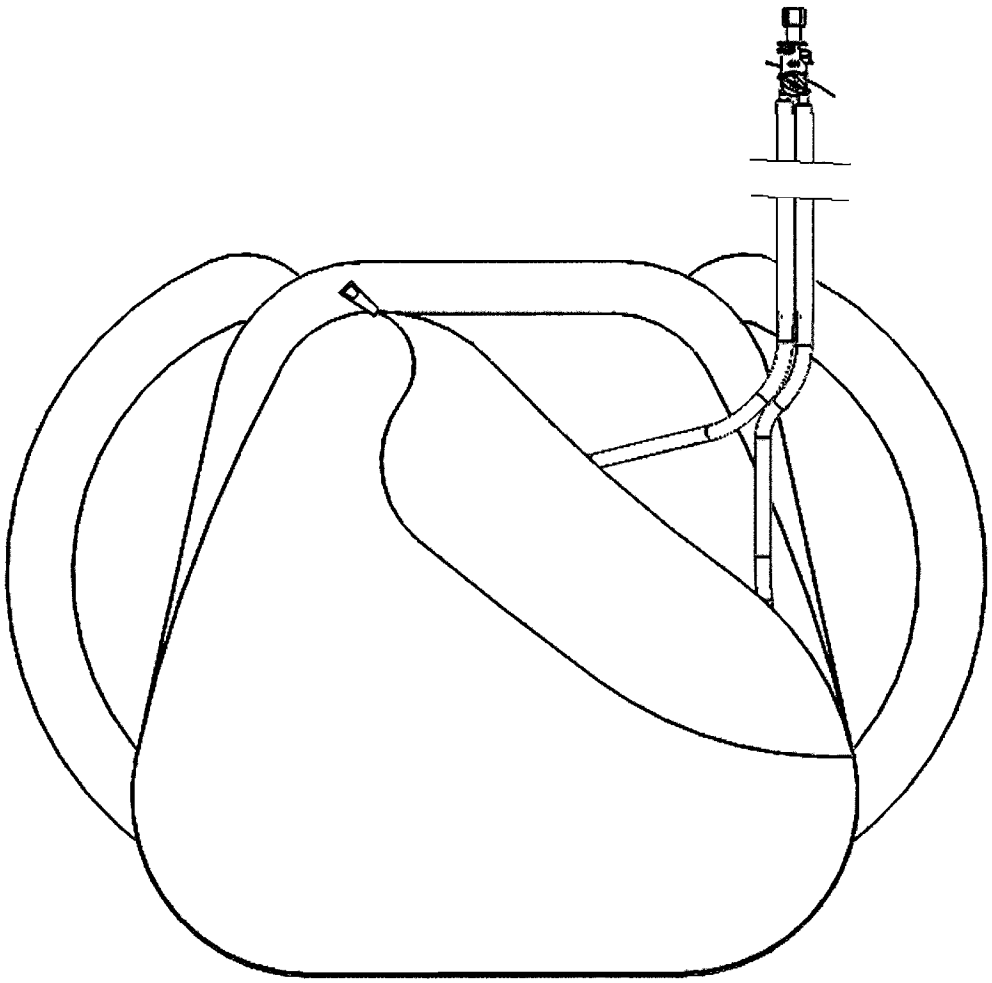
FIG. 9B illustrates a carrying system that incorporates an over-the-strap holding section for the hydration tubes and end piece.
Figure 9C:
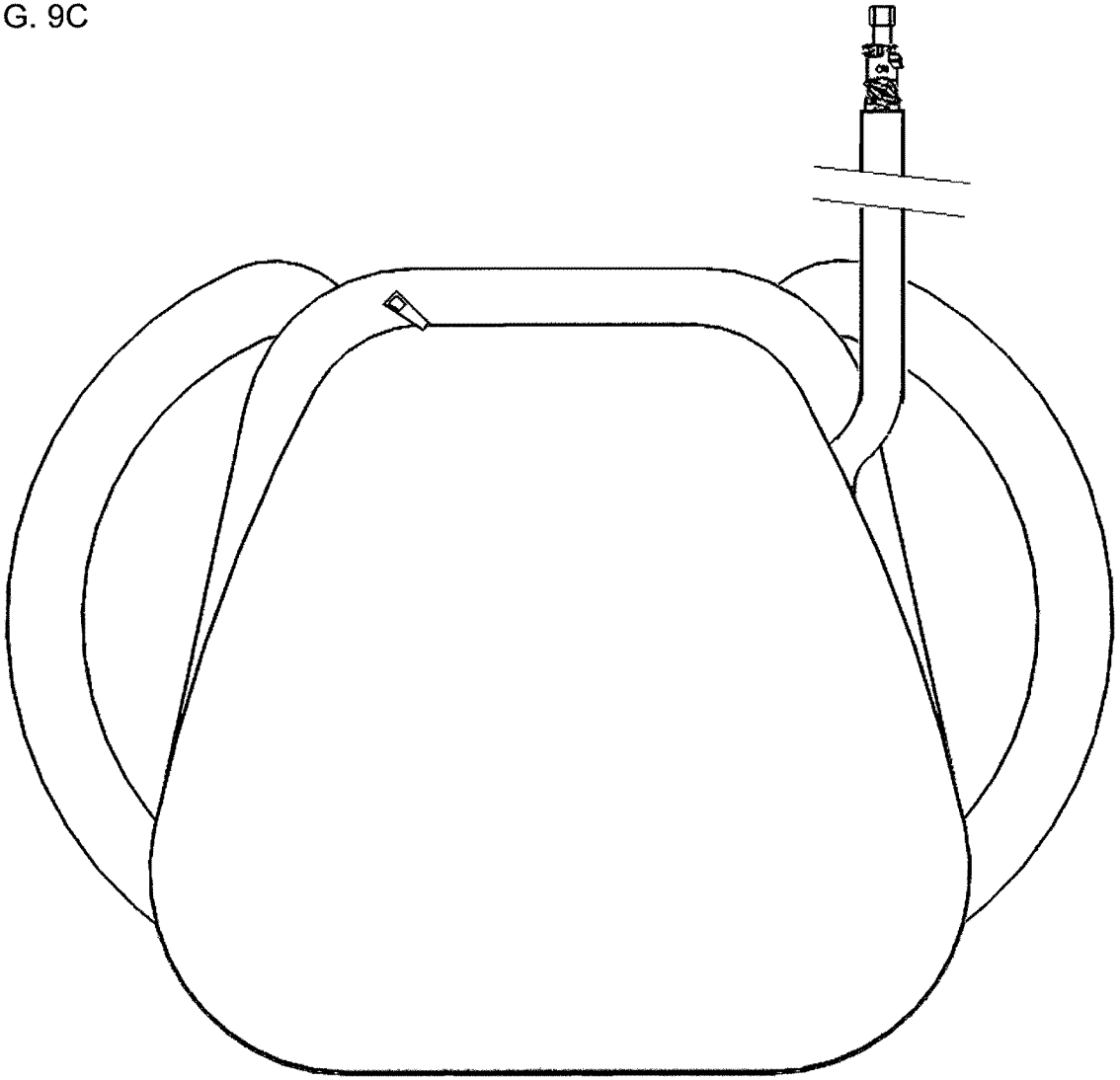
FIG. 9C illustrates another embodiment of a carrying system that incorporates an over-the-strap holding section for the hydration tube and end piece.
Figure 9D:
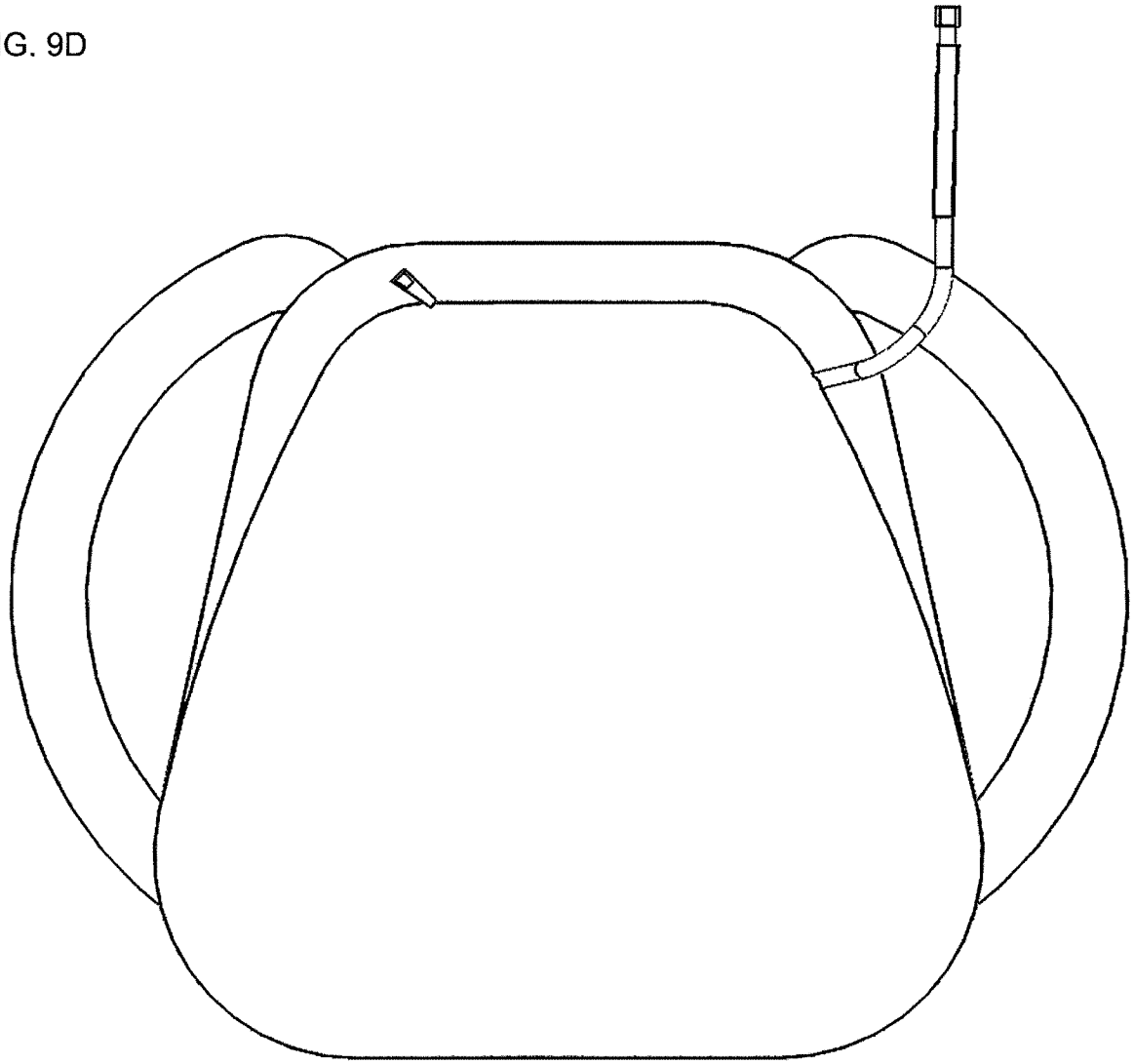
FIG. 9D shows a carrying system with the integration of a single-hose system.
Figure 9E:
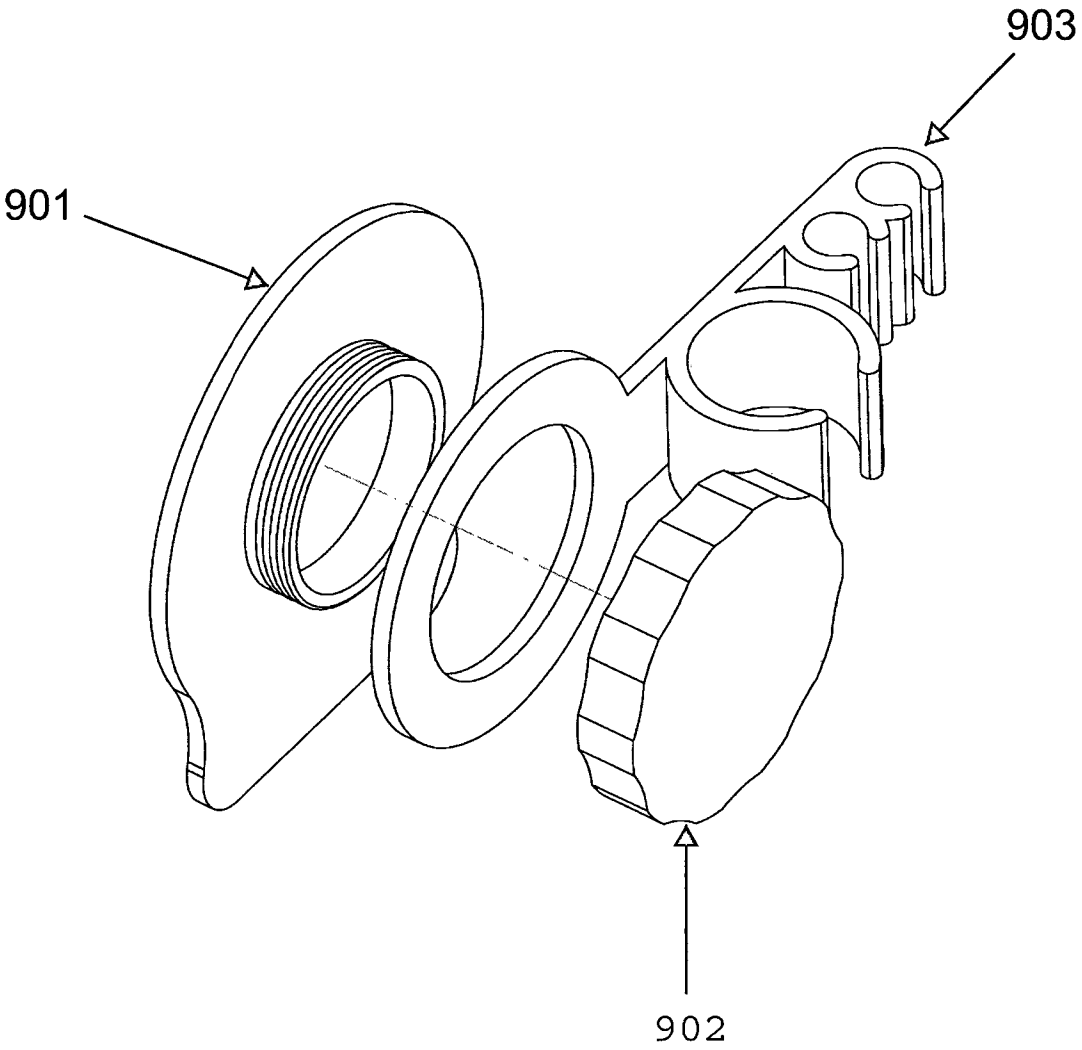
FIG. 9E illustrates the bladder opening with integrated bracket.

From FIG. 9E, the fill spout 901 for the hydration bladder may employ a removable cap 902 and a mounting bracket 903. Mounting bracket 903 may be designed to hold the pump system and the drinking tubes.

The hydration system may incorporate mounting points to connect the various parts of the system, such as the pump or pump system 101, hydration bladder 105, drinking return tube 102, drinking feeder tube 108, and/or other components. The aforementioned parts may also have complementary mounting points to make the system compact.

The carrying system may have an integrated heating and/or cooling system in the carrier. The heating and/or cooling system may include a power source, processor, wiring, circuitry, an activation mechanism, sensors, wired and/or wireless capabilities, and other components. These components may be integrated into the hydration system, utilize connection points as connections, or be designed as separate components. An activation system may include switches, sensors, timers, or any manner of device, which may be integrated into the carrier system, hydration system, or other components. The described heating and/or cooling system incorporated into the carrier system may be utilized as a freestanding component, or in conjunction with the heating and/or cooling system integrated into the hydration system.

FIG. 9D shows a carrying system with the integration of commercially available single hose hydration system.

The system may contain a component capable of being utilized as a quick fill system for hydration bladder 105. Such a component may be configured as an attachment point on hydration bladder 105, pump 101, drinking tubes 102, 108 and 109, end piece 103, or any other component. The quick fill system may allow the user to fill or recharge the hydration bladder 105 with liquid without the need to remove the hydration system from his or her person. The quick fill system may contain a filtration system to make the addition of any liquid into the bladder more efficient and safer for the user.

In another embodiment of the design, the hydration system may include a liquid measurement system and a means to indicate a fluid measurement to the wearer without removing the hydration system from his or her person. This information may be conveyed by a gauge, sound, vibration, electronic and/or over-the-air transmission of information to a secondary device such as smartphone, or any other means. This design may allow the user to view or otherwise understand how much liquid is being consumed and how much liquid remains inside the hydration system without having to remove and inspect the bladder.

In another embodiment of the design, a gas mask coupler may be employed. Such a connection point may be utilized to connect the drinking system of a gas mask to the hydration system, allowing a user wearing a gas mask to drink from/through the hydration system without having to remove the mask while in a dangerous or contaminated environment. The system may permit the addition or removal of other accessories, including but not limited to, water flavor enhancers and carbonation systems.

The system may incorporate a series of one-way valves provided in various locations throughout the hydration bladder, drinking tubes and within other components. Such valves may use the movement of the user to move liquid within the system. Such valves may provide a circulatory capability activated and facilitated by the kinetic movement of the user.

An external power source may be provided, or the system may utilize only kinetic energy to move liquid in a circulatory fashion using strategically placed one-way valve systems. Such a system may not need an external power source and may be automated. Alternately, an external power source may be incorporated into the system to provide ancillary capabilities or to augment the kinetic system. Additionally, a dedicated power source may be recharged using a kinetically activated system while in use by the wearer.

Figure 10A:
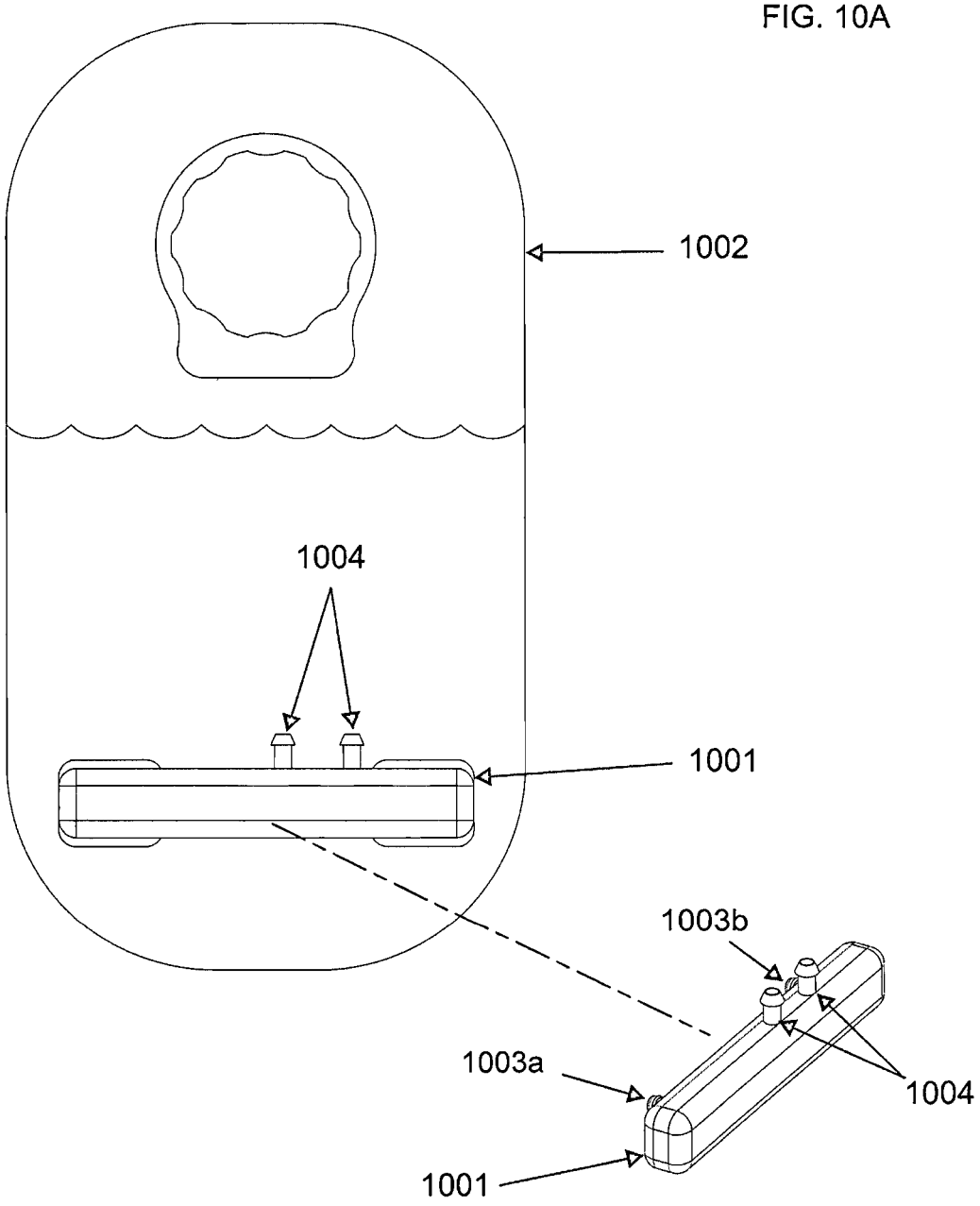
FIG. 10A is a version of the present design including a one-piece coupler system.
Figure 10B:
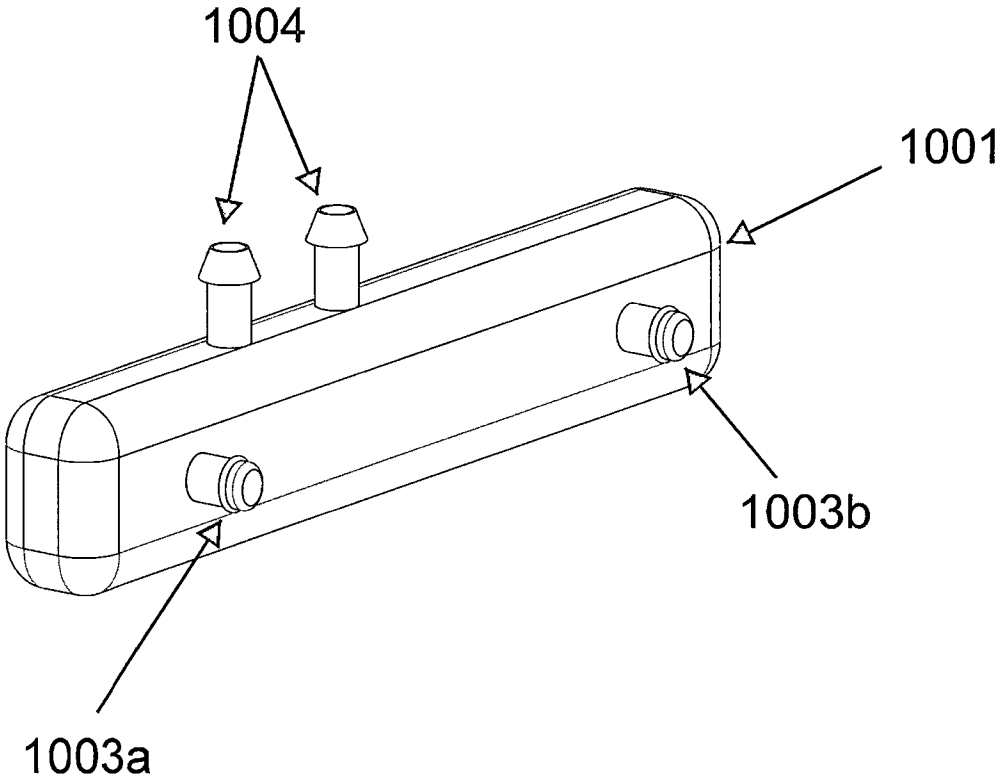
FIG. 10B is a perspective view of the one-piece coupler.
Figure 10C:
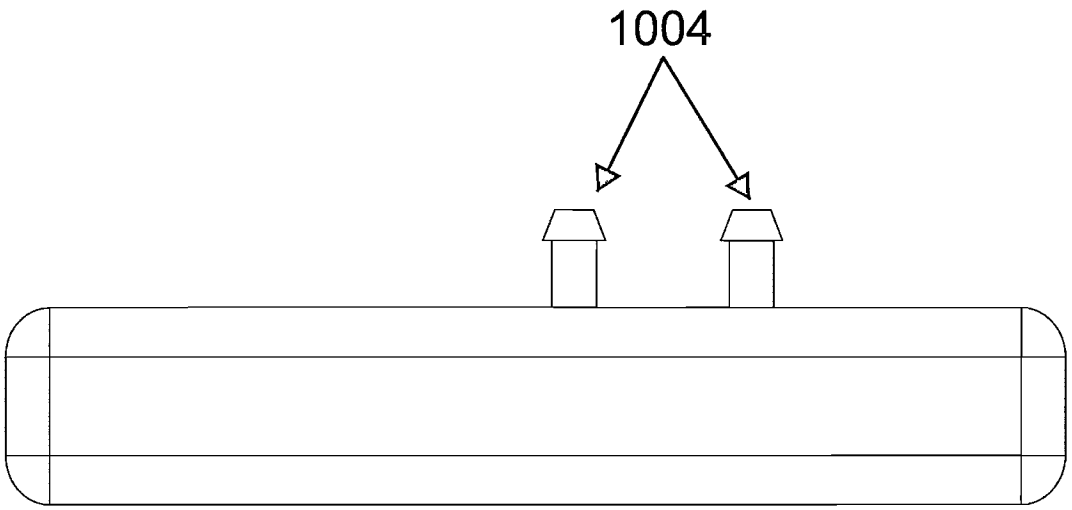
FIG. 10C shows a front view of the one-piece coupler.
Figure 10D:
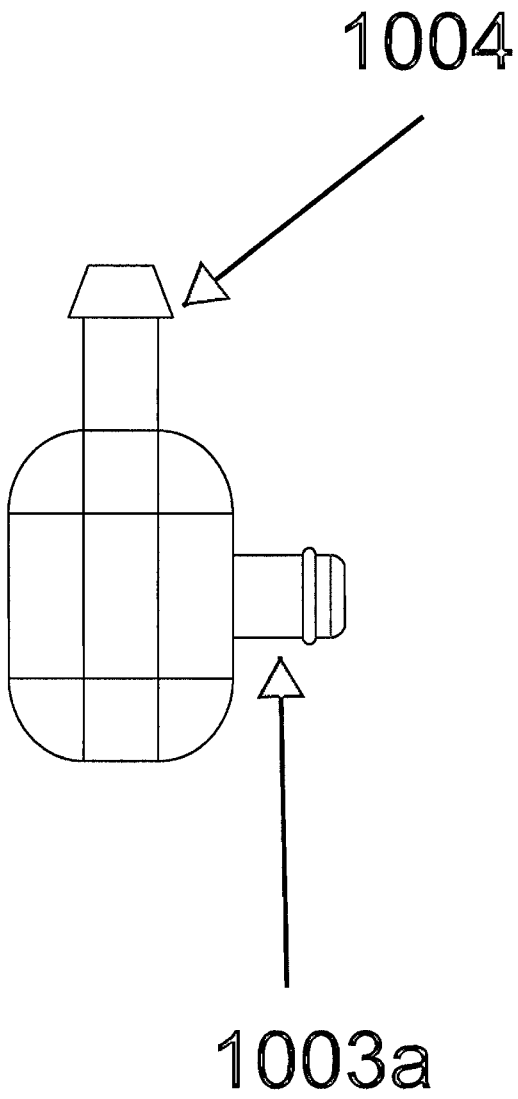
FIG. 10D represents a side view of the one-piece coupler.
Figure 10E:
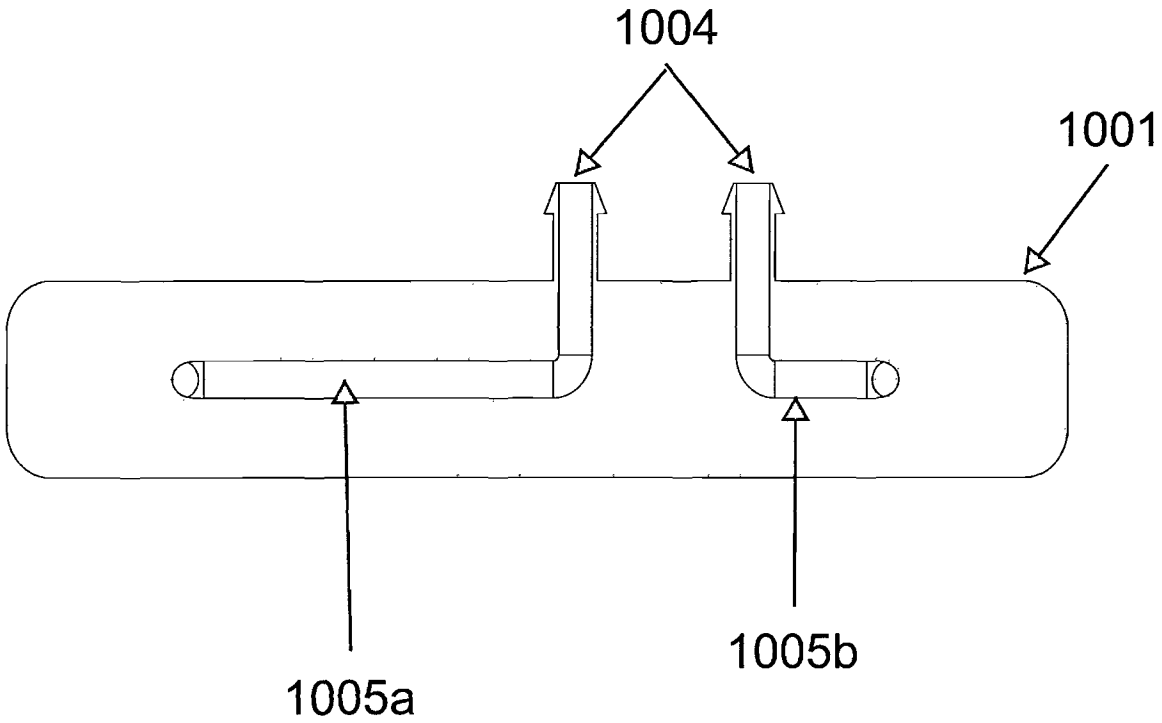
FIG. 10E is a cutaway view of the one-piece coupler.

FIG. 10A shows a version of the present design including a one-piece coupler system 1001. Coupler system 1001 has two separate series of tubes used to carry liquid out of and into hydration bladder 1002. Bottom openings 1003*a* and 1003*b* may be separated and may be attached to two openings in the body of hydration bladder 1002. The coupler system 1001 may include two connection points 1004 attaching the drinking tube feeder and the drinking tube return.

FIGS. 10B through 10H illustrate the interior and relevant components of the one-piece coupler system 1001. Coupler system 1001 has two separate tubes 1005*a* and 1005*b* that connect to separate openings in hydration bladder 1002 as well as to the drinking tube feeder and the drinking tube return.

Figure 10F:
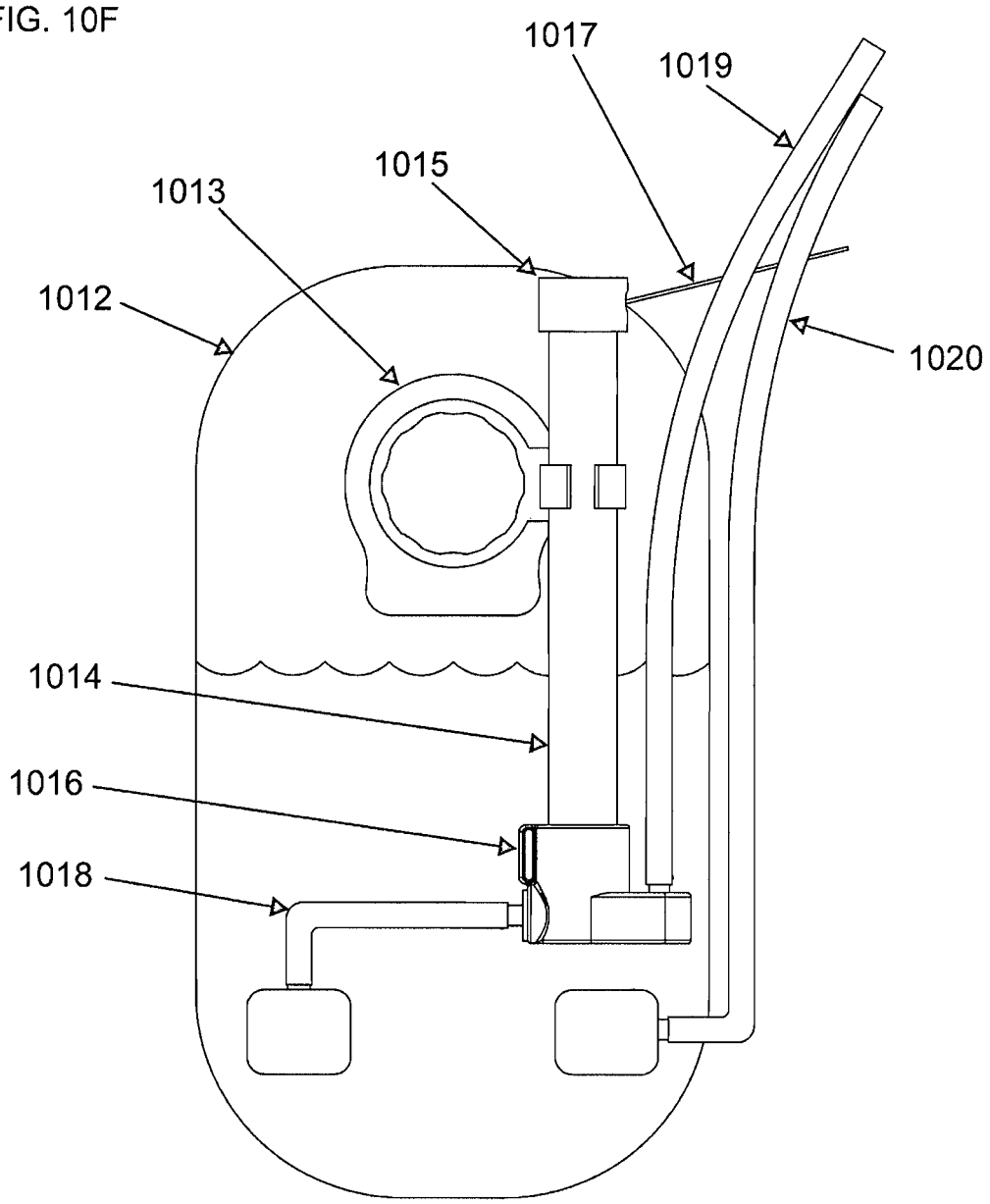
FIG. 10F shows a hydration bladder and associated components, including a one-piece coupler, according to the present design.
Figure 10G:
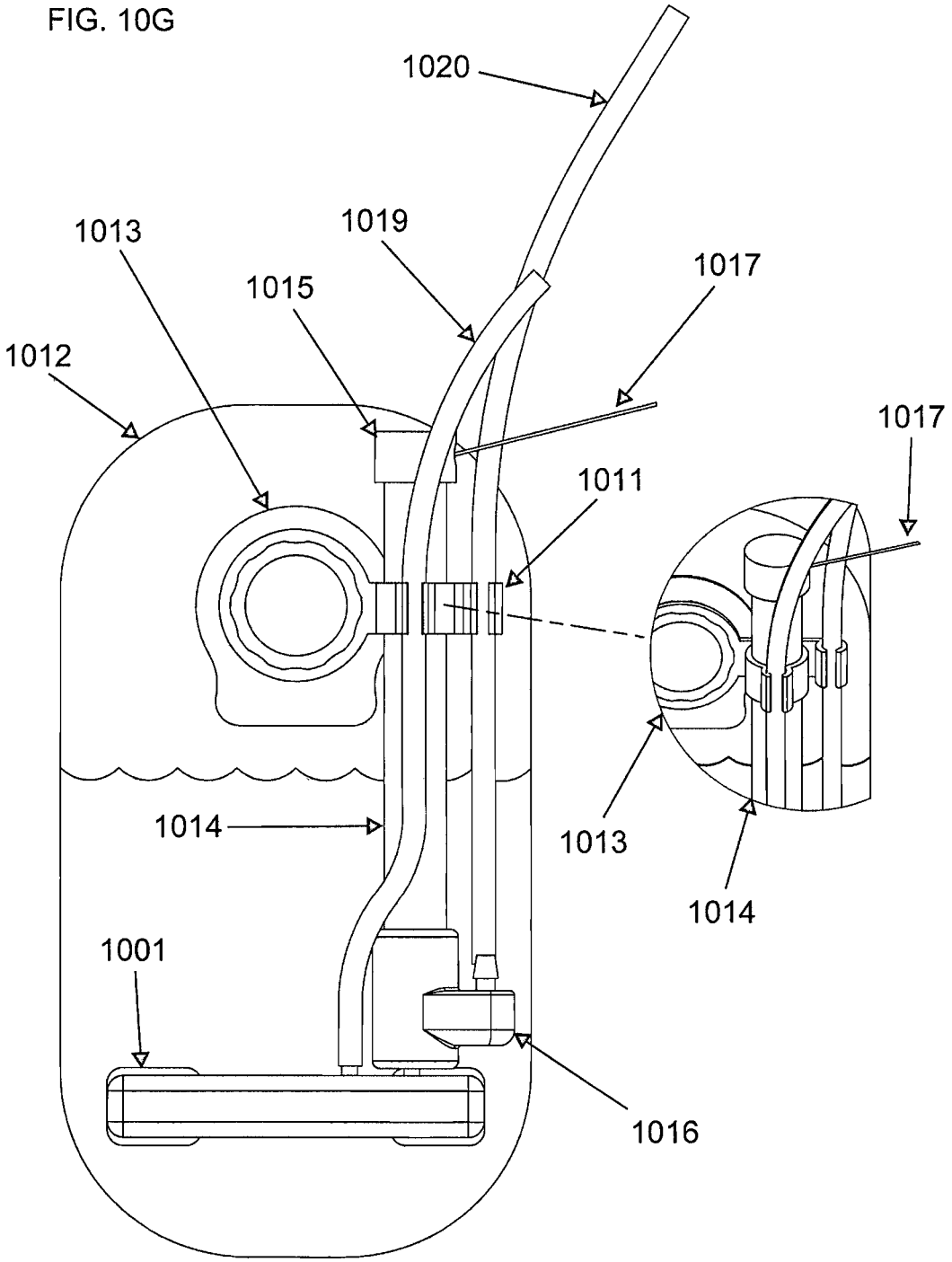
FIG. 10G is an alternate version of a hydration bladder and associated components, including a one-piece coupler, according to the present design.
Figure 10H:
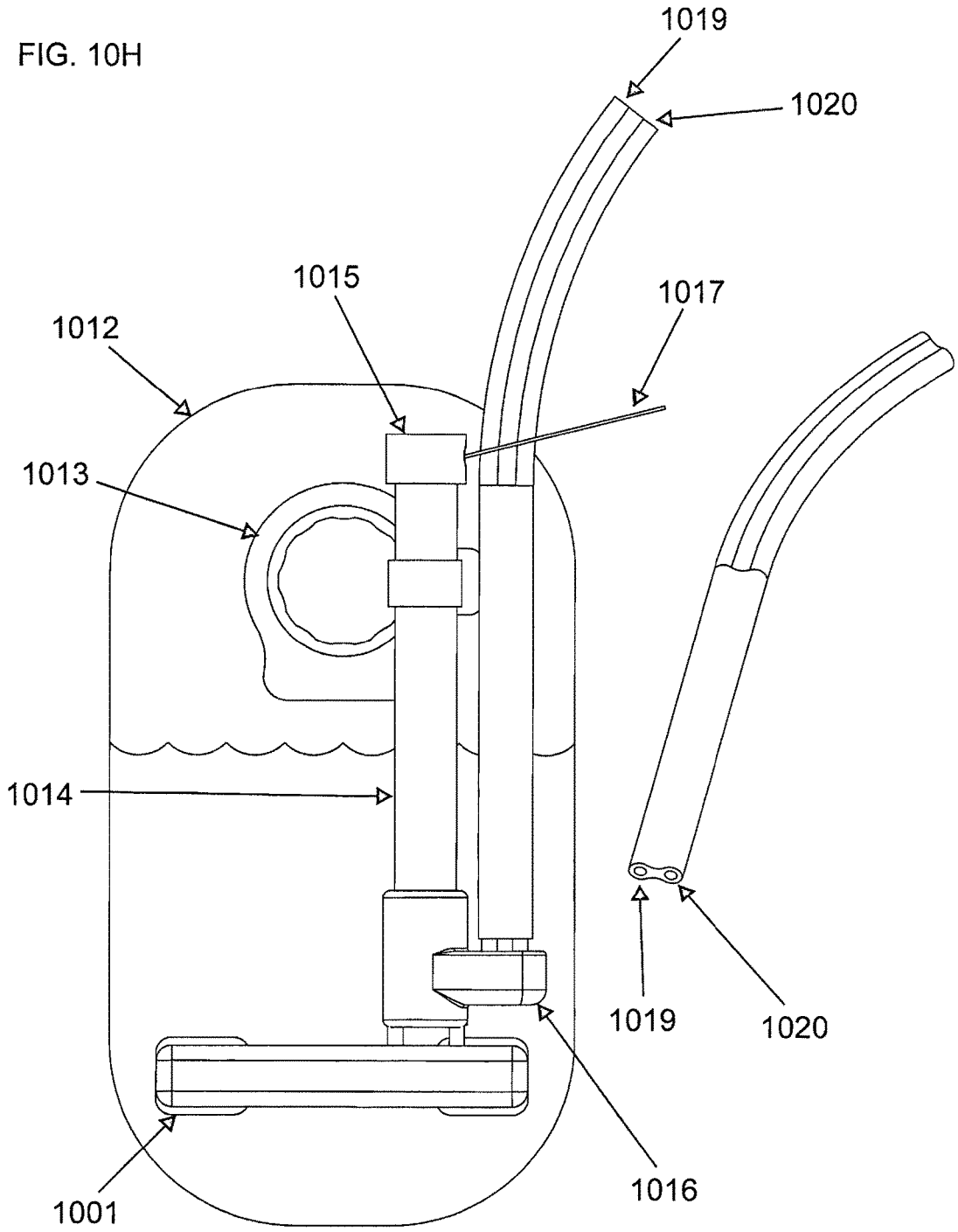
FIG. 10H illustrates another version of a hydration bladder and associated components, including a one-piece coupler, according to the present design.

FIG. 10F shows a hydration bladder 1002 with a bladder opening 1013, pump body 1014, top end cap 1015 and bottom end cap 1016, pull cord 1017, pump feed tube 1018, drinking tube feeder 1019 and drinking tube return 1020. FIG. 10G shows the drinking tube feeder 1019 and drinking tube return 1020 connected to mounting bracket 1021 which is connected to bladder opening 1013. The mounting bracket 1021 provides routing for the drinking tubes 1019 and 1020. FIG. 10H shows a design where the drinking tube feeder 1019 and the drinking tube return 1020 are enclosed within a single tube or hose, which may be simple and less prone to snagging.

Thus according to the present design, there is provided a hydration bladder or reservoir interconnected with multiple coupling points to allow water or other liquids to enter or leave the bladder. The couplers may connect the bladder to a pump, which circulates the liquid within the bladder around a dual hose system. This pump system may be operated manually or electrically and may connect the drinking and return hoses to an end piece or bite valve. The hose system may incorporate one or more hoses to connect the bladder, pump, and end piece. The end piece may have the ability to connect both drinking hoses, perform various sprays, and may be insulated.

According to another embodiment of the present design, there is provided a heating system or a cooling system that may be incorporated into the hydration bladder, pump system, drinking feeder tube, drinking return tube, end piece and/or the hydration carrier system. The heating system may utilize coils or other methods of heating, which may be activated manually or automatically by a sensor, switch, or other means. The cooling system may utilize refrigeration components such as cooling coils, or other cooling mechanisms. The cooling system may be activated manually or automatically, via a sensor, switch, or other means.

According to another embodiment of the present design, there is provided a filtration system. This filtration system may be incorporated into the hydration bladder, pump system, hose system, or any combination of components.

The filtration system may be integrated with or separately attached to the described components.

According to a further embodiment of the present design, there is provided a processor, which may monitor, initiate, and run various applications of the hydration system. The processor may be integrated into the hydration bladder, pump system, and/or hose system. The processor may employ wired, wireless, Wi-Fi, Bluetooth, or any other connectivity means or methodology to connect to various components of the hydration system.

According to another embodiment of the present design, there is provided a carrying system, which may incorporate mounting points to hold the various components of the system, or attach to different modes of transportation. The carrying system may incorporate a separate heating or cooling system to heat or cool liquids within the hydration system.

According to a further embodiment of the present design, the hydration system may contain numerous additional elements. These include, but are not limited to, a quick fill system, a liquid level meter, and a sensor system. These components may be attached to various elements of the hydration system.

According to another embodiment of the present design, a gas mask coupler may be employed, and the system may permit the addition or removal of other accessories to the end piece. The system may incorporate a series of one-way valves integrated throughout the hydration bladder, drinking tubes, and other components. An external power source may be incorporated into the design, or the design may include hardware that employs kinetic energy, either completely or partially.

The present hydration system may therefore include a bladder, container, or reservoir, a number of coupling points integrated into the bladder and other components, a pump connected to the bladder through various coupling points, a hose system protruding from the bladder and pump, and an end piece connected drinking hose apparatus. The pump system may include a manual pulling mechanism, pull cord handle, or any other means of manual actuation. The pump system may alternately include a manual pump system comprising of an internal plunger, spring and series of valves. Alternately, an electrical pump system may be incorporated into the hydration system. The pump system may include an electrical motor, electrical switch, or any other means of electric operation. If a switch is provided, the switch may be manual or electric and may control the activation of the pump system. The electrical pump system may include a motor, power source, activation system, circuitry, processor, and/or wired and wireless technologies. A hydration bladder may be provided for use with a heating system including a heating coil or other mechanism within or attached to the bladder, a heating controller powered by battery, solar, or any other means, an activation mechanism, and a processor with various cycles of operation.

A pump system may be provided and configured for use with a heating system including a heating coil or other mechanism within or attached to the pump system, a heating controller powered by battery, solar, or any other means, an activation mechanism, and a processor with various cycles of operation. The system may alternately include a hydration system having a hose system configured for use with a heating system including a heating coil or other mechanism within or attached to the hose system, a heating controller powered by battery, solar, or any other means, an activation mechanism, and a processor with various cycles of operation. A hydration bladder may be configured for use with a cooling system including a cooling coil or other mechanism within or attached to the bladder, a cooling controller powered by battery, solar, or any other means, an activation mechanism, and a processor with various cycles of operation. The pump system may be configured for use with a cooling system including a cooling coil or other mechanism within or attached to the pump, a cooling controller powered by battery, solar, or any other means, an activation mechanism, and a processor with various cycles of operation. The hose system may be configured for use with a cooling system including a cooling coil or other mechanism within or attached to the hose system, a cooling controller powered by battery, solar, or any other means, an activation mechanism, and a processor with various cycles of operation.

An end piece may be provided a cooling system comprising a cooling coil or other mechanism within or attached to the end piece, a cooling controller powered by battery, solar, or any other means, an activation mechanism, and a processor with various cycles of operation.

Various sensors and activation mechanisms which may be utilized to manually, remotely or automatically activate and manage various sensors, systems, pumps and other associated devices. The system may be employed with a filtration system or device, with the filtration system or device positioned in the hose system, end piece, or other appropriate location.

The system may include a processor with capabilities including, but not limited to a biological sensing, system maintenance sensing, liquid level metering, GPS tracking, informing user to consume liquid for preventative measures through audible or vibratory notifications, and/or tracking consumption for electronic applications or post-use data collection and analysis. A carrying system may be provided which may be employed to hold, clasp, or contain various components of the system. A sensor may be integrated into the hydration system, the sensor having the ability to gather and transmit data regarding, but not limited to, water levels, water flow, GPS position, temperature, valve control, circuitry information, status, and data, and biological information, status, and data. A quick fill system may be integrated or attached to the bladder opening or other component. A meter may be provided that measures the amount of liquid, liquid flow, and other data inside the hydration system, which may convey information via gauge, sound, vibration, or transmission to a secondary device. A coupler may be employed that may be used to connect additional components including gas masks, facemasks, and any other accessories that may connect to the end piece.

The design may further include a series of one-way valves powered by an external source or using kinetic energy, where the series of one-way valves may be provided within the hydration bladder, the drinking tubes, and/or other components of the hydration system.

A recirculating pump configured for use with a hydration pack comprising a dual tube system is provided. The recirculating pump includes openings to receive and pump liquids continued in a hydration bladder to allow the user to consistently receive cold water from the hydration pack through a dual drinking tube. This process would pump the warm water in the tube back into the hydration pack, replacing it with cold water from inside the hydration pack. The design may incorporate a heating system, which may be utilized to melt ice that is carried within the hydration bladder to provide cool water for an extended period of time. Conversely, the heating system may be utilized to carry and keep heated warm water for consumption in a cold environment. The pumping system may be designed to actively spray water from the hydration system.

According to one aspect of the present design, there is provided a hydration system comprising a container configured to receive and maintain a quantity of liquid, a pump connected to the container, a hose system comprising a plurality of hoses connected to the container and the pump and configured to receive liquid from the container, and an end piece connected to one of the plurality of hoses configured to be used by a user of the hydration system. The pump is configured to circulate liquid through the hose system and container to maintain a relatively similar liquid temperature for all liquid contained in the hose system and container.

According to another aspect of the present design, there is provided a hydration system comprising a deformable container configured to receive and maintain a quantity of liquid, a pump, and a hose system comprising a plurality of hoses connected to the deformable container and the pump and configured to receive liquid from the deformable container. The deformable container is configured to be worn on a person and the pump is configured to circulate liquid through the hose system and deformable container.

According to another aspect of the present design, there is provided a hydration system comprising a deformable container configured to be maintained on the person of a user and further configured to receive and maintain a quantity of liquid, a pump, and a hose system comprising an end piece and a plurality of hoses connected to both the deformable container and the pump and configured to receive liquid from the deformable container and provide liquid in a desired manner. The pump is configured to circulate liquid through the hose system and deformable container.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the example and designs described herein, but is to be accorded the widest scope consistent with the principles and novel features disclosed herein.

Certain devices are described herein as being a single device while others are described as multiple devices, and it is to be understood that the invention is not limited to the devices described but single or multiple devices may be employed where multiple and single devices, respectively, are described, as long as the functionality described is performed. The foregoing and other concepts disclosed herein are intended to be interpreted broadly and not limit the scope of the present invention.

What is claimed is:

1. A hydration system comprising:

a container configured to receive and maintain a quantity of liquid;

a pump connected to the container via a first fluid passageway; and a three opening end piece connected at a first opening to the container by a second fluid passageway;

wherein the three opening end piece is connected at a second opening to the pump by a third fluid passageway;

wherein the three opening end piece comprises an integrally formed user selectable valve rotatable to permit a user to direct fluid out of the hydration system through a third opening or recirculate liquid via the first opening to the second fluid passageway, the container, the first fluid passageway, the pump, the third fluid passageway, and to the second opening in the three opening end piece;

wherein the pump comprises a user pull cord activated mechanical pump comprising a valve arrangement configured to selectively control intake of fluid into the pump and dispersal of fluid out of the pump in desired directions.

2. The hydration system of claim 1, further comprising a plurality of liquid coupling points provided within the container, wherein the pump is connected to the container through at least one coupling point.

3. The hydration system of claim 1, wherein the pump comprises an internal plunger, a spring, and the valve arrangement comprising a series of valves.

4. The hydration system of claim 1, further comprising a heating system comprising a heating element configured to heat liquid within one of the container, the pump, and the hose arrangement.

5. The hydration system of claim 1, further comprising cooling hardware configured to cool liquid within one of the container, the pump, and the hose arrangement.

6. The hydration system of claim 1, further comprising at least one liquid filter.

7. The hydration system of claim 1, further comprising a carrying system configured to maintain the container and the pump on a person.

8. A hydration system comprising:

a deformable container configured to receive and maintain a quantity of liquid;

a pump;

a three opening selector piece; and a fluid passageway system comprising:

a first fluid passageway connecting the pump and the deformable container;

a second fluid passageway connecting the deformable container and the three opening selector piece; and a third fluid passageway connecting the three opening selector piece and the pump;

wherein the deformable container is configured to be worn on a person and the pump is configured to circulate liquid to the three opening selector piece, to the container, and back to the pump;

wherein the three opening selector piece comprises an integrally formed user selectable valve rotatable to permit a user to direct liquid out of the hydration system through one opening or redirect liquid through the fluid passageway system via a second opening;

wherein the pump comprises a user pull cord activated mechanical pump comprising a valve arrangement configured to selectively control intake of fluid into the pump and dispersal of fluid out of the pump in desired directions.

9. The hydration system of claim 8, wherein the pump is manual.

10. The hydration system of claim 8, further comprising at least one of a heating arrangement, a cooling arrangement, and a filter arrangement.

11. The hydration system of claim 8, wherein the three opening selector piece redirects liquid via the second opening to the third fluid passageway.

12. A hydration system comprising:

a deformable container configured to be maintained on the person of a user and further configured to receive and maintain a quantity of liquid;

a pump;

a three opening selector piece; and a fluid passageway system comprising:

a first fluid passageway connecting the pump and the deformable container;

a second fluid passageway connecting the deformable container and the three opening selector piece; and a third fluid passageway connecting the three opening selector piece and the pump;

wherein the three opening selector piece comprises an integrally formed user selectable valve rotatable to permit the user to direct liquid out of the hydration system through one opening or cause liquid to recirculate by flowing from the pump to the three opening selector piece to the container and back to the pump;

wherein the pump comprises a user pull cord activated mechanical pump comprising a valve arrangement configured to selectively control intake of fluid into the pump and dispersal of fluid out of the pump in desired directions.

13. The hydration system of claim 12, wherein the pump is manual.

14. The hydration system of claim 12, further comprising at least one of a heating arrangement, a cooling arrangement, and a filter arrangement.

15. The hydration system of claim 12, wherein the three opening selector piece enables the user to selectively direct fluid to the third fluid passageway.

* * * * *